US009108403B2

(12) United States Patent
Kawatoko et al.

(10) Patent No.: US 9,108,403 B2
(45) Date of Patent: Aug. 18, 2015

(54) PRINTING APPARATUS AND PRINTING METHOD

(71) Applicant: CANON KABUSHIKI KAISHA, Tokyo (JP)

(72) Inventors: Norihiro Kawatoko, Yokohama (JP); Masashi Hayashi, Yokohama (JP); Hitoshi Nishikori, Inagi (JP); Osamu Iwasaki, Tokyo (JP); Tomoki Yamamuro, Kawasaki (JP); Atsuhiko Masuyama, Yokohama (JP); Fumiko Suzuki, Kawasaki (JP); Satoshi Masuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/046,152

(22) Filed: Oct. 4, 2013

(65) Prior Publication Data

US 2014/0104335 A1 Apr. 17, 2014

(30) Foreign Application Priority Data

Oct. 11, 2012 (JP) ..... 2012-225998

(51) Int. Cl.
*B41J 29/38* (2006.01)
*B41J 2/07* (2006.01)
*B41J 2/21* (2006.01)

(52) U.S. Cl.
CPC *B41J 2/07* (2013.01); *B41J 2/2121* (2013.01); *B41J 2/2128* (2013.01)

(58) Field of Classification Search
USPC ..... 347/5, 9, 12, 14, 15
See application file for complete search history.

(56) References Cited

U.S. PATENT DOCUMENTS

| | | | |
|---|---|---|---|
| 6,846,066 | B2 | 1/2005 | Teshikawara et al. |
| 6,877,833 | B2 | 4/2005 | Teshigawara et al. |
| 7,249,815 | B2 | 7/2007 | Keller et al. |
| 7,410,239 | B2 | 8/2008 | Takahashi et al. |
| 7,618,116 | B2 | 11/2009 | Hamasaki et al. |
| 7,959,246 | B2 | 6/2011 | Hamasaki et al. |
| 8,251,480 | B2 | 8/2012 | Moriyama et al. |
| 2012/0287191 | A1 | 11/2012 | Nishikori et al. |
| 2012/0287193 | A1 | 11/2012 | Suzuki et al. |
| 2012/0287194 | A1 | 11/2012 | Masuda et al. |

*Primary Examiner* — Lam Nguyen
(74) *Attorney, Agent, or Firm* — Fitzpatrick, Cella, Harper & Scinto

(57) ABSTRACT

A printing apparatus including a print head including nozzle groups each having nozzles, each of the nozzle groups applying ink having a plurality of volumes from the nozzles to form dots including dots differing in size, including: an arrangement determination unit to determine an arrangement of dots to be formed by each of the nozzle groups; a size determination unit to determine sizes of ink ejected to print the dots determined by the arrangement determination unit, according to respective ejection characteristics of the nozzle groups, such that a print characteristic of an image based on the dot arrangement determined by the arrangement determination unit is within a predetermined range; and an ejection control unit to control the print head to eject ink having the plurality of sizes determined by the size determination unit in positions of a print medium based on the arrangement determined by the arrangement determination unit.

18 Claims, 39 Drawing Sheets

| FIG.1A | |
|---|---|
| | FIG.1B |

| threshold | Out | Evaluation |
|---|---|---|
| 255 | | |
| | Level4 | 255 |
| 224 | | |
| | Level3 | 192 |
| 160 | | |
| | Level2 | 128 |
| 96 | | |
| | Level1 | 64 |
| 32 | | |
| | Level0 | 0 |
| 0 | | |

C

D

| | SMALL DOT | LARGE DOT | LARGE-TO-SMALL DOT RATIO |
|---|---|---|---|
| Level 0 | 0 | 0 | - |
| Level 1 | 0.5 | 0.5 | 1 : 1 |
| Level 2 | 1 | 1 | 1 : 1 |
| Level 3 | 1.5 | 1.5 | 1 : 1 |
| Level 4 | 2 | 2 | 1 : 1 |

A ● PRINT DOT ARRANGEMENT

B ☆ SELECTED PRINT DOT

C-1 ◎ LARGE DOT
○ SMALL DOT

D-1 ◎ LARGE DOT
○ SMALL DOT

E

F

C-2 INTEGRATED POTENTIAL AFTER ARRANGEMENT OF 1 DOT

PRINT DOT EXISTS

| | 0 | 1 | 2 | 3 | 4 | 5 | 6 | 7 |
|---|---|---|---|---|---|---|---|---|
| 0 | 72 | 54 | 42 | 36 | 42 | 54 | 72 | 80 |
| 1 | 116 | 76 | 49 | 42 | 49 | 76 | 116 | 141 |
| 2 | 410 | 169 | 76 | 54 | 76 | 169 | 410 | 635 |
| 3 | 2506 | 410 | 116 | 72 | 116 | 410 | 2506 | 10006 |
| 4 | 10006 | 635 | 141 | 80 | 141 | 635 | 10006 | 50004 |
| 5 | 2506 | 410 | 116 | 72 | 116 | 410 | 2506 | 10006 |
| 6 | 410 | 169 | 76 | 54 | 76 | 169 | 410 | 635 |
| 7 | 116 | 76 | 49 | 42 | 49 | 76 | 116 | 141 |

C-3

D-2

PRINT DOT EXISTS

| | 0 | 1 | 2 | 3 | 4 | 5 | 6 | 7 |
|---|---|---|---|---|---|---|---|---|
| 0 | 482 | 2560 | 10048 | 2542 | 452 | 170 | 144 | 196 |
| 1 | 285 | 486 | 684 | 452 | 218 | 152 | 170 | 217 |
| 2 | 486 | 285 | 217 | 170 | 152 | 218 | 452 | 684 |
| 3 | 2560 | 482 | 196 | 144 | 170 | 452 | 2542 | 10048 |
| 4 | 10082 | 751 | 282 | 196 | 217 | 684 | 10048 | 50053 |
| 5 | 2675 | 820 | 751 | 482 | 285 | 486 | 2560 | 10082 |
| 6 | 820 | 2675 | 10082 | 2560 | 486 | 285 | 482 | 751 |
| 7 | 751 | 10082 | 50053 | 10048 | 684 | 217 | 196 | 282 |

D-3 INTEGRATED POTENTIAL AFTER ARRANGEMENT OF 2 DOTS

A-1

B-1

C-1

A-2 SINGLE DOT POTENTIAL (4,4)
(4,4)=50000, 10000/(DISTANCE)4 IN OTHER POSITIONS

| | 0 | 1 | 2 | 3 | 4 | 5 | 6 | 7 |
|---|---|---|---|---|---|---|---|---|
| 0 | 9 | 16 | 25 | 34 | 39 | 34 | 25 | 16 |
| 1 | 16 | 30 | 59 | 100 | 123 | 100 | 59 | 30 |
| 2 | 25 | 59 | 156 | 400 | 625 | 400 | 156 | 59 |
| 3 | 34 | 100 | 400 | 2500 | 10000 | 2500 | 400 | 100 |
| 4 | 39 | 123 | 625 | 10000 | 50000 | 10000 | 625 | 123 |
| 5 | 34 | 100 | 400 | 2500 | 10000 | 2500 | 400 | 100 |
| 6 | 25 | 59 | 156 | 400 | 625 | 400 | 156 | 59 |
| 7 | 16 | 30 | 59 | 100 | 123 | 100 | 59 | 30 |

B-2 SINGLE DOT POTENTIAL (0,0)
(0,0)=50000, 10000/(DISTANCE)4 IN OTHER POSITIONS

| | 0 | 1 | 2 | 3 | 4 | 5 | 6 | 7 |
|---|---|---|---|---|---|---|---|---|
| 0 | 50000 | 10000 | 625 | 123 | 39 | 16 | 7 | 4 |
| 1 | 10000 | 2500 | 400 | 100 | 34 | 14 | 7 | 4 |
| 2 | 625 | 400 | 156 | 59 | 25 | 11 | 6 | 3 |
| 3 | 123 | 100 | 59 | 30 | 16 | 8 | 4 | 2 |
| 4 | 39 | 34 | 25 | 16 | 9 | 5 | 3 | 2 |
| 5 | 16 | 14 | 11 | 8 | 5 | 4 | 2 | 1 |
| 6 | 7 | 7 | 6 | 4 | 3 | 2 | 1 | 1 |
| 7 | 4 | 4 | 3 | 2 | 2 | 1 | 1 | 1 |

C-2 SINGLE DOT POTENTIAL (0,0)
WITH BOUNDARY CONDITIONS

| | 0 | 1 | 2 | 3 | 4 | 5 | 6 | 7 |
|---|---|---|---|---|---|---|---|---|
| 0 | 50004 | 10006 | 635 | 141 | 80 | 141 | 635 | 10006 |
| 1 | 10006 | 2506 | 410 | 116 | 72 | 116 | 410 | 2506 |
| 2 | 635 | 410 | 169 | 76 | 54 | 76 | 169 | 410 |
| 3 | 141 | 116 | 76 | 49 | 42 | 49 | 76 | 116 |
| 4 | 80 | 72 | 54 | 42 | 36 | 42 | 54 | 72 |
| 5 | 141 | 116 | 76 | 49 | 42 | 49 | 76 | 116 |
| 6 | 635 | 410 | 169 | 76 | 54 | 76 | 169 | 410 |
| 7 | 10006 | 2506 | 410 | 116 | 72 | 116 | 410 | 2506 |

| SMALL DOT [%] | LARGE DOT [%] | TOTAL LARGE/ SMALL DOTS [%] |
|---|---|---|
| 100 | 0 | 100 |
| 90 | 10 | 100 |
| 80 | 20 | 100 |
| 70 | 30 | 100 |
| 60 | 40 | 100 |
| 50 | 50 | 100 |
| 40 | 60 | 100 |
| 30 | 70 | 100 |
| 20 | 80 | 100 |
| 10 | 90 | 100 |
| 0 | 100 | 100 |

| LARGE DOT [%] | AVERAGE INK VOLUME [ng] |
|---|---|
| 0 | 2 |
| 10 | 2.1 |
| 20 | 2.2 |
| 30 | 2.3 |
| 40 | 2.4 |
| 50 | 2.5 |
| 60 | 2.6 |
| 70 | 2.7 |
| 80 | 2.8 |
| 90 | 2.9 |
| 100 | 3 |

| INK VOLUME ERROR [%] | INK VOLUME PER DOT | PRESENT INVENTION LARGE/SMALL DOTS [ng] | |
|---|---|---|---|
| | CONVENTIONAL ART | SMALL DOT | LARGE DOT |
| -20 | 2 | 1.67 | 2.50 |
| -16 | 2.1 | 1.75 | 2.63 |
| -12 | 2.2 | 1.83 | 2.75 |
| -8 | 2.3 | 1.92 | 2.88 |
| -4 | 2.4 | 2.00 | 3.00 |
| 0 | 2.5 | 2.08 | 3.13 |
| 4 | 2.6 | 2.17 | 3.25 |
| 8 | 2.7 | 2.25 | 3.38 |
| 12 | 2.8 | 2.33 | 3.50 |
| 16 | 2.9 | 2.42 | 3.63 |
| 20 | 3 | 2.50 | 3.75 |

| INK VOLUME ERROR [%] | PRESENT INVENTION LARGE-TO-SMALL USAGE RATIO [%] | | |
|---|---|---|---|
| | SMALL DOT USAGE RATIO | LARGE DOT USAGE RATIO | TOTAL LARGE-TO-SMALL DOT USAGE RATIO |
| -20 | 0 | 100 | 100 |
| -16 | 14 | 86 | 100 |
| -12 | 27 | 73 | 100 |
| -8 | 39 | 61 | 100 |
| -4 | 50 | 50 | 100 |
| 0 | 60 | 40 | 100 |
| 4 | 69 | 31 | 100 |
| 8 | 78 | 22 | 100 |
| 12 | 86 | 14 | 100 |
| 16 | 93 | 7 | 100 |
| 20 | 100 | 0 | 100 |

| INK VOLUME ERROR [%] | INK VOLUME PER DOT | | PRESENT INVENTION LARGE/SMALL DOTS [ng] | | PRESENT INVENTION LARGE-TO-SMALL USAGE RATIO [%] | |
|---|---|---|---|---|---|---|
| | CONVEN-TIONAL ART [ng] | PRESENT INVENTION [ng] | SMALL DOT | LARGE DOT | SMALL DOT USAGE RATIO | LARGE DOT USAGE RATIO |
| -20 | 2 | 2.5 | 1.67 | 2.50 | 0 | 100 |
| -16 | 2.1 | 2.5 | 1.75 | 2.63 | 14 | 86 |
| -12 | 2.2 | 2.5 | 1.83 | 2.75 | 27 | 73 |
| -8 | 2.3 | 2.5 | 1.92 | 2.88 | 39 | 61 |
| -4 | 2.4 | 2.5 | 2.00 | 3.00 | 50 | 50 |
| 0 | 2.5 | 2.5 | 2.08 | 3.13 | 60 | 40 |
| 4 | 2.6 | 2.5 | 2.17 | 3.25 | 69 | 31 |
| 8 | 2.7 | 2.5 | 2.25 | 3.38 | 78 | 22 |
| 12 | 2.8 | 2.5 | 2.33 | 3.50 | 86 | 14 |
| 16 | 2.9 | 2.5 | 2.42 | 3.63 | 93 | 7 |
| 20 | 3 | 2.5 | 2.50 | 3.75 | 100 | 0 |

QUANTIZATION LEVEL

A

| | | | |
|---|---|---|---|
| L1 | L1 | L1 | L1 |
| L1 | L1 | L1 | L1 |
| L1 | L1 | L1 | L1 |
| L1 | L1 | L1 | L1 |

B

| | | | |
|---|---|---|---|
| L2 | L2 | L2 | L2 |
| L2 | L2 | L2 | L2 |
| L2 | L2 | L2 | L2 |
| L2 | L2 | L2 | L2 |

C

| | | | |
|---|---|---|---|
| L3 | L3 | L3 | L3 |
| L3 | L3 | L3 | L3 |
| L3 | L3 | L3 | L3 |
| L3 | L3 | L3 | L3 |

D

| | | | |
|---|---|---|---|
| L4 | L4 | L4 | L4 |
| L4 | L4 | L4 | L4 |
| L4 | L4 | L4 | L4 |
| L4 | L4 | L4 | L4 |

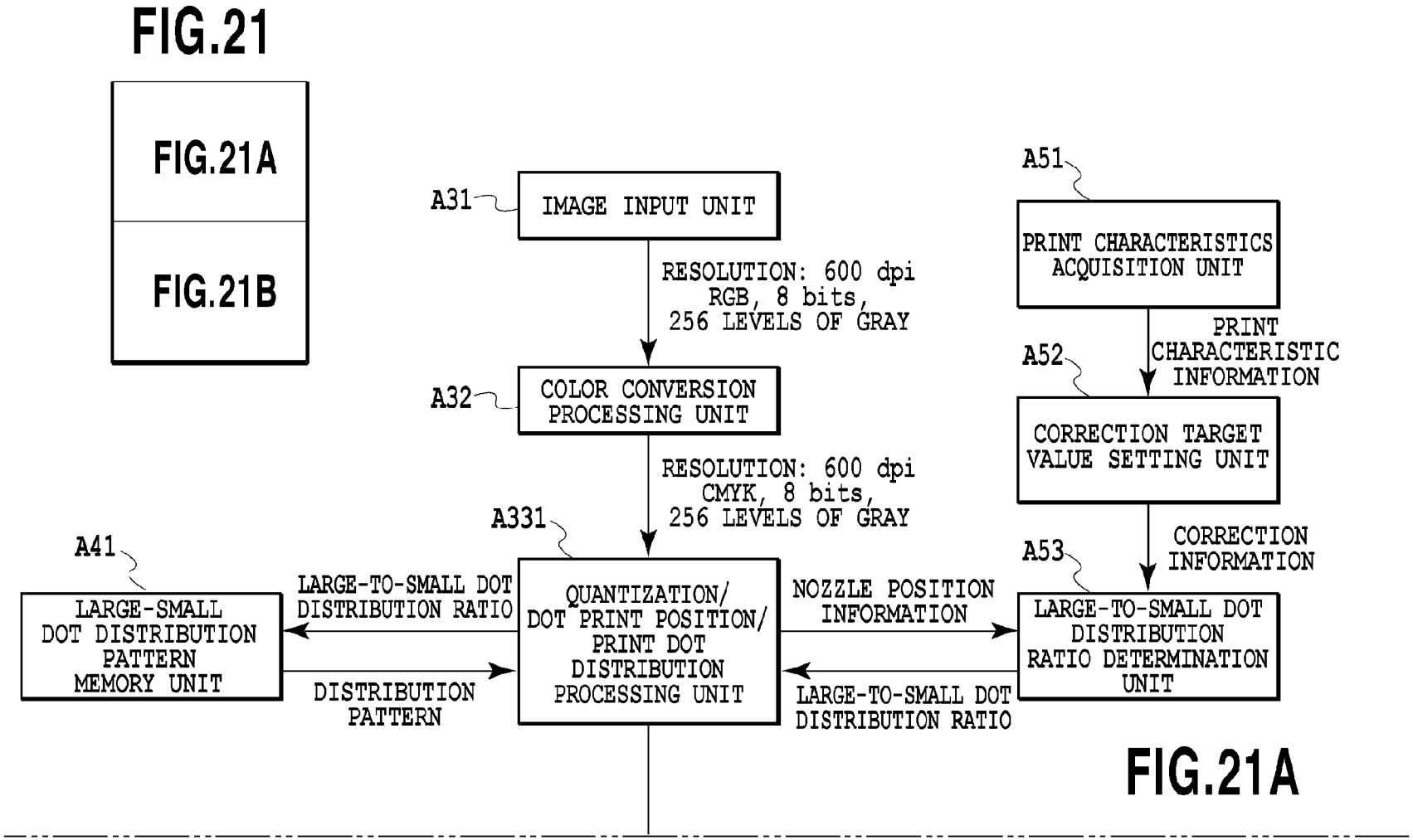
FIG.21
FIG.21A
FIG.21B
IMAGE INPUT UNIT
A31
RESOLUTION: 600 dpi
RGB, 8 bits,
256 LEVELS OF GRAY
COLOR CONVERSION PROCESSING UNIT
A32
RESOLUTION: 600 dpi
CMYK, 8 bits,
256 LEVELS OF GRAY
QUANTIZATION/ DOT PRINT POSITION/ PRINT DOT DISTRIBUTION PROCESSING UNIT
A331
LARGE-TO-SMALL DOT DISTRIBUTION RATIO
DISTRIBUTION PATTERN
LARGE-SMALL DOT DISTRIBUTION PATTERN MEMORY UNIT
A41
NOZZLE POSITION INFORMATION
LARGE-TO-SMALL DOT DISTRIBUTION RATIO
LARGE-TO-SMALL DOT DISTRIBUTION RATIO DETERMINATION UNIT
A53
CORRECTION INFORMATION
CORRECTION TARGET VALUE SETTING UNIT
A52
PRINT CHARACTERISTIC INFORMATION
PRINT CHARACTERISTICS ACQUISITION UNIT
A51
FIG.21A

| FIG.24A | FIG.24B |
|---|---|

A

| | | | |
|---|---|---|---|
| 64 | 64 | 64 | 64 |
| 64 | 64 | 64 | 64 |
| 64 | 64 | 64 | 64 |
| 64 | 64 | 64 | 64 |

B-1

| | | | |
|---|---|---|---|
| 32 | 32 | 32 | 32 |
| 32 | 32 | 32 | 32 |
| 32 | 32 | 32 | 32 |
| 32 | 32 | 32 | 32 |

B-2

| | | | |
|---|---|---|---|
| 32 | 32 | 32 | 32 |
| 32 | 32 | 32 | 32 |
| 32 | 32 | 32 | 32 |
| 32 | 32 | 32 | 32 |

C

| | | | | | | | |
|---|---|---|---|---|---|---|---|
| 31 | 91 | 203 | 143 | 15 | 83 | 195 | 151 |
| 131 | 231 | 87 | 51 | 139 | 223 | 79 | 27 |
| 127 | 3 | 251 | 159 | 119 | 19 | 187 | 215 |
| 219 | 183 | 55 | 107 | 163 | 239 | 95 | 35 |
| 71 | 59 | 179 | 247 | 39 | 115 | 243 | 175 |
| 235 | 191 | 23 | 67 | 211 | 135 | 7 | 75 |
| 103 | 11 | 155 | 207 | 63 | 99 | 147 | 255 |
| 227 | 167 | 47 | 123 | 171 | 199 | 111 | 43 |

FIG.26A

D-1 (DOT ON)

| | | | | | | | |
|---|---|---|---|---|---|---|---|
| 31 | 91 | 203 | 143 | 15 | 83 | 195 | 151 |
| 131 | 231 | 87 | 51 | 139 | 223 | 79 | 27 |
| 127 | 3 | 251 | 159 | 119 | 19 | 187 | 215 |
| 219 | 183 | 55 | 107 | 163 | 239 | 95 | 35 |
| 71 | 59 | 179 | 247 | 39 | 115 | 243 | 175 |
| 235 | 191 | 23 | 67 | 211 | 135 | 7 | 75 |
| 103 | 11 | 155 | 207 | 63 | 99 | 147 | 255 |
| 227 | 167 | 47 | 123 | 171 | 199 | 111 | 43 |

D-2 (LARGE DOT)

E-1 (DOT ON)

| | | | | | | | |
|---|---|---|---|---|---|---|---|
| 31 | 91 | 203 | 143 | 15 | 83 | 195 | 151 |
| 131 | 231 | 87 | 51 | 139 | 223 | 79 | 27 |
| 127 | 3 | 251 | 159 | 119 | 19 | 187 | 215 |
| 219 | 183 | 55 | 107 | 163 | 239 | 95 | 35 |
| 71 | 59 | 179 | 247 | 39 | 115 | 243 | 175 |
| 235 | 191 | 23 | 67 | 211 | 135 | 7 | 75 |
| 103 | 11 | 155 | 207 | 63 | 99 | 147 | 255 |
| 227 | 167 | 47 | 123 | 171 | 199 | 111 | 43 |

E-2 (SMALL DOT)

F

LARGE DOT

SMALL DOT

C-1 FOR LARGE NOZZLE SECOND ARRAY

| | | | | | | | |
|---|---|---|---|---|---|---|---|
| 31 | | | 143 | 15 | | | |
| | | | | | 223 | 79 | |
| 127 | | | 159 | | | | |
| | | | | | 239 | 95 | |
| | | | | | | | 175 |
| | 191 | | | | | | |
| | | | 207 | 63 | | | 255 |
| | | 47 | | | | 111 | |

D-1 FOR SMALL NOZZLE SECOND ARRAY

| | | | | | | | |
|---|---|---|---|---|---|---|---|
| | 91 | 203 | | | | | |
| | | | | 139 | | | 27 |
| | | 251 | | | | 187 | |
| 219 | | | 107 | | | | |
| | 59 | | | | | | |
| 235 | | | | | | | 75 |
| | 11 | 155 | | | | | |
| | | | 123 | 171 | | | 43 |

C-2 FOR LARGE NOZZLE SECOND ARRAY

| | | | | | | | |
|---|---|---|---|---|---|---|---|
| 31 | | | 143 | 15 | | | |
| | | | | | 223 | 79 | |
| 127 | | | 159 | | | | |
| | | | | | 239 | 95 | |
| | | | | | | | 175 |
| | 191 | | | | | | |
| | | | 207 | 63 | | | 255 |
| | | 47 | | | | 111 | |

DOT ON

D-2 FOR SMALL NOZZLE SECOND ARRAY

| | | | | | | | |
|---|---|---|---|---|---|---|---|
| | 91 | 203 | | | | | |
| | | | | 139 | | | 27 |
| | | 251 | | | | 187 | |
| 219 | | | 107 | | | | |
| | 59 | | | | | | |
| 235 | | | | | | | 75 |
| | 11 | 155 | | | | | |
| | | | 123 | 171 | | | 43 |

DOT ON

C-3 FOR LARGE NOZZLE SECOND ARRAY

| | | | | | | | |
|---|---|---|---|---|---|---|---|
| 31 | | | 143 | 15 | | | |
| | | | | | 223 | 79 | |
| 127 | | | 159 | | | | |
| | | | | | 239 | 95 | |
| | | | | | | | 175 |
| | 191 | | | | | | |
| | | | 207 | 63 | | | 255 |
| | | 47 | | | | 111 | |

DOT ON

D-3 FOR SMALL NOZZLE SECOND ARRAY

| | | | | | | | |
|---|---|---|---|---|---|---|---|
| | 91 | 203 | | | | | |
| | | | | 139 | | | 27 |
| | | 251 | | | | 187 | |
| 219 | | | 107 | | | | |
| | 59 | | | | | | |
| 235 | | | | | | | 75 |
| | 11 | 155 | | | | | |
| | | | 123 | 171 | | | 43 |

DOT ON

C-4 FOR LARGE NOZZLE SECOND ARRAY

| | | | | | | | |
|---|---|---|---|---|---|---|---|
| 31 | | | 143 | 15 | | | |
| | | | | | 223 | 79 | |
| 127 | | | 159 | | | | |
| | | | | | 239 | 95 | |
| | | | | | | | 175 |
| | 191 | | | | | | |
| | | | 207 | 63 | | | 255 |
| | | 46 | | | | 111 | |

DOT ON

D-4 FOR SMALL NOZZLE SECOND ARRAY

| | | | | | | | |
|---|---|---|---|---|---|---|---|
| | 91 | 203 | | | | | |
| | | | | 139 | | | 27 |
| | | 251 | | | | 187 | |
| 219 | | | 107 | | | | |
| | 59 | | | | | | |
| 235 | | | | | | | 75 |
| | 11 | 155 | | | | | |
| | | | 123 | 171 | | | 43 |

DOT ON

C-5 FOR LARGE NOZZLE SECOND ARRAY

| | | | | | | | |
|---|---|---|---|---|---|---|---|
| ◎ | | | | ◎ | | | |
| | | | | | | | |
| | | | | | | | |
| | | | | | | | |
| | | | | | | | |
| | | | | ◎ | | | |
| | | ◎ | | | | | |

◎ LARGE DOT

D-5 FOR SMALL NOZZLE SECOND ARRAY

| | | | | | | | |
|---|---|---|---|---|---|---|---|
| | | | | | | | |
| | | | | | | | ○ |
| | | | | | | | |
| | | | | | | | |
| | ○ | | | | | | |
| | | | | | | | |
| | ○ | | | | | | |
| | | | | | | | ○ |

○ SMALL DOT

FIG.29B

PRINTING APPARATUS AND PRINTING METHOD

BACKGROUND OF THE INVENTION

1. Field of the Invention

The present invention relates to a printing apparatus and a printing method for correcting density variations resulting from differences in print characteristics among predetermined nozzle groups of a plurality of ink ejection nozzles.

2. Description of the Related Art

There is known an ink jet printing apparatus which includes a print head provided with a plurality of nozzles for ink ejection and ejecting ink drops to form ink dots on a print medium to print characters and images.

Nozzles differing in diameter for each position in a single substrate of a print head eject different volumes of ink according to their diameters even if other printing conditions are the same, and as a result, variations may occur in size of ink dots formed on a print medium. In addition, in the case of a print head employing a piezoelectric element which ejects ink by an applied pressure as a printing element, differences in material and working precision of the piezoelectric element may affect a displacement of the ink volume that the print head can eject. Accordingly, in a printing apparatus provided with a print head having many nozzles arranged therein, ejected ink volumes vary depending on the print characteristic of each nozzle, causing variations in size of the formed ink dots, which may result in density variations in images.

To correct such density variations, that is, differences in the ink volume used for printing, control for compensating differences in the ink volume based on the number of ink dots used for printing is conventionally known. U.S. Pat. No. 7,249,815 discloses a printing apparatus comprising a plurality of nozzles arranged according to a predetermined distribution, the plurality of nozzles having a target average droplet volume and an actual average droplet volume wherein a subset of the plurality of nozzles is sized larger than others of the plurality of nozzles, and a controller configured to selectively drive nozzles. The controller corrects print density by selecting nozzles to drive such that the actual average droplet volume is equal to the target average droplet volume.

According to the printing apparatus disclosed in U.S. Pat. No. 7,249,815, print density is corrected. On the other hand, however, a pattern formed by printed dots (hereinafter referred to as "a dot pattern") is different from a dot pattern formed when the correction is not performed. This is because positions of dots printed on a print medium differ between the nozzles selectively driven for print density correction and the nozzles driven when the print density correction is not performed.

For this reason, the conventional technique had a problem that making a significant correction above a certain level results successfully in print density correction but disadvantageously in visual recognition of a difference in a dot pattern, leading to degradation in image quality. On the other hand, to ensure that image quality is maintained, a range of print density correction is limited.

SUMMARY OF THE INVENTION

It is an object of the present invention to correct density variations which result from differences in print characteristics among predetermined nozzles and also to achieve an extended range that the print characteristics can be corrected while maintaining image quality without degradation of the image quality caused by a difference in a dot pattern which is associated with the correction.

To solve the above problem, the present invention provides a printing apparatus provided with a print head including a plurality of nozzle groups each consisting of a plurality of nozzles, each of the plurality of nozzle groups applying ink having a plurality of volumes from the plurality of nozzles onto a print medium to form a plurality of dots including dots differing in size for printing, the printing apparatus including: an arrangement determination unit configured to determine an arrangement of dots to be formed by each of the plurality of nozzle groups on the print medium; a size determination unit configured to determine sizes of ink ejected to print the dots determined by the arrangement determination unit, according to respective ejection characteristics of the plurality of nozzle groups, such that a print characteristic of an image to be printed based on the dot arrangement determined by the arrangement determination unit is within a predetermined range; and an ejection control unit configured to control the print head to eject ink having the plurality of sizes determined by the size determination unit in positions of the print medium based on the arrangement determined by the arrangement determination unit.

The present invention provides a printing apparatus and a printing method for correcting density variations resulting from differences in print characteristics of nozzles among predetermined portions, while improving degradation of image quality caused by a visual detection of differences in print patterns.

Further features of the present invention will become apparent from the following description of exemplary embodiments (with reference to the attached drawings).

BRIEF DESCRIPTION OF THE DRAWINGS

FIG. 21 is a diagram showing the relationship between FIGS. 21A and 21B;

FIGS. 21A and 21B are schematic diagrams of image processing in accordance with a third embodiment of the present invention;

FIGS. 26A and 26B illustrate large-small dot distribution patterns of the fourth embodiment of the present invention;

FIGS. 29A and 29B illustrate large-small dot distribution patterns of the fifth embodiment of the present invention.

DESCRIPTION OF THE EMBODIMENTS

Hereinafter, embodiments of the present invention will be described in detail with reference to the drawings.

First Embodiment

Overview of Line Printer

Figure 2:
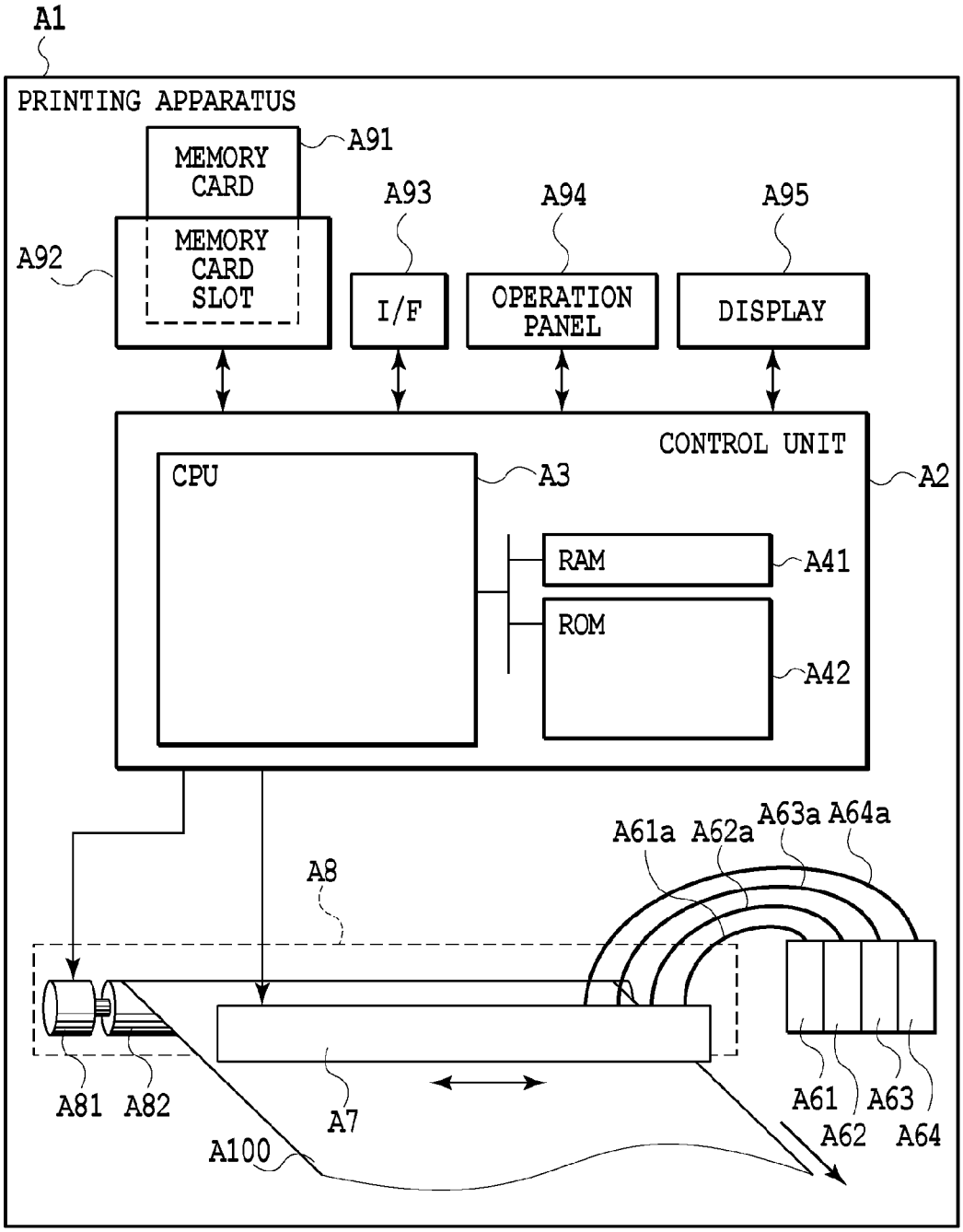
FIG. 2 is a schematic block diagram illustrating the structure of a printing apparatus to which the present invention is applicable.

FIG. 2 is a schematic block diagram illustrating the structure of a printing apparatus A1 in accordance with a first embodiment of the present invention. The printing apparatus A1 is an ink jet line printer and includes a control unit A2, ink cartridges A61 to A64, a print head A7, a print medium conveying mechanism A8, and the like as shown in FIG. 2. The ink cartridges A61 to A64 include cyan (C), magenta (M), yellow (Y), and black (K) inks, respectively.

The print head A7 is a line head-type thermal print head and includes a plurality of nozzles arranged in a direction perpendicular to a conveying direction of a print medium on a surface facing a print medium. Through ink introduction tubes A61*a* to A64*a*, the inks in the ink cartridges A61 to A64 are supplied to the nozzles in the print head A7 each having an opening on a surface facing a print medium A100 and are ejected from the openings of the nozzles to print the print medium A100. The print head A7 will be described later in detail with reference to FIGS. 3A and 3B.

The print medium conveying mechanism A8 has a paper feed motor A81 and a paper feed roller A82. The paper feed motor A81 causes the paper feed roller A82 to rotate so that the print medium A100 on the paper feed roller A82 is conveyed in a direction perpendicular to a rotation axis of the paper feed roller A82. Thereby, the print medium A100 is conveyed to a position where the print head A7 can print the print medium A100.

The control unit A2 includes a CPU (A3), a RAM (A41), and a ROM (A42) and controls operations of the above-described print head A7 and paper feed roller A82. The CPU (A3) expands, in the RAM (A41), control programs stored in the ROM (A42) and executes them to perform various kinds of processing on an image as will be described later, generate image data to be printed by use of the print head A7, and perform control on the print medium conveying mechanism A8 and the like.

Figure 3A:
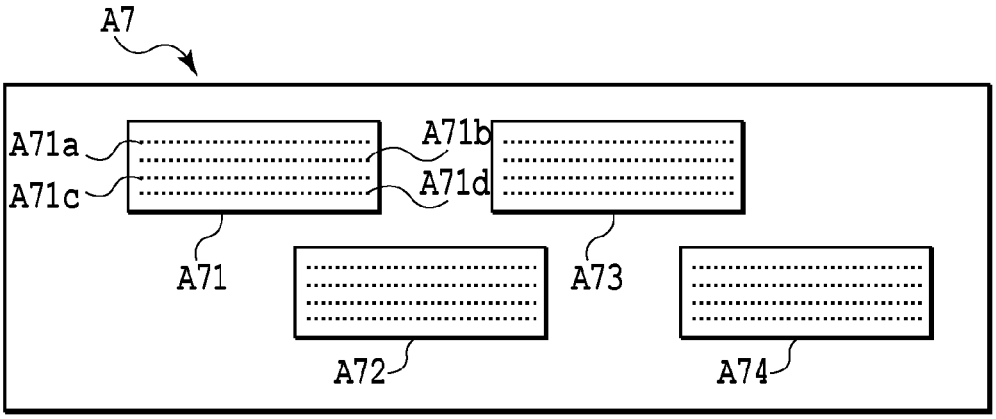
FIG. 3A is an illustrative diagram showing the structure of a print head in detail.

FIG. 3A is an illustrative diagram showing the structure of the print head A7 in detail. As shown in FIG. 3A, the print head A7 of the present embodiment has a plurality of print chips A71 to A74 arranged in a nozzle array direction, each print chip having a plurality of nozzle arrays, each consisting of a plurality of ink ejection nozzles. Paper feeding (conveyance of a print medium) and ink ejection timing are adjusted so that ink drops ejected from the respective print chips form print dots on the print medium on the same column extending in the conveying direction of the print medium.

Incidentally, the number of print chips in the print head is four in the present example, but is not limited thereto in the present invention. In addition, a plurality of print chips is arranged in a zigzag pattern in the present example, but is not limited thereto in the present invention. The print chips may be arranged in line.

Figure 3B:
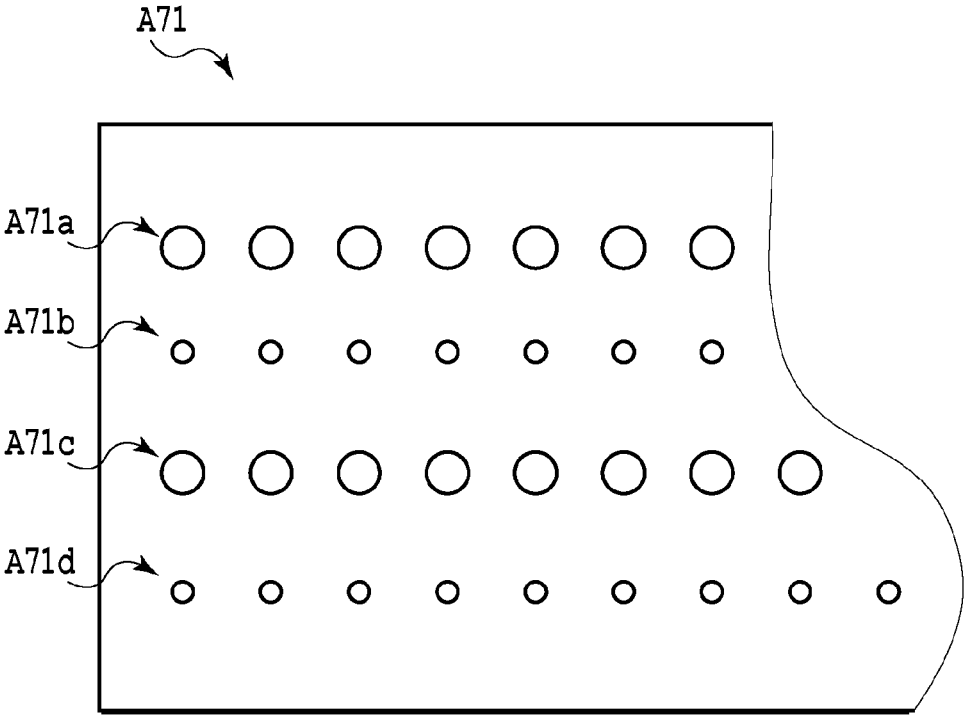
FIG. 3B is an illustrative diagram showing a print chip included in the print head.

FIG. 3B is a diagram illustrating the print chip A71 which is one of the print chips included in the print head A7. The print chip A71 has a plurality of nozzles having different print characteristics so that ink dots with at least two different diameters can be printed. In the present embodiment, a plurality of nozzles forms each of four nozzle arrays A71*a* to A71*d*. In the present embodiment, a volume of ink ejected from each nozzle is used as a value representing a print characteristic. In the present specification, a volume of ink ejected from each nozzle is hereinafter also referred to simply as "an ejection volume." In the present embodiment, two types of ejection volumes, large and small volumes, are set for the nozzles in one print chip, and one nozzle array consists of nozzles with a relatively large ejection volume and another nozzle array consists of nozzles with a relatively small ejection volume. In the present specification, a nozzle array consisting of nozzles with a relatively large ejection volume is hereinafter also referred to as "a large nozzle array." In the present specification, a nozzle array consisting of nozzles with a relatively small ejection volume is hereinafter also referred to as "a small nozzle array." Hereinafter, in the present specification, a large nozzle array and a small nozzle array are also referred to as "large and small nozzle arrays" collectively. The nozzle arrays A71*a* and A71*c* correspond to large nozzle arrays, and the nozzle arrays A71*b* and A71*d* correspond to small nozzle arrays. Here, the nozzle arrays A71*a* and A71*c* and the nozzle arrays A71*b* and A71*d* have different diameters to eject different volumes of ink. This allows the print chip A71 to print dots of a relatively large diameter (large dots) using the nozzle arrays A71*a* and A71*c* and to print dots of a relatively small diameter (small dots) using the nozzle arrays A71*b* and A71*d*. The print chips A72 to A74 have the same structure as the print chip A71.

Incidentally, the print chip of the present embodiment is configured to have a total of four nozzle arrays, including two types of nozzle arrays differing in print characteristics arranged one after the other. However, a print chip applicable to the present invention is not limited to this. In addition to the above structure, a print chip may be configured to have a total of four nozzle arrays, including a pair of nozzle arrays arranged alternately with another pair of nozzle arrays differing in print characteristics, or to have a total of two nozzle arrays having different print characteristics arranged, or to have three or more types of nozzle arrays differing in print characteristics arranged. Alternatively, a print chip may be configured to have nozzle groups having different print characteristics arranged in a two-dimensional zigzag pattern. Although the print head installed on the printing apparatus A1 of the present embodiment is a thermal print head, a print head applicable to the present invention is not limited to this. A print head may be any line head which has a plurality of print chips arranged in a direction perpendicular to the conveying direction of the print medium and is capable of forming dots having a plurality of print characteristics in a print medium on the same raster extending in a direction perpendicular to the conveying direction of the print medium to print image data. Another ink-ejection type ink jet print head using a piezoelectric technology may be employed. In addition, a print head capable of printing print dots having a plurality of different print characteristics using one nozzle may be employed. Furthermore, a print head may be configured to print dots of multiple sizes by using, for example, one nozzle in which a volume of ejected ink may be controllable. Further, inks of any colors other than the aforementioned C, M, Y and K colors may be employed.

<Overview of Image Processing Unit>

Figures 1, 1A:
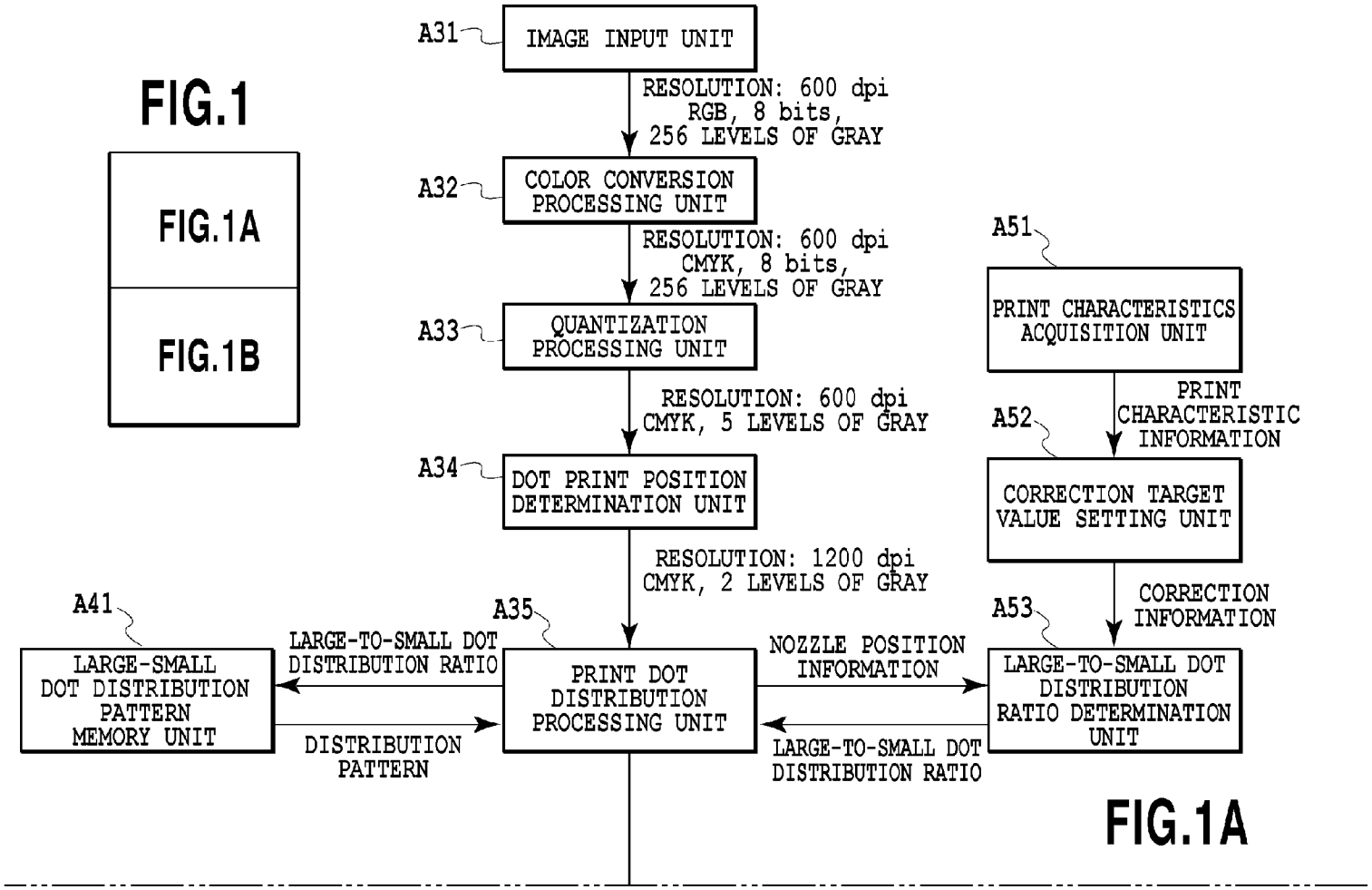
FIG. 1 is a diagram showing the relationship between FIGS. 1A and 1B.
FIGS. 1A and 1B are schematic diagrams of image processing in accordance with a first embodiment of the present invention.
Figure 1B:
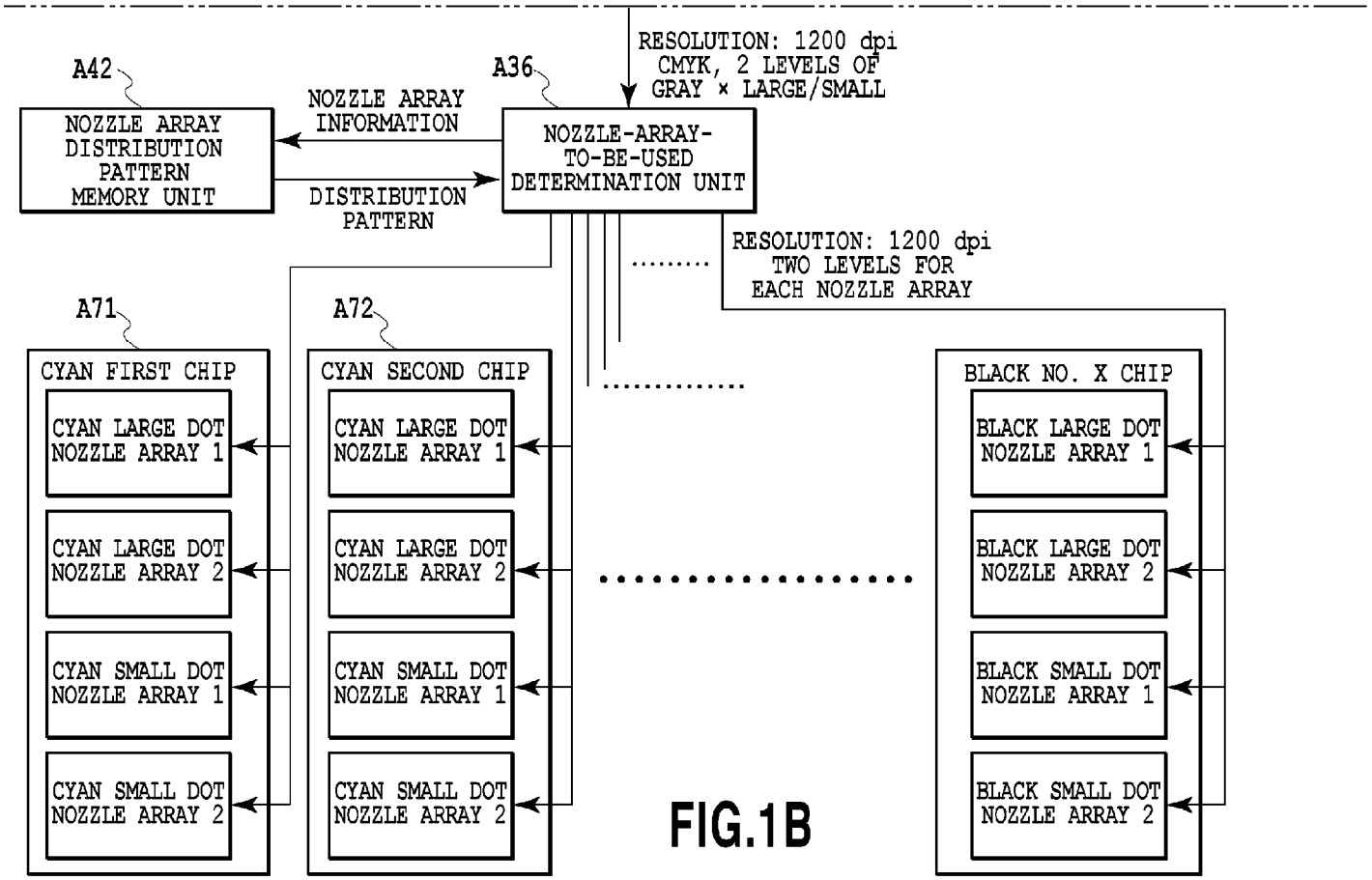
Figure 4A:
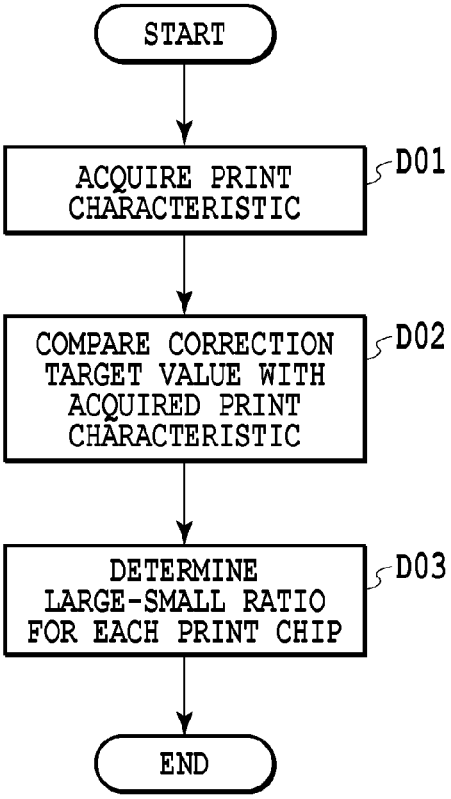
FIGS. 4A and 4B are flow charts of the first embodiment of the present invention.
Figure 4B:
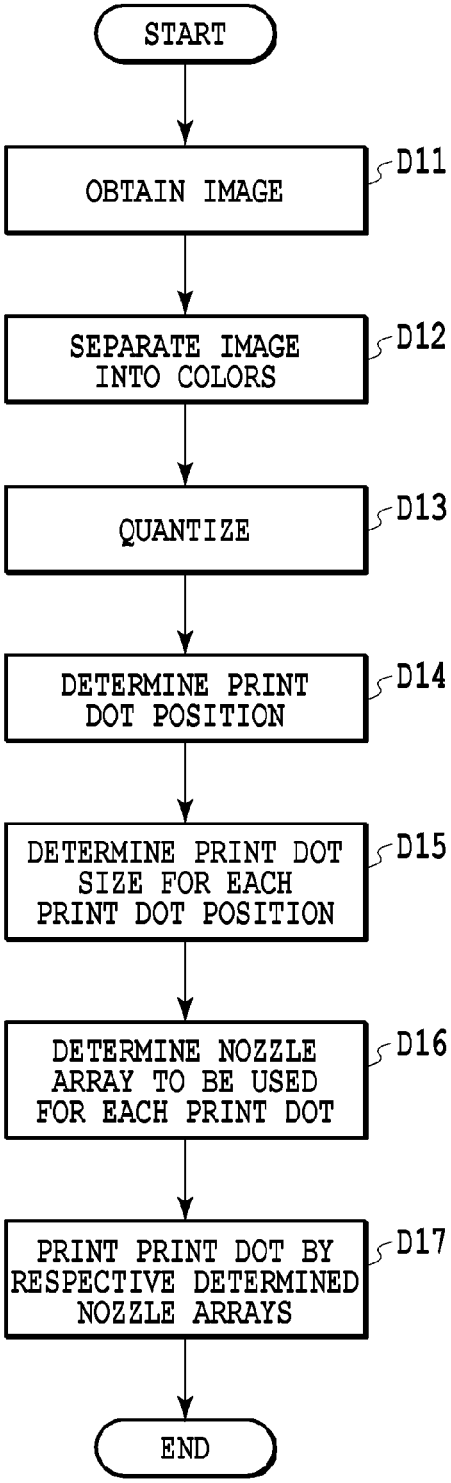

FIGS. 1A and 1B are schematic diagrams of image processing in accordance with the first embodiment of the present invention. FIGS. 4A and 4B are flow charts illustrating the processing flows of the first embodiment of the present invention. The operation flow of the present invention will be described with reference to FIGS. 1A, 1B, 4A, and 4B.

First, a description will be given based on the flow of FIG. 4A. In step D01, the printing apparatus A1 uses a print characteristics acquisition unit A51 as shown in FIG. 1A to acquire information about the print characteristics of the respective print chips A71 to A74. In the present embodiment, the printing apparatus A1 acquires information about an average value of an ejection volume per nozzle for each nozzle array as a print characteristic of a print chip. In the present specification, an average value of an ejection volume per nozzle is hereinafter also referred to as "a nozzle average ejection volume." Then in step D02, the printing apparatus A1 uses a correction target value setting unit A52 as shown in FIG. 1A to set a desirable ejection volume to be applied for the printing by each of the print chips A71 to A74 as a target ejection volume per nozzle. In the present specification, a target ejection volume per nozzle is hereinafter also referred to as "a correction target ejection volume." Then in step D03, the printing apparatus A1 uses a large-to-small dot distribution ratio determination unit A53 to determine a distribution ratio for printing large dots and small dots based on a nozzle average ejection volume for each nozzle array as read for each print chip in step D01 and a correction target ejection volume as set in step D02.

In the present specification, the term "large dot" means a dot of a relatively large diameter formed on a print medium, whereas the term "small dot" means a dot of a relatively small diameter formed on a print medium. The "large dot" can be formed by ink ejected from a large nozzle with a relatively large ejection volume and the "small dot" can be formed by ink ejected from a small nozzle with a relatively small ejection volume. The large dot and the small dot are also collectively referred to as "large and small dots."

Incidentally, the term "large-to-small dot distribution ratio" as used in the present specification indicates in what ratio large dots and small dots should be printed of all the dots to be printed.

In the present example, in acquiring information about a nozzle average ejection volume for each nozzle array in step D01, it is assumed that a nozzle average ejection volume for each of large nozzle arrays A71*a* and A71*c* is 3 ng, and a nozzle average ejection volume for both of the large nozzle arrays is also 3 ng. It is also assumed that a nozzle average ejection volume for each of small nozzle arrays A71*b* and A71*d* is 2 ng, and a nozzle average ejection volume for both of the small nozzle arrays is also 2 ng. Next in step D02, a correction target ejection volume is set to 2.5 ng. Then, in step D03, to achieve a correction target ejection volume of 2.5 ng, a large-to-small dot distribution ratio in the print chip A71 is determined as large dot (3 ng):small dot (2 ng)=1:1.

Next, a description will be given based on the flow of FIG. 4B. FIG. 4B is a flow chart showing the steps in the printing apparatus A1 performing predetermined image processing on image data stored in a memory card A91 (shown in FIG. 2) to convert the image data into dot data indicating the presence or absence of dots for printing. Once image printing processing of FIG. 4B starts, in step D11, the control unit A2 (shown in FIG. 2) controls an image input unit A31 of FIG. 1A to load image data to be printed from the memory card A91. The description is given on the assumption that the image data is a color image of R, G, and B, each color having 8 bits and 256 levels of gray at a resolution of 600 dpi. However, the present invention is applicable equally not only to a color image but also to a monochrome image.

Next in step D12, a color conversion processing unit A32 of FIG. 1A performs color conversion processing to convert the image data of R, G, and B, each color having 8 bits and 256 levels of gray at a resolution of 600 dpi into output multi-level image data of C, M, Y, and K, each color having 8 bits and 256 levels of gray at a resolution of 600 dpi.

The term "color conversion processing" as used in the present specification refers to various kinds of processing performed on image data under a multi-level state and includes, for example, color correction, gradation correction, and color separation. The term "color correction" as used in the present specification refers to making a change in a color space of an input image such that the input image can be outputted by an output device. The term "gradation correction" as used in the present specification refers to correction of a difference between gradation based on increase and decrease in image data signal values and gradation based on increase and decrease in the number of print dots by using gradation correction tables. Switching between gradation correction tables to be applied according to the print chip in the print head allows correction of print density variations resulting from variations in print characteristics of the print chips in the print head. In addition, switching between gradation correction tables to be applied according to the nozzle position in the print chip allows correction of minor print density variations resulting from variations in print characteristics of nozzles in the print chip. The term "color conversion processing" as used in the present specification refers to conversion of an RGB color image represented by combinations of gray scale values of R (red), G (green), and B (blue) into data represented by gray scale values of colors used for printing.

As described above, the printing apparatus A1 prints an image by using inks of four colors: cyan (C), magenta (M), yellow (Y), and black (K). The color conversion processing unit A32 of the present embodiment performs processing to convert RGB image data into data represented by gray scale values of CMYK colors.

After the image data (input image data) loaded in step D11 is color converted into output multi-level image data of CMYK colors in step D12 as described above, next in step D13, quantization processing is performed by using a quantization processing unit A33 of FIG. 1A.

The term "quantization processing" as used in the present specification refers to the processing in which the output multi-level image data having the large number of gray levels is processed to have the smaller number of gray levels appropriate to the printing capability of the printing apparatus, that is, the processing of appropriately reducing gray scale values. In this example, a description will be given based on the example that the data with 8 bits, 256 levels of gray is quantized to five levels. Generally, error diffusion or dithering is often used for the quantization processing.

Figures 5A, 5B:
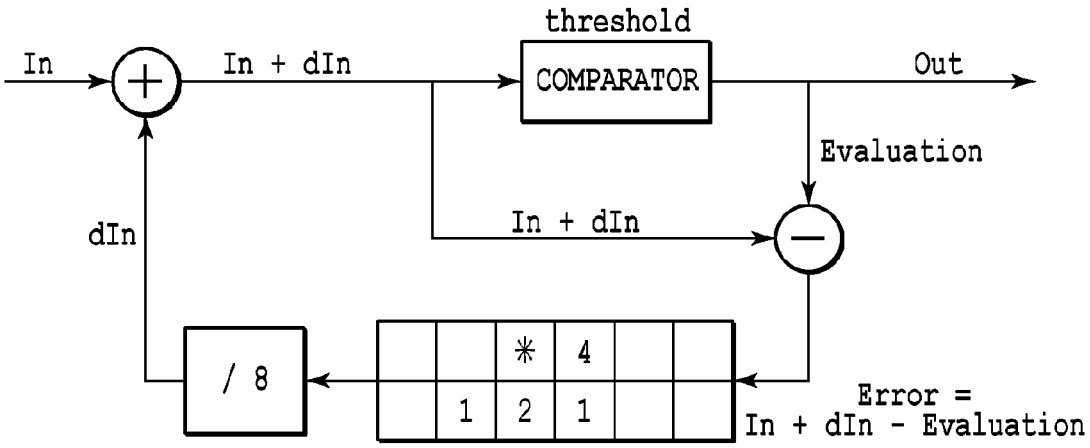
FIGS. 5A and 5B illustrate conventional error diffusion processing.

FIG. 5A shows the flow of general error diffusion processing. FIG. 5B illustrates the relationship among a threshold (threshold), an output level (Out), and an evaluation value (Evaluation). Multi-level error diffusion processing for five levels will be described using FIGS. 5A and 5B.

First, with reference to FIG. 5A, an image density value (In) and a diffusion error value (dIn) from neighboring pixels are added to obtain a corrected density value (In+dIn). Then, a comparator compares the obtained corrected density value (In+dIn) with a threshold (threshold) to output an output level (Out) which is determined from the threshold according to the corrected density value.

A more specific description will be given with reference to FIG. 5B. In a case where the obtained corrected density value (In+dIn) is "equal to or smaller than 32," an output level (Out) determined according to the corrected density value is "Level 0," and accordingly "Level 0" is outputted. In the same manner, in a case where the corrected density value (In+dIn) is "larger than 32 and equal to or smaller than 96," for example, "Level 1" is outputted as an output level (Out).

Next, referring back to FIG. 5A, a multi-level error (Error=In+dIn−Evaluation) is calculated by subtracting an evaluation value (Evaluation) from a corrected density value (In+dIn). To diffuse the calculated multi-level error (Error=In+dIn−Evaluation) into neighboring pixels, a weighting operation is performed to add the multi-level error to an error buffer.

Here, with reference to FIG. 5B, the relationship between an output level (Out) and an evaluation value (Evaluation) will be described. At an output level (Out) of "Level 4," an evaluation value (Evaluation) is "255." In the same manner, at an output level (Out) of "Level 3," an evaluation value (Evaluation) is "192." At an output level (Out) of "Level 2," an evaluation value (Evaluation) is "128." At an output level (Out) of "Level 1," an evaluation value (Evaluation) is "64." At an output level (Out) of "Level 0," an evaluation value (Evaluation) is "0."

Referring back to FIG. 5A, an error value diffused into a focused pixel position is extracted from the error buffer and normalized by the sum of weighting factors to obtain a diffusion error (dIn) of the next pixel. This process is repeated to all the pixels. In this manner, the data with 8 bits, 256 levels of gray is quantized to have five levels of gray appropriate to the printing capability of the printing apparatus A1.

Referring back to FIG. 4B, the rest of the flow will be described. In step D13, image data is quantized for each print pixel to have the smaller number of gray levels. In step D14, based on the quantized image data, arrangements of print dots in the print pixels are determined by using a dot print position determination unit A34 of FIG. 1A.

Figure 6:
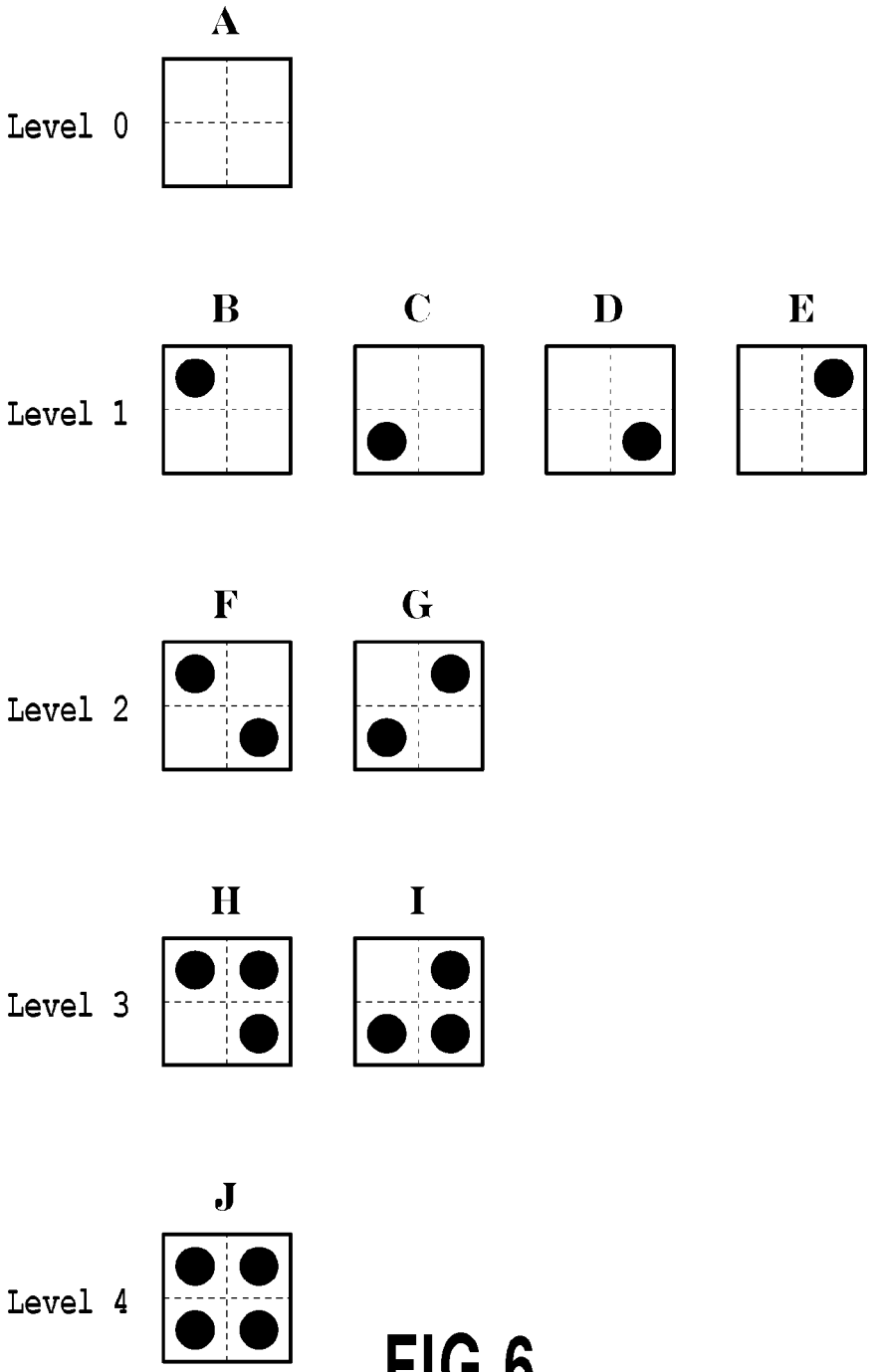
FIG. 6 shows exemplary arrangements of print dots in print pixels according to quantization results.

Here, FIG. 6 shows dot print positions to represent the quantized image data including a print pixel with a resolution of 600 dpi, five levels of gray from Level 0 to Level 4, by using dot patterns of print dots at a resolution of 1200 dpi. For example, in a case where gradation after the quantization in step D13 is Level 1, only one dot is printed in a print pixel with a resolution of 600 dpi. In this case, the print position of the one dot is determined to be any one of four areas with a resolution of 1200 dpi obtained by dividing one print pixel with a resolution of 600 dpi (in FIG. 6, an upper left area as shown in B, a lower left area as shown in C, a lower right area as shown in D, or an upper right area as shown in E).

Next, in step D15 of FIG. 4B, a print dot distribution processing unit A35 of FIG. 1A determines the size of a print dot for each position of a print dot in the following manner. More specifically, first, the print dot distribution processing unit A35 transmits information about positions of nozzles used for printing dots in a print head to the large-to-small dot distribution ratio determination unit A53 of FIG. 1A. In this example, the information indicates which print chip prints the dots. The print dot distribution processing unit A35 receives information about a print dot distribution ratio as determined based on the information about the print characteristics of the print chips as previously described, from the large-to-small dot distribution ratio determination unit A53. In the present specification, the information about a print dot distribution ratio is hereinafter also referred to as "distribution ratio information." The print dot distribution processing unit A35 transmits the received distribution ratio information to a large-small dot distribution pattern memory unit A41 of FIG. 1A, thereby obtaining a distribution pattern of large and small dots from the large-small dot distribution pattern memory unit A41. The print dot distribution processing unit A35 uses the obtained large-small dot distribution pattern to allocate the print dot arrangements as determined in step D14 to nozzles having different print characteristics to generate print data for each nozzle. In this example, the different print characteristics indicate ejection volumes. In this example, large and small dots printed with two different ejection volumes, 3 ng and 2 ng respectively, are used to obtain binary print data with a resolution of 1200 dpi including large and small dots distributed to achieve a 1:1 ratio. Hereinafter, the print data obtained based on the ratio between the number of large dots and the number of small dots is also referred to as "large-small distribution print data."

Next, in step D16, a nozzle-array-to-be-used determination unit A36 of FIG. 1B transmits information about which nozzle array is used to print large-small distribution print data to a nozzle array distribution pattern memory unit A42 of FIG. 1B. After receiving the information about which nozzle array is used to print large-small distribution print data, the nozzle array distribution pattern memory unit A42 transmits the distribution pattern of the pertinent nozzle arrays to the nozzle-array-to-be-used determination unit A36. After obtaining the distribution pattern of the pertinent nozzle arrays, the nozzle-array-to-be-used determination unit A36 generates nozzle array-specific print data (binary at 1200 dpi) to be printed by each of the nozzle arrays (A71*a* to A71*d*) having different print characteristics based on the distribution pattern and large-small distribution print data.

Next, in step D17, the nozzle array-specific print data as generated for each nozzle array in step D16 is sent to each nozzle array in each print chip, and the nozzles having different print characteristics eject ink to form a plurality of dots on a print medium to print an image. In other words, the paper feed motor A81 of FIG. 2 is driven and according to its movement, the print head A7 ejects ink droplets on the print medium based on the nozzle array-specific print data. As a result, dots having different print characteristics (dot sizes) formed by ink ejected from the nozzles having different print characteristics (ejection volumes) are distributed in a desired ratio to print image data.

<Description of Processing Using Image Data>

Next, the processing using image data in accordance with the present embodiment will be described.

Figure 7:
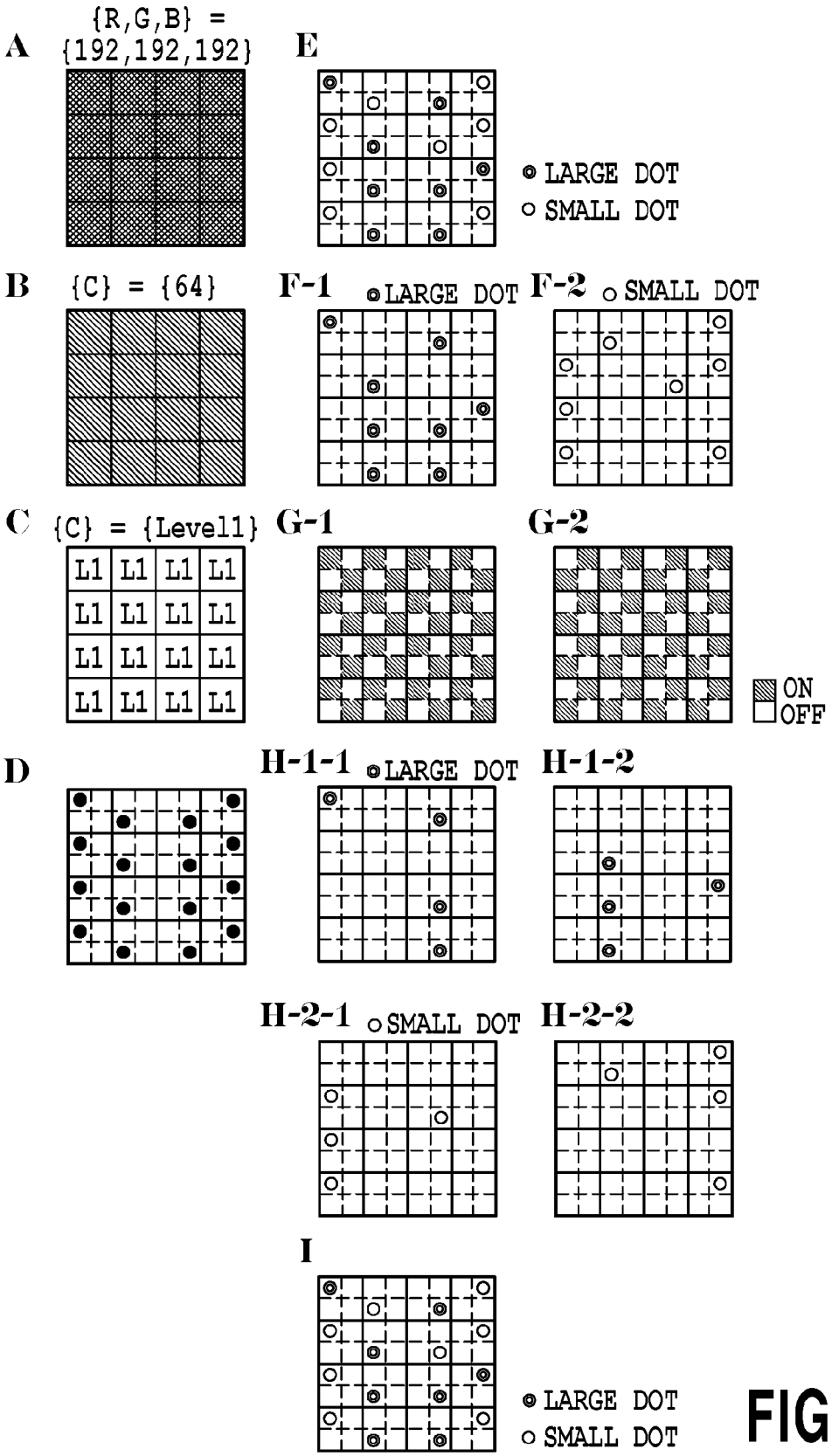
FIG. 7 shows exemplary image data processing in accordance with the first embodiment of the present invention.

FIG. 7 illustrates image data before and after the processing of each step in the flow of FIG. 4B, distribution results of different print characteristics (dot sizes), distribution results of nozzle arrays, and print results on the print medium.

In FIG. 7, A shows input image data loaded in step D11 of FIG. 4B. Herein, the input image data is RGB data, each color having a value of 192. This is represented as {R, G, B}={192, 192, 192} in A of FIG. 7.

Next, in FIG. 7, B shows output multi-level image data obtained based on the input image data of {R, G, B} as loaded in step D11 which is converted to have gray scale values of respective CMYK inks to be used in step D12 of FIG. 4B. For the sake of description, only ink C is specified herein based on the assumption that a signal value is converted into a value of 64. This is represented as {C}={64} in B of FIG. 7.

Next, in FIG. 7, C shows a result of converting the gray scale values of the output multi-level image data with 8 bits and 256 levels of gray into other gray scale values (five levels in this example) appropriate to the printing capability of the image printing apparatus A1. As previously described, a signal value of 64 ({C}={64}) is converted into Level 1 as a result of the error diffusion processing as described with reference to FIGS. 5A and 5B. This is represented as {C}={Level 1} in C of FIG. 7.

Next, in FIG. 7, D shows a result of step D14 in FIG. 4B. Using the print dot patterns of FIG. 6, from A to J, data with gray scale values of Level 1 is converted into data indicating the presence and absence of print dots for each position at 1200 dpi.

Next, in FIG. 7, E shows a result of step D15 in FIG. 4B. As previously described, in step D15, the size of a print dot is determined for each print dot position. In this example, the size of a print dot is determined according to the ejection volume, that is, 3 ng or 2 ng. In step D15, first, based on the information about the print chip for printing the image data as shown by D in FIG. 7, a large-to-small dot distribution ratio calculated in advance for each print chip is obtained. Then, a large-small dot distribution pattern is obtained based on the large-to-small dot distribution ratio, and it is determined which dot, large dot or small dot, is printed for each print dot as shown by D in FIG. 7.

Figure 8:
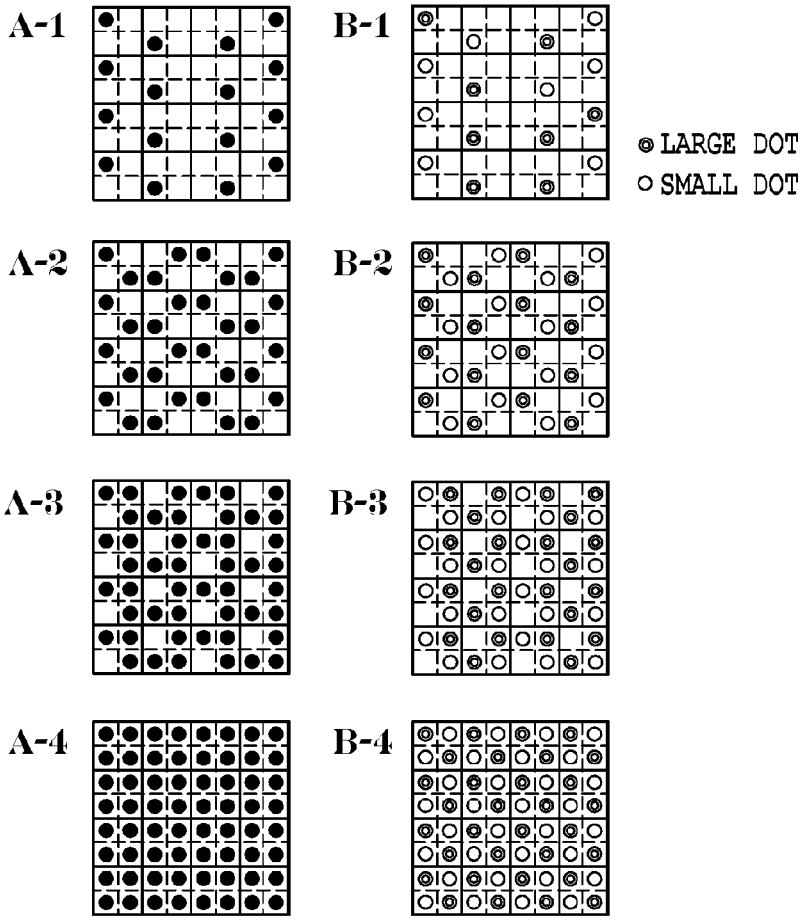
FIG. 8 illustrates large-small dot distribution patterns at each output level after quantization in accordance with the first embodiment of the present invention.
Figure 8:
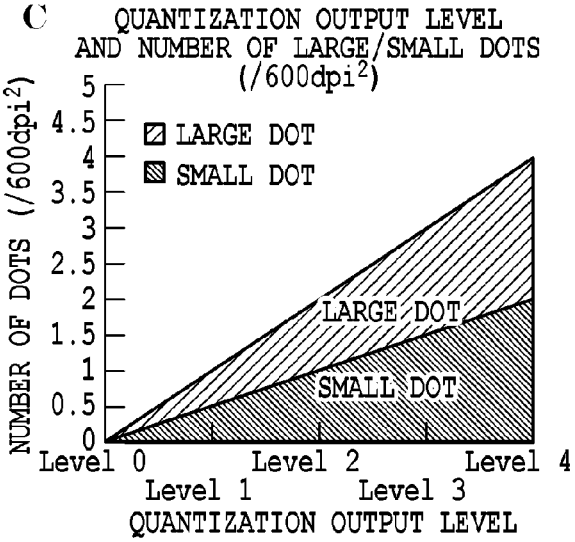

Here, FIG. 8 is used to describe exemplary large-small dot distribution patterns for determining which dot, large dot or small dot, is printed as well as exemplary allocations of large and small dots using the large-small dot distribution patterns. In the present specification, allocation of large and small dots is hereinafter also referred to simply as "large-small allocation."

In FIG. 8, A-1 to A-4 show exemplary print dot arrangements at the output levels corresponding to Level 1 to Level 4, respectively, after the output multi-level image data is quantized to five levels. In FIG. 8, B-1 to B-4 correspond with A-1 to A-4, respectively, and show exemplary large-small dot distribution patterns in a case where the large and small dots are distributed in a 1:1 ratio. More specifically, in FIG. 8, B-1, B-2, B-3, and B-4 show large-small dot distribution patterns at Level 1, Level 2, Level 3, and Level 4, respectively.

By using the example of Level 1 as shown by A-1 and B-1 in FIG. 8, a process of determining which dot, large dot or small dot, is printed for each print dot will be described. First, after the print dot arrangement as shown by A-1 in FIG. 8 is determined, a large-to-small dot distribution ratio is calculated based on the information about the print characteristics of the print chips. In this example, a distribution ratio of large dots to small dots is 1:1. Based on the data on the print dot arrangement and large-to-small dot distribution ratio, a large-small dot distribution pattern is prepared according to the arrangement and distribution ratio as shown by B-1 in FIG. 8. The process of generating (the process of switching) a large-small dot distribution pattern according to the large-to-small dot distribution ratio will be described later in detail.

Next, each print dot as shown by A-1 in FIG. 8 refers to a corresponding position in the large-small dot distribution pattern as shown by B-1 in FIG. 8 and is replaced by a dot having a print dot size as specified for the corresponding position. In this manner, the size of a print dot is determined for each print dot position.

In FIG. 7, E shows the print data obtained in this manner. This print data corresponds with the aforementioned large-small distribution print data.

In this manner, the large-small distribution print data as shown by E in FIG. 7 is generated based on the print dot arrangement data as shown by D in FIG. 7.

In a case where data having different output levels after quantization exist, allocation of large and small dots used for printing is performed in the same manner as in the case of Level 1. More specifically, large-small allocation is performed for Level 2 using A-2 and B-2 in FIG. 8, for Level 3 using A-3 and B-3 in FIG. 8, and for Level 4 using A-4 and B-4 in FIG. 8.

Here, in FIG. 8, C is a graph showing the relationship between output levels after quantization and the number of print dots in 600×600 dpi. In FIG. 8, D is a table showing ratios between the number of large dots and the number of small dots for respective output levels. As shown by B-1 to B-4 in FIG. 8, large-to-small dot distribution ratios (ratios between the number of large dots and the number of small dots) are constant irrespective of the output levels after quantization as shown by C and D in FIG. 8. Accordingly, the large-small distribution print data as shown by E in FIG. 7 includes large dots (3 ng) and small dots (2 ng) distributed in the calculated 1:1 ratio. Therefore, by using the nozzle groups (nozzle arrays) having average ejection volumes of 3 ng and 2 ng, it is possible to print an image with an average ink volume of 2.5 ng per 600 dpi square.

In FIG. 7, F-1 and F-2 show large-small distribution print data for each print dot size generated based on the large-small distribution print data as shown by E. In FIG. 7, F-1 shows the print data only about the large dots, whereas F-2 shows the print data only about the small dots. The number of printed dots is eight for both large and small dots, and they satisfy a large-to-small dot distribution ratio of 1:1.

Next, in FIG. 7, G-1 and G-2 and H-1-1 to H-2-2 illustrate step D16 of FIG. 4B. In step D16, it is determined which nozzle array is used to print the large-small distribution print data as shown by E in FIG. 7.

Here, the large-small distribution print data as shown by E in FIG. 7, as previously described, can be separated into the print data about large dots and the print data about small dots as shown by F-1 and F-2, respectively, in FIG. 7. In this example, large dots and small dots are respectively printed by two large nozzle arrays and two small nozzle arrays.

To distribute the print data about large dots as shown by F-1 in FIG. 7 to two large nozzle arrays, two nozzle array distribution patterns are prepared. In the present specification, the print data about large dots is hereinafter also referred to simply as "large dot print data." In FIG. 7, one example of the large dot print data is shown by G-1 and G-2. In this example, these patters constitute masks complementary to each other, each of the masks including 50% ON areas indicating that the areas can be printed. In the same manner, to distribute the print data about small dots as shown by F-2 in FIG. 7 to two small nozzle arrays, two nozzle array distribution patterns are prepared. In the present specification, the print data about small dots is hereinafter also referred to simply as "small dot print data." Also in this example, these patters constitute masks complementary to each other, each of the masks including 50% ON areas indicating that the areas can be printed. In this case, the nozzle array distribution patterns for small dots may be either the same as or different from those for large dots. In this example, a description will be given based on the assumption that the same nozzle array distribution pattern (see G-1 and G-2 in FIG. 7) is used for both large dots and small dots.

First, generation of nozzle array-specific print data associated with large dots will be described. Print data for the nozzle array A71*a* which prints large dots is generated by an AND operation (logical conjunction) on the large dot print data as shown by F-1 in FIG. 7 and the nozzle array distribution pattern as shown by G-1 in FIG. 7, that is, data is produced only for the portions indicating "large dot: exist" and "mask: ON". In FIG. 7, H-1-1 shows the large dot print data for the nozzle array A71*a* obtained in this manner. Similarly, the large dot print data for the nozzle array A71*c* as shown by H-1-2 in FIG. 7 is obtained by an AND operation on the large dot print data as shown by F-1 in FIG. 7 and the nozzle array distribution pattern as shown by G-2 in FIG. 7.

In the same manner as the large dot print data, nozzle array-specific print data associated with small dots are generated. More specifically, the small dot print data for the nozzle array A71*b* as shown by H-2-1 in FIG. 7 is obtained by an AND operation on the small dot print data as shown by F-2 in FIG. 7 and the nozzle array distribution pattern as shown by G-1 in FIG. 7. Further, the small dot print data for the nozzle array A71*d* as shown by H-2-2 in FIG. 7 is obtained by an AND operation on the small dot print data as shown by F-2 in FIG. 7 and the nozzle array distribution pattern as shown by G-2 in FIG. 7.

As described above, generation of nozzle array-specific print data associated with all the print dots, that is, both the large and small dots, is completed.

Next, in FIG. 7, I shows a result of step D17 in FIG. 4B. In step D17, the nozzle array-specific print data as shown in H-1-1 to H-2-2 are transmitted to the corresponding nozzle arrays A71*a* to A71*d*, and printing is performed on a print medium based on the data. In FIG. 7, I illustrates large and small print dots printed on the print medium. In FIG. 7, a large dot is marked with symbol ⊙ (a double circle) and a small dot is marked with symbol ○ (a white circle). As is apparent from FIG. 7, the distribution ratio of large dots (an ejection volume of 3 ng) to small dots (an ejection volume of 2 ng) satisfies 1:1. Therefore, by using the nozzle groups (nozzle arrays in this example) having average ejection volumes of 3 ng and 2 ng, it is possible to print an image with an average ink volume of 2.5 ng per 600 dpi square.

<Configuration of Switching Between Large-Small Dot Distribution Patterns According to Large-to-Small Dot Distribution Ratio>

Figure 9:
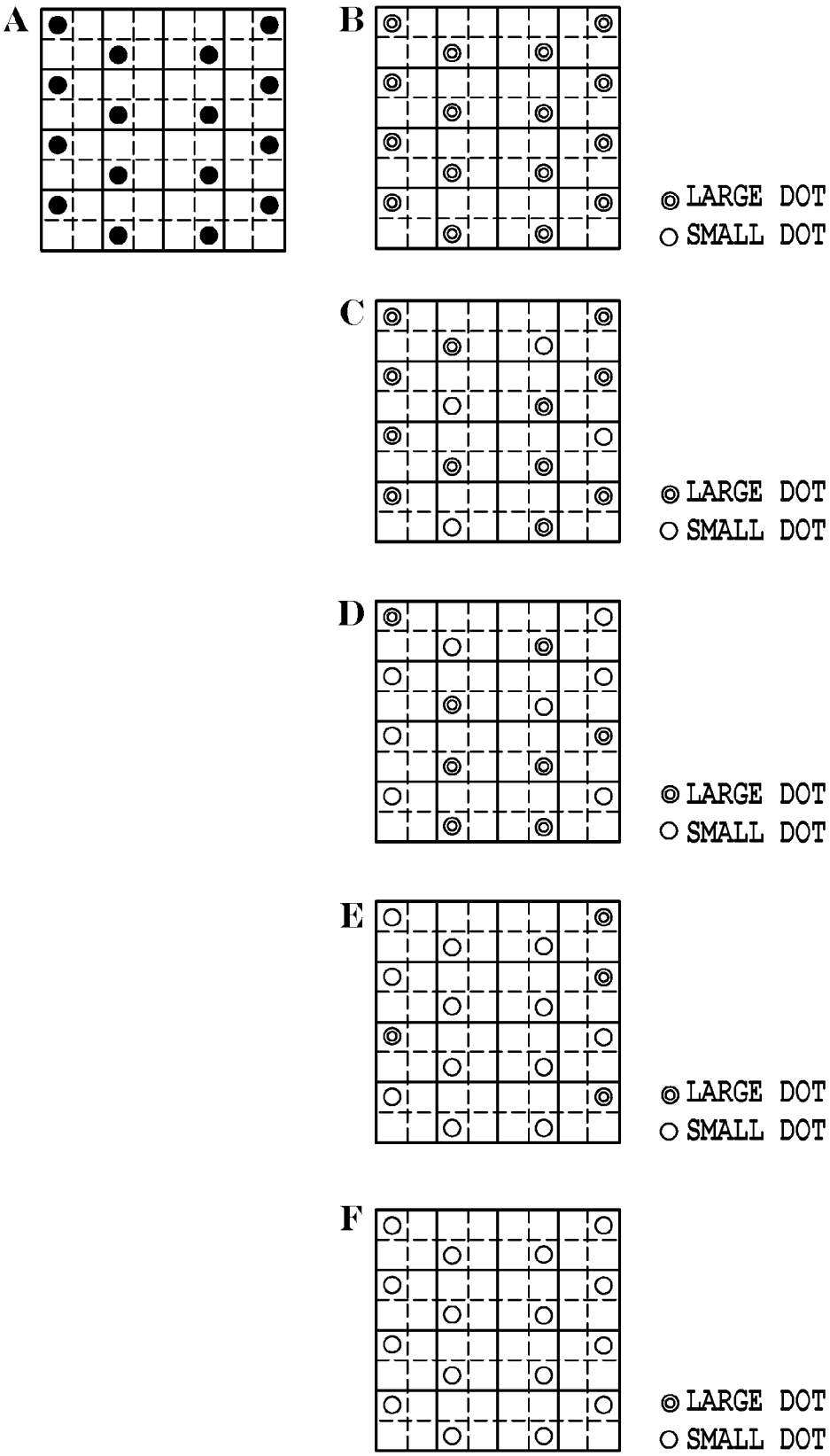
FIG. 9 illustrates data for allocating print dots based on distribution ratios in accordance with the first embodiment of the present invention.

Next, with reference to FIG. 9, a configuration of switching between distribution patterns will be described. In this configuration, in a case where print characteristics differ from print chip to print chip, according to the print characteristic of the print chip, a distribution pattern of print dots differing in print characteristics depending on the print chip is switched to another one.

For the respective print chips in the print head, print information is acquired as in the case of the print chip A71. Here, the print chip A72 is used as an example to describe the present configuration.

First, for the print chip A72, ejection volume information is acquired by using the print characteristics acquisition unit A51 of FIG. 1A in step D01 of FIG. 4B. In this example, a nozzle average ejection volume of large and small nozzle arrays in the print chip A72 is about 83.3% in terms of the print chip A71, that is, an ejection volume for the large dots is 2.5 ng and an ejection volume for the small dots is 1.67 ng.

Next, in step D02 of FIG. 4A, the correction target value setting unit A52 of FIG. 1A sets an ejection volume at 2.5 ng as a correction target value. Then, in step D03 of FIG. 4A, a distribution ratio of large dots to small dots in the print chip A72 is determined as 1:0. Hereinafter, descriptions of step D11 to step D14 of FIG. 4B will be omitted as they are the same as the case of the print chip A71.

Next, in step D15 of FIG. 4B, the print dot distribution processing unit A35 of FIG. 1A sends the distribution ratio information associated with the print chip A72 to the large-small dot distribution pattern memory unit A41 to obtain a large-small dot distribution pattern according to the distribution ratio. In this example, the distribution ratio information associated with the print chip A72 is 1:0.

Here, exemplary large-small dot distribution patterns according to large-to-small dot distribution ratios will be shown. In FIG. 9, A shows a print dot arrangement before distributing large and small dots. In FIG. 9, B to F show patterns of large and small dots according to distribution ratios. In FIG. 9, B to F show large-small dot distribution patterns in large-to-small dot distribution ratios of 1:0, 3:1, 1:1, 1:3, and 0:1, respectively. As is apparent from FIG. 9, the ratios between the number of positions allowing large dots to be printed and the number of positions allowing small dots to be printed in the respective large-small dot distribution patterns are identical with the respective large-to-small dot distribution ratios.

In this example, the large-to-small dot distribution ratio in the print chip A72 is 1:0. Accordingly, the print dot distribution processing unit A35 of FIG. 1A obtains the pattern shown by B in FIG. 9 as a large-small dot distribution pattern. Hereinafter, descriptions of the processing in step D16 and the following steps in FIG. 4B will be omitted as they are the same as the case of the print chip A71.

As described above, a large-small dot distribution pattern is selected according to a large-to-small dot distribution ratio in the present invention. This allows a print head having a plurality of print chips differing in print characteristics to correct the difference in print characteristics to print at a constant ejection volume.

In this example, a large-to-small dot distribution ratio is determined for each print chip, but the present invention is not limited to this. That is, a print chip may be divided into a plurality of sections to obtain a print characteristic for each section, and a large-to-small dot distribution ratio is determined to select an appropriate large-small dot distribution pattern.

Figure 10:
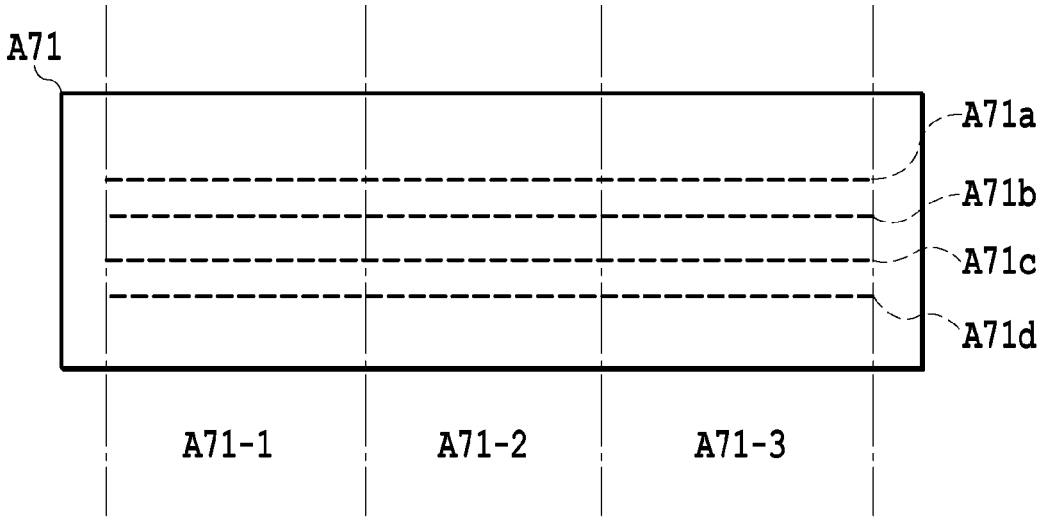
FIG. 10 is an illustrative diagram showing the case of acquiring print characteristics of a plurality of portions in a print chip in accordance with the first embodiment of the present invention.

FIG. 10 is a diagram illustrating a range of correction within a print chip in a case where the print chip is divided into three sections. Here, the nozzle arrays A71*a* to A71*d* in the print chip A71 are divided into three areas: A71-1, A71-2, and A71-3. A nozzle group in each of the areas obtained by dividing the nozzle arrays is considered as a unit having a different print characteristic in the present invention, and the present invention can be applied to each of the divided nozzle groups. In the present specification, a nozzle group in each of the divided areas is hereinafter also referred to as "a divided nozzle group." This embodiment is effective in a case where there is a wide range of variation in print characteristics within a print chip.

<Process of Generating Large-Small Dot Distribution Pattern>

Figure 11A:
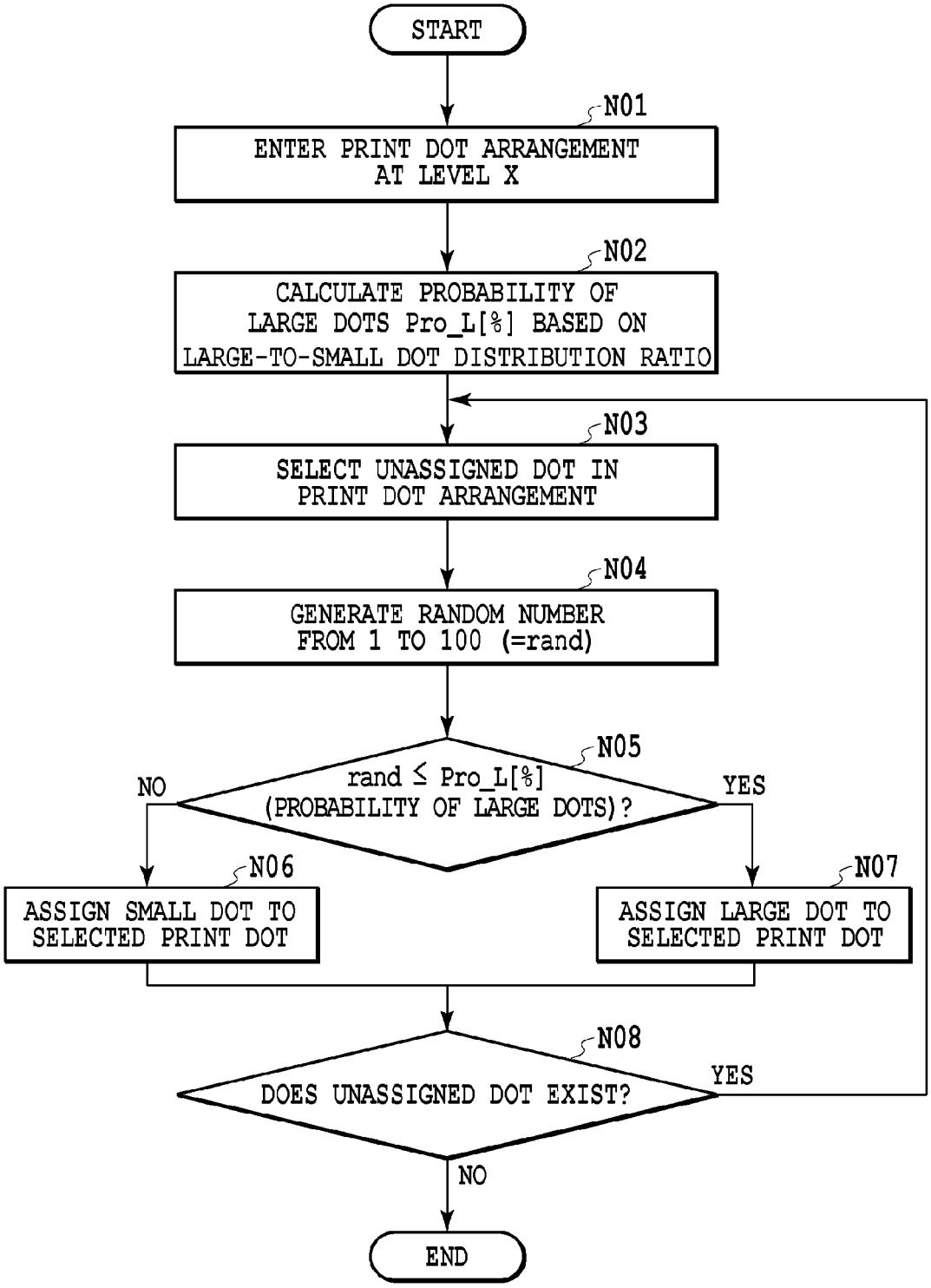
FIGS. 11A and 11B are flow charts illustrating exemplary methods for generating a large-small dot distribution pattern in accordance with the first embodiment of the present invention.
Figure 11B:
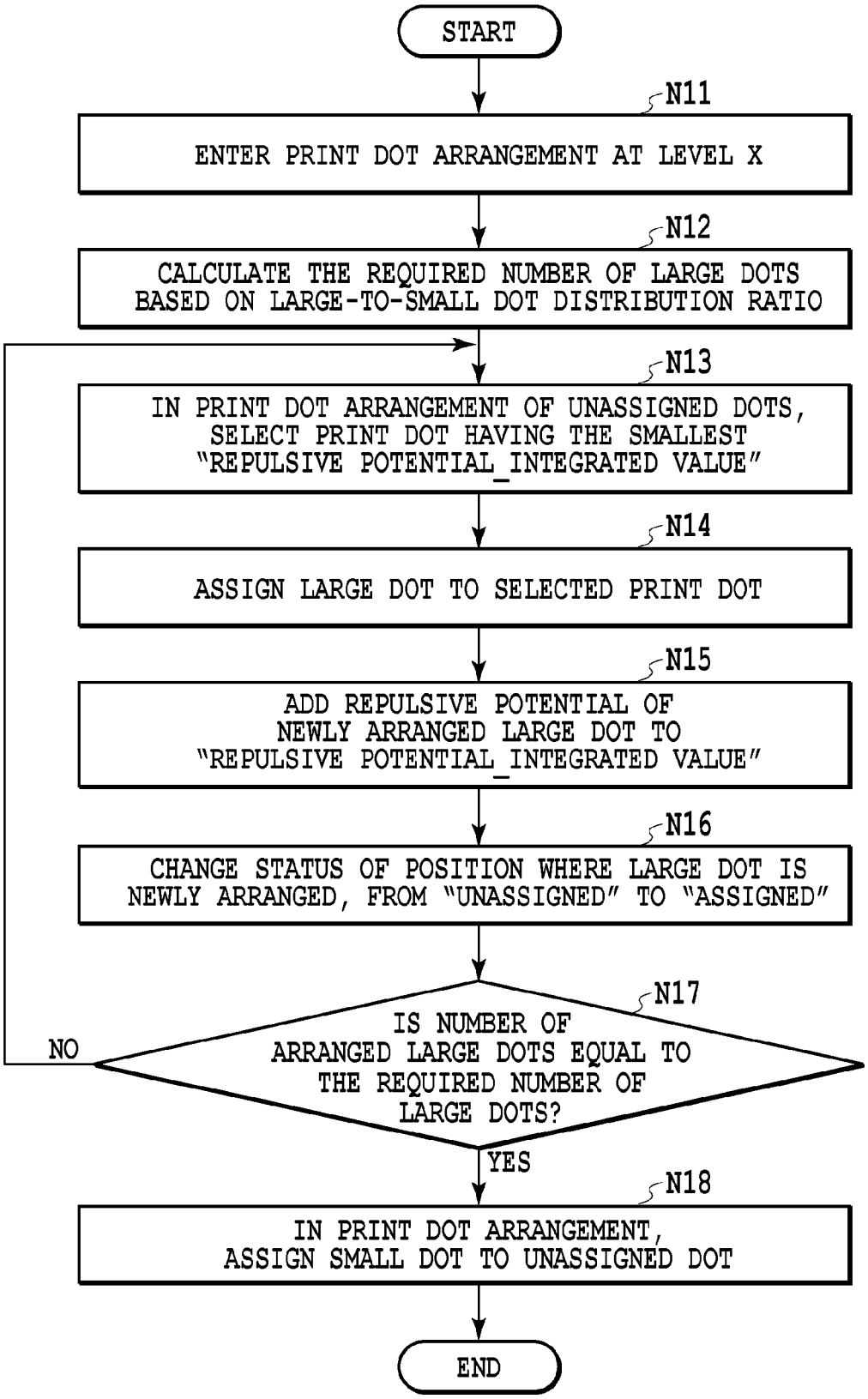

Next, a process of generating a large-small dot distribution pattern will be described. FIGS. 11A and 11B show flows of generating a large-small dot distribution pattern. FIG. 11A shows a simple process using random numbers. FIG. 11B shows a high resolution process using repulsive potential.

First, a simple process using random numbers as shown in FIG. 11A will be described. In step N01 of FIG. 11A, a print dot arrangement at a desirable output level after quantization to generate a large-small dot distribution pattern is entered. Then, in step N02, a generation probability of large dots Pro_L is calculated based on a large-to-small dot distribution ratio. In a case where a distribution ratio of large dots to small dots is 3:1, a generation probability of large dots Pro_L is 75%, which is represented by Pro_L=75(%). Then, in step N03, an unassigned dot, that is, a dot to which a large dot or a small dot is not assigned yet, is selected based on the print dot arrangement entered in step N01. Then, in step N04, a random number is generated from a numerical value between 1 and 100. In step N05, the random number is compared with the calculated generation probability of large dots Pro_L, and in a case where the random number is larger than the calculated generation probability of large dots Pro_L, the process proceeds to step N06, whereas in a case where the random number is equal to or smaller than the calculated generation probability of large dots Pro_L, the process proceeds to step N07. In step N06, a small dot is assigned to the unassigned dot selected in step N03, whereas in step N07, a large dot is assigned to the unassigned dot selected in step N03. After step N06 or step N07, the process proceeds to step N08. In step N08, it is checked whether there exists any unassigned dot to which a large dot or small dot is not assigned yet. If there exists an unassigned dot, the process returns to step N03 and the following steps will be repeated. If no unassigned dot exists, the process of generating a large-small dot distribution pattern at the pertinent output level is completed.

The processing according to the flow of FIG. 11A as described above is performed for each output level after quantization to obtain a large-small dot distribution pattern for each output level after quantization. In the processing of FIG. 11A, the size of a print dot to be distributed may be determined in turn for each selected unassigned dot. The advantage of this is a small amount of memory required for generating data.

Next, a process of generating a large-small dot distribution pattern using repulsive potential as shown in FIG. 11B will be described. First, in step N11 of FIG. 11B, a print dot arrangement at a desirable output level after quantization to generate a large-small dot distribution is entered. In this example, Level 1 is a desirable output level after quantization to generate a large-small dot distribution pattern, and the exemplary print dot arrangement as shown by A in FIG. 12 will be described.

Figure 12:
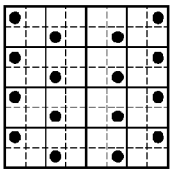
FIG. 12 illustrates a process for generating a distribution pattern using repulsive potential in accordance with the first embodiment of the present invention.
Figure 12:
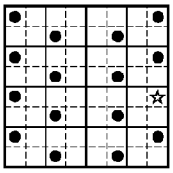
Figure 12:
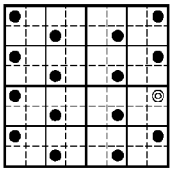
Figure 12:
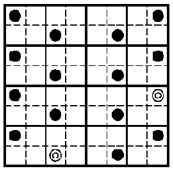
Figure 12:
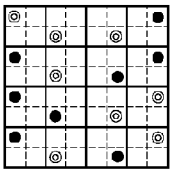
Figure 12:
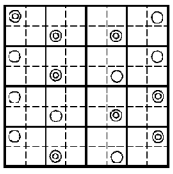
Figure 12:
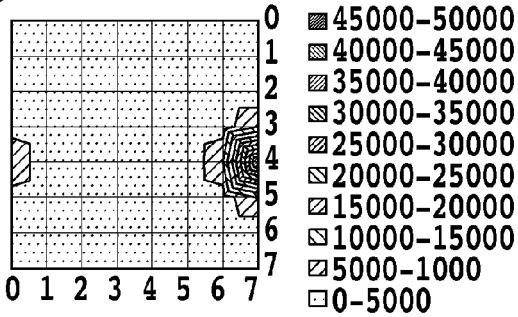
Figure 12:
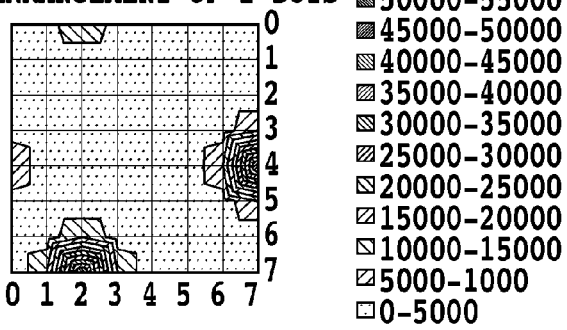

In step N12, the required number of large dots is calculated based on a large-to-small dot distribution ratio and the number of print dots at an entered output level after quantization. In this example, A of FIG. 12 shows that the number of print dots is 16, and based on a large-to-small dot distribution ratio of 1:1, the required number of large dots is determined to be eight dots by the following equation, 16×0.5=8.

Next, in step N13, in the print dot arrangement, a print dot at a position where a "repulsive potential_integrated value" is smallest is selected. Before a print dot selection is made, a "repulsive potential_integrated value" is 0 at any position. Accordingly, an arbitrary print dot is selected to be assigned as the first dot. In this example, a print dot at a position with coordinates (X, Y)=(7, 4) is selected. The selected print dot is marked with a white star-shaped symbol in B of FIG. 12. Next, in step N14, a large dot is assigned to the selected print dot. The print dot to which the large dot is assigned is marked with symbol ⊙ (a double circle) in C-1 of FIG. 12. Then, in step N15, the repulsive potential of the distributed large dot is added to the "repulsive potential_integrated value."

Figure 13:
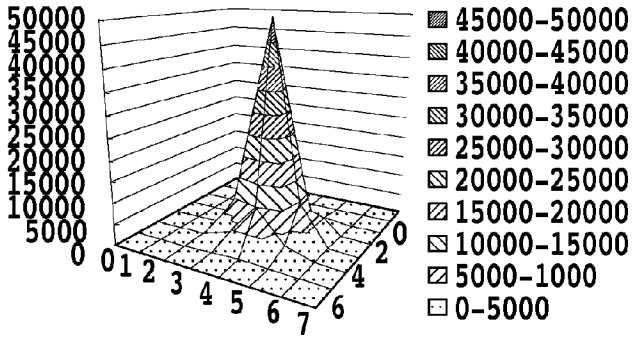
FIG. 13 illustrates repulsive potential for generating a large-small dot distribution pattern in accordance with the first embodiment of the present invention.
Figure 13:
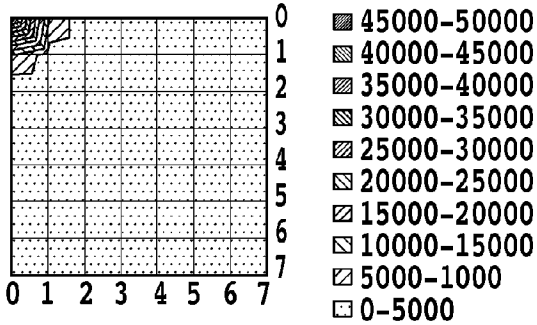
Figure 13:
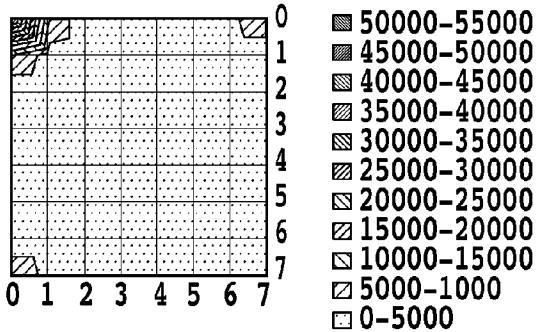

Here, the repulsive potential will be described with reference to FIG. 13. In this example, to obtain steeper repulsive potential around the arranged dot, the repulsive potential in the center of the arranged dot is set to 50000, and the repulsive potential in the other points is isotropical repulsive potential calculated by 10000÷(distance)$^4$. In FIG. 13, A-1 is a stereoscopic graph of the potential. In FIG. 13, A-2 is a table of the repulsive potential at respective points with X coordinates of 0 to 7 in the horizontal axis and Y coordinates of 0 to 7 in the vertical axis. As is apparent from A-1 and A-2 in FIG. 13, the steep potential occurs around the coordinates (4, 4).

In FIG. 13, B-1 and B-2 show the potential when the center of the potential as shown by A-1 and A-2 is moved to the coordinate position (0, 0). In a case where the repulsive potential of a single dot is represented by Pot_alone, the potential at a position (x, y) is represented by the following equation:

$$\text{Pot_alone}=50000\{x=0,y=0\},$$

$$10000\div(x^2+y^2)^2\{x\#0,y\#0\}. \qquad \text{[Equation 1]}$$

To satisfy the boundary conditions, it is assumed that the same pattern continues in the upward, downward, rightward and leftward directions including oblique directions. At the same time, the repulsive potential Pot_0(x, y) at the position (x, y) is represented by the following equation:

$$\begin{aligned}\text{Pot_0}(x, y) = {} & \text{Pot_alone}(x + \text{array_X}, y + \text{array_Y}) + \\ & \text{Pot_alone}(x, y + \text{array_Y}) + \\ & \text{Pot_alone}(x - \text{array_X}, y + \text{array_Y}) + \\ & \text{Pot_alone}(x + \text{array_X}, y) + \\ & \text{Pot_alone}(x, y) + \\ & \text{Pot_alone}(x - \text{array_X}, y) + \\ & \text{Pot_alone}(x + \text{array_X}, y - \text{array_Y}) + \\ & \text{Pot_alone}(x, y - \text{array_Y}) + \\ & \text{Pot_alone}(x - \text{array_X}, y - \text{array_Y})\end{aligned} \quad \text{[Equation 2]}$$

wherein array_X represents the size of a print dot pattern in the x-axis and array_Y represents the size of a print dot pattern in the y-axis.

In this example, both array_X and array_Y are 8.

In FIG. 13, C-1 and C-2 show the state of the repulsive potential in this case. The repulsive potential at the position (x, y) in a case where a large dot is arranged at an arbitrary position (a, b) may be yielded by substituting a relative position of the position (a, b) in the Pot_0(x, y). Accordingly, the repulsive potential is represented by the following equation:

$$\text{Pot_}ab(x,y)=\text{Pot_0}(\text{Pos_}x,\text{Pos_}y)$$

wherein Pos_x=x−a {in the case of x≥a}, a−x {in the case of x≤a}, and Pos_y=y−b {in the case of y≥b}, b−y {in the case of y≤b}.

In FIG. 12, C-2 shows a value of the "repulsive potential_integrated value" calculated by adding repulsive potential to the coordinate position (7, 4) in step N15 of FIG. 11B. In FIG. 12, C-3 is a contour graph of the "repulsive potential_integrated value." As shown in the graph, a numerical value of the repulsive potential is integrated around the position (X, Y)=(7, 4) where a large dot is arranged.

Then, in step N16 of FIG. 11B, a status of the print dot at a position where a large dot is arranged is changed from "unassigned" to "assigned." Then in step N17, the number of distributed large dots is compared with the required number of large dots previously calculated in step N12. In a case where the number of distributed large dots is smaller than the required number of large dots, the process returns to step N13 and the processing is repeated.

Continuously, arrangement of a second large dot will be described. In the table of C-2 in FIG. 12, shaded cell portions (hereinafter also referred to simply as shaded portions) indicate portions where print dots are arranged. In step N13, the shaded portions are searched for a cell having the smallest "repulsive potential_integrated value," and the print dot at a position corresponding to the cell is selected. In C-2 of FIG. 12, "repulsive potential_integrated values" in the cells at the positions (2, 1) and (2, 7) are both 169, and therefore random numbers are used to determine which cell is selected. In this example, the position (2, 7) is selected. After a print dot is selected, as in steps N14 and N15, in the same manner as the first dot, a large dot is assigned to the selected print dot, and further, repulsive potential of a new large dot is added to the "repulsive potential_integrated value." In FIG. 12, D-1 shows that a large dot is assigned to the position (2, 7). In FIG. 12, D-2 is a table showing the "repulsive potential_integrated value" to which repulsive potential of a large dot assigned to the position (2, 7) is added. In FIG. 12, D-3 is a contour graph of the "repulsive potential_integrated value."

As described above, the processing in step N13 to step N16 is repeated until it is determined that the number of distributed large dots reaches the required number of large dots in step N17.

In step N17, in a case where the number of distributed large dots reaches the required number of large dots, the process proceeds to the next step N18.

In FIG. 12, E shows a pattern in which eight large dots, which correspond to half the total number of dots, are arranged in a 1:1 large-to-small dot distribution ratio. Once the number of distributed large dots reaches the required number of large dots, small dots are assigned to remaining unassigned print dots in step N18 of FIG. 11B. Accordingly, it is possible to obtain the large-small dot distribution pattern in accordance with the print dot arrangement and large-to-small dot distribution ratio.

In FIG. 12, F shows an example that a large-small dot distribution pattern is generated by using the repulsive potential of the present example. Using repulsive potential to arrange large dots allows the large dots to be arranged in a more dispersing manner in the print dot arrangement. Arranging large dots in dispersed positions can reduce variations by position in density correction based on large-to-small dot distribution ratios while removing differences in roughness and fineness of large dots that are more visually recognizable, thereby producing favorable results of graininess and uniformity.

Advantageous Effects of Present Invention

Hereinafter, advantageous effects of the present invention will be described.

[First Advantageous Effect]

A first advantageous effect of the present invention is that an ink volume per print pixel can be kept constant.

Figure 14A:
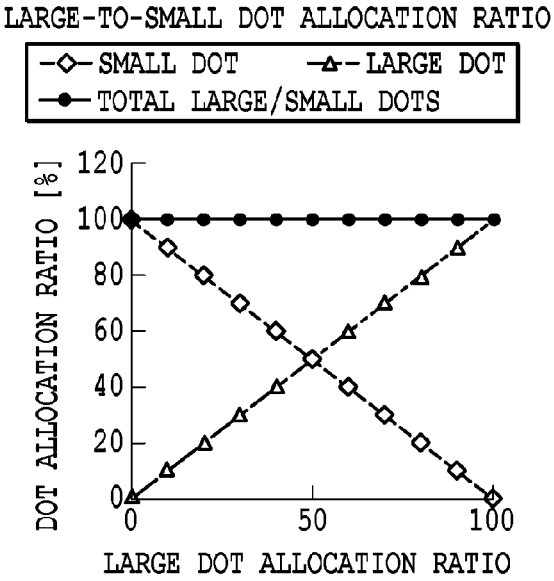
FIG. 14A shows exemplary dot usage ratios of the present invention.
Figure 14B:
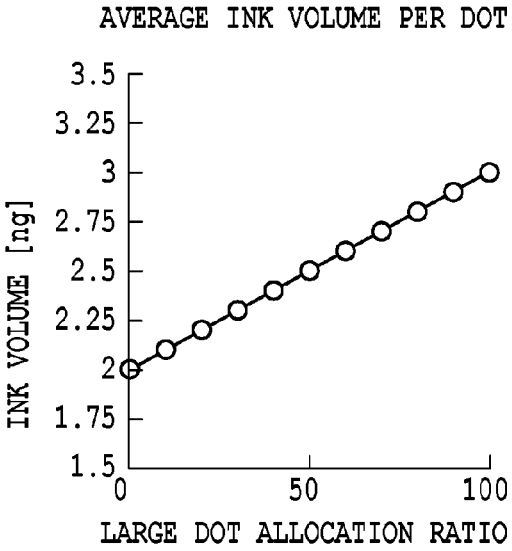
FIG. 14B shows exemplary ink volumes of the present invention.

FIG. 14A shows that an ink volume per print pixel can be adjusted by changing a ratio between the number of large dots and the number of small dots in the present embodiment. As described above, to a print dot for which a print position is determined, either a large dot or a small dot is assigned. Accordingly, as shown in FIG. 14A, the sum of the percentages of large dots and small dots of the total print dots always adds up to 100%. FIG. 14B shows an ink volume per print pixel in this case. By changing a large-to-small dot distribution ratio, it is possible to adjust an ink volume per print pixel in the range from 2 ng to 3 ng, which are the ink volumes applied for print dots including only small dots and for print dots including only large dots, respectively.

Next, with reference to FIGS. 15A, 15B, and 15C, a description will be given to show that the present invention can maintain a constant ink volume per print pixel even in a case where ink volumes (ejection volumes) as print characteristics vary among the print chips A71 to A74.

Figure 15A:
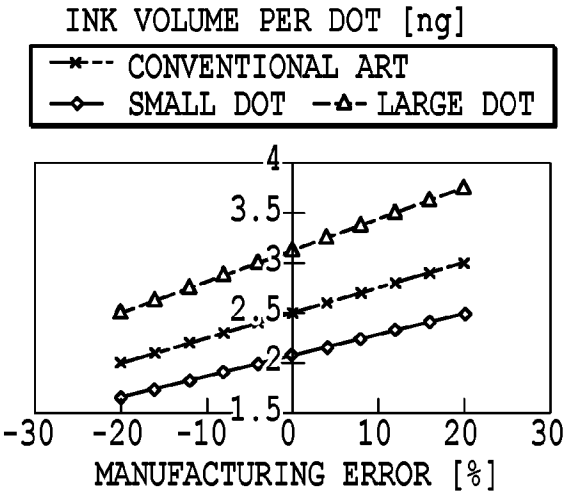
FIG. 15A includes a graph and a table illustrating exemplary ink volume errors in accordance with the first embodiment of the present invention.
Figure 15B:
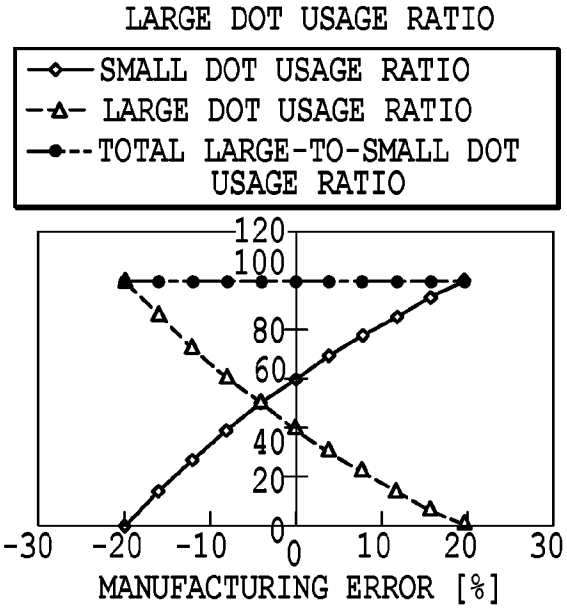
FIG. 15B includes a graph and a table illustrating exemplary dot distribution ratios in accordance with the first embodiment of the present invention.
Figure 15C:
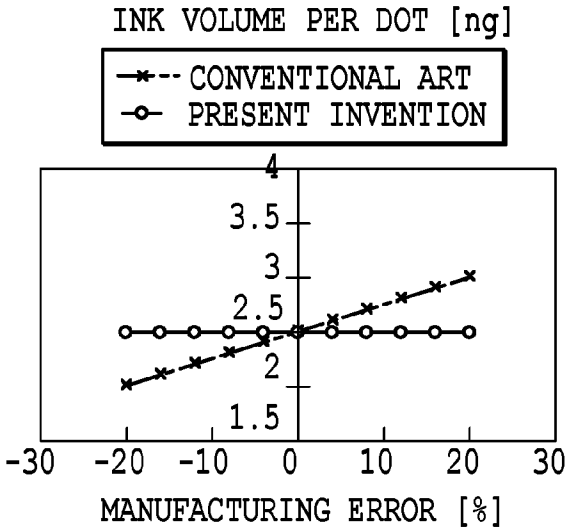
FIG. 15C includes a graph and a table illustrating exemplary ink volumes in accordance with the first embodiment of the present invention.

FIG. 15A includes a graph and a table illustrating variations in ink volumes (ejection volumes) among print chips used for the description of the present example. In a case where an intended value of an ejection volume (target ejection volume) for the conventional print chip is set to 2.5 ng, manufacturing errors fall within ±20% and the ejection volumes of the print chips vary from 2 to 3 ng. Such manufacturing errors can cause variations in ink volumes (ejection volumes) among print chips in a line head, resulting in the difference in print density to degrade image quality. In the present invention, "small dot nozzles" and "large dot nozzles" differing in print characteristics (ejection volumes) are prepared for each print chip. Assuming that both the small dot nozzles and the large dot nozzles have manufacturing errors within ±20% as the conventional print chip, FIG. 15A shows that the small dot nozzles and the large dot nozzles have variations in ink volumes (ejection volumes) which are 2.08 ng±20% (1.67-2.5 ng) and 3.13 ng±20% (2.5-3.75 ng), respectively. FIG. 15B shows a usage ratio between small dot nozzles and large dot nozzles when the present invention is applied. For the print chip with an ink volume error of −20%, usage of the large dot nozzles is set to 100%. For the print chip with an ink volume error of +20%, usage of the small dot nozzles is set to 100%. Furthermore, for the print chip with an ink volume error larger than −20% and smaller than +20%, a distribution ratio between large dots and small dots is adjusted in turn such that usage of small dot nozzles and large dot nozzles adds up to 100%, and an ink volume per print pixel is kept constant. FIG. 15C shows ink volumes per print pixel in this example. FIG. 15C shows that, in the conventional printing method, ink volumes per pixel vary from 2 to 3 ng due to the manufacturing errors of the print chips, but the present invention can achieve an ink volume of 2.5 ng per print pixel irrespective of the manufacturing errors.

As described above, the present invention makes it possible to maintain a constant ink volume per dot by adjusting the large-to-small dot distribution ratio even in a case where ejection volumes vary from print chip to print chip due to manufacturing errors. Incidentally, a distribution ratio is set in a range from 0 to 100% in this example to ensure a wide range of adjustment. However, the distribution ratio may be adjusted in a smaller range (for example, from 25 to 75%) to minimize a difference in usage frequencies among nozzle arrays.

[Second Advantageous Effect]

Figure 16:
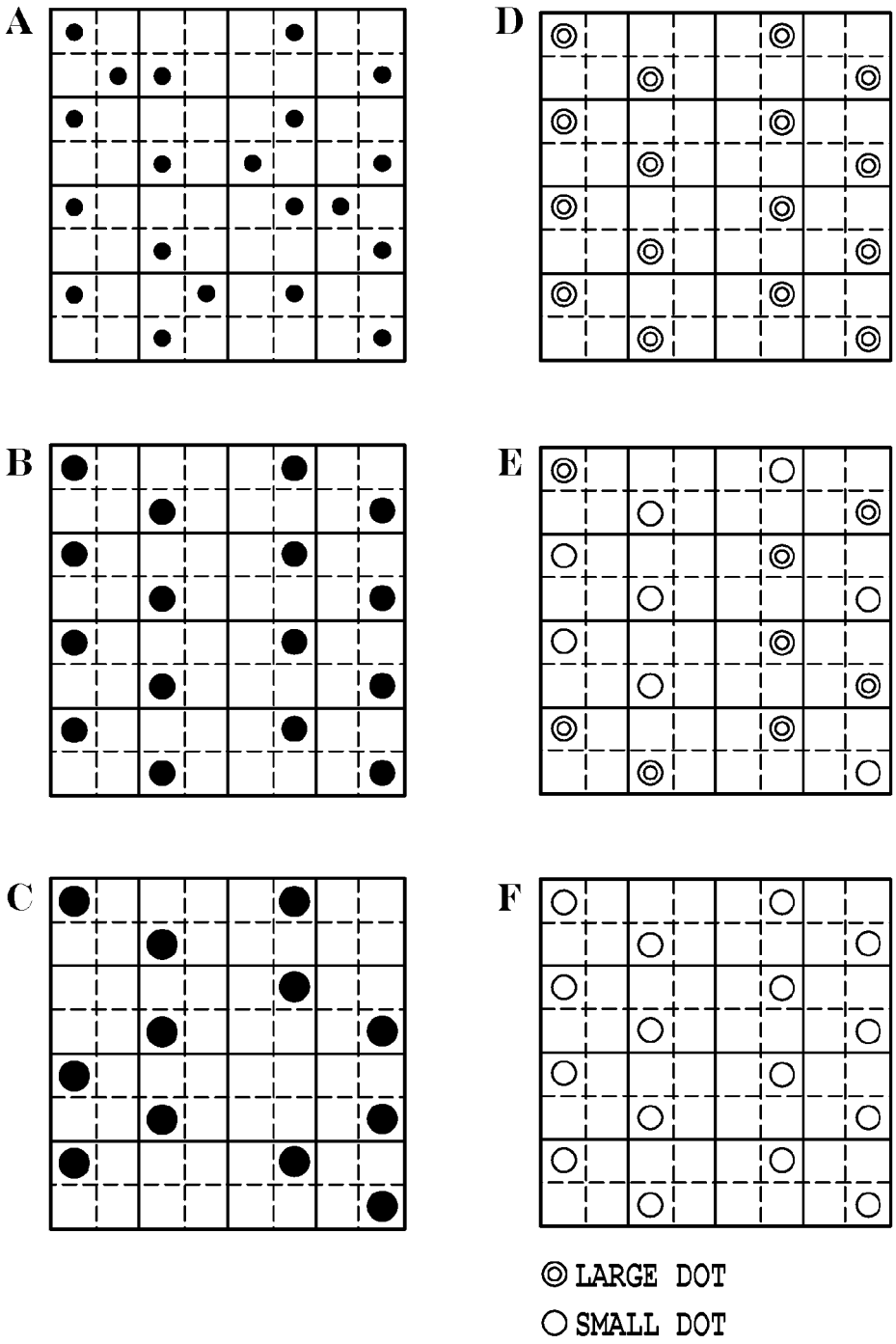
FIG. 16 illustrates print dot arrangements of the conventional and present inventions to describe advantageous results of the present invention.

With reference to FIG. 16, another advantageous effect of the present invention will be described. A second advantageous effect of the present invention is that the difference in print dot patterns resulting from print density correction is less likely to be visually detected.

In FIG. 16, A, B, and C schematically show print dot arrangements in the case of correcting ink volume errors by the number of print dots as disclosed by the conventional art. Meanwhile, in FIG. 16, D, E, and F schematically show print dot arrangements in the case of correcting ink volume errors by adjusting the large-to-small dot distribution ratio in accordance with the first embodiment of the present invention.

First, according to the correction method by the conventional art, correction is performed by increasing the number of dots printed by the print chip with a small ink volume and decreasing the number of dots printed by the print chip with a large ink volume. In FIG. 16, B shows a print dot pattern for printing 16 dots, in this case, with an ejection volume of 2.5 ng, which is an intended value of an ink volume (target ejection volume). In FIG. 16, A shows a print dot pattern corresponding to the print dot pattern of B in the case of printing with an ejection volume of 2 ng, which is an ink volume reduced by 20%, and 16×0.8≈13 dots are printed for density correction. Further, in FIG. 16, C shows a print dot pattern corresponding to the print dot pattern of B in the case of printing with an ejection volume of 3 ng, which is an ink volume increased by 20%, and 16×1.2≈19 dots are printed for density correction. As described above, in the conventional correction method, an ink volume per print pixel is kept constant by adjusting the number of dots to perform print density correction. According to this method, however, the print dot patterns vary among A, B, and C in FIG. 16. Accordingly, there is a problem that even in the same print density, the difference in print dot patterns among print chips is visually recognized, and as a result, the difference may be recognized as uneven images. Even if the method disclosed in U.S. Pat. No. 7,249,815 is applied, since the nozzle arrays having a plurality of ejection volumes are arranged in different positions, the difference in print dot patterns is produced due to the difference in dot positions even if an average volume of droplets can be kept constant without changing the number of dots.

On the other hand, in accordance with the first embodiment of the present invention, the print dot patterns as shown by D, E, and F in FIG. 16 are the same, which illustrate the cases where an ink volume is a target ejection volume, an ink volume is reduced by 20%, and an ink volume is increased by 20%, respectively. Therefore, according to the first embodiment of the present invention, it is possible to correct density with a constant ink volume per print pixel and the print dot pattern unchanged.

As described above, the present invention can correct print density and keep a print dot pattern unchanged at the same time, so that the degradation of image quality can be reduced.

In the first embodiment as described above, a series of processes from image data processing to print dot arrangement are performed in the printing apparatus A1, but the present invention is not limited to this. The processing in the flow of the present invention may be performed in a host, and the image data transmitted from the host may be directly printed in the printing apparatus A1. Alternatively, the processing may be shared between the printing apparatus A1 and the host.

In the example according to the present embodiment, the description has been given assuming that the ejection volume errors of large dots and the ejection volume errors of small dots have the same value. This is because the nozzle array A71*a* for printing large dots and the nozzle array A71*b* for printing small dots are located in the same print chip A71, and the diameter of small ejection nozzles and the diameter of large ejection nozzles have the same tendency to errors. However, it should be understood that the present invention is also applicable to the case where large dots and small dots have different tendencies to errors, e.g., large dots and small dots are printed by different print chips. In such a case, an appropriate distribution ratio may be set according to a combination of print characteristics of a plurality of print dots having different print characteristics.

Furthermore, in the present embodiment, the description has been given of an example that print dot positions are not changed within grids with a print dot resolution of 1200×1200 dpi. Here, since a gray level is represented in a unit of print pixel on which quantization processing is performed, it is required that the number of print dots and print density be kept constant for each unit of print pixel. Meanwhile, in visual observation, even smaller changes of print dot positions within a unit of print pixel on which quantization processing is performed are less likely to be recognized. Accordingly, in step D13 of FIG. 4B, the print dot positions may be changed within a unit of print pixel (600×600 dpi in this example) on which quantization processing is performed by using the quantization processing unit A33.

Second Embodiment

In the first embodiment, a large-to-small dot distribution ratio is calculated by using ejection volumes as print characteristics and correction target values. In addition, dot print positions are determined based on the quantized image data, and large dots and small dots having different print characteristics are assigned to the print dots at the dot print positions according to the distribution ratio, and further to respective nozzle arrays for printing.

In a second embodiment, in contrast to the first embodiment, an example of using lightness as a print characteristic, and further, directly distributing quantized image data to data for each nozzle array will be described.

Figure 17:
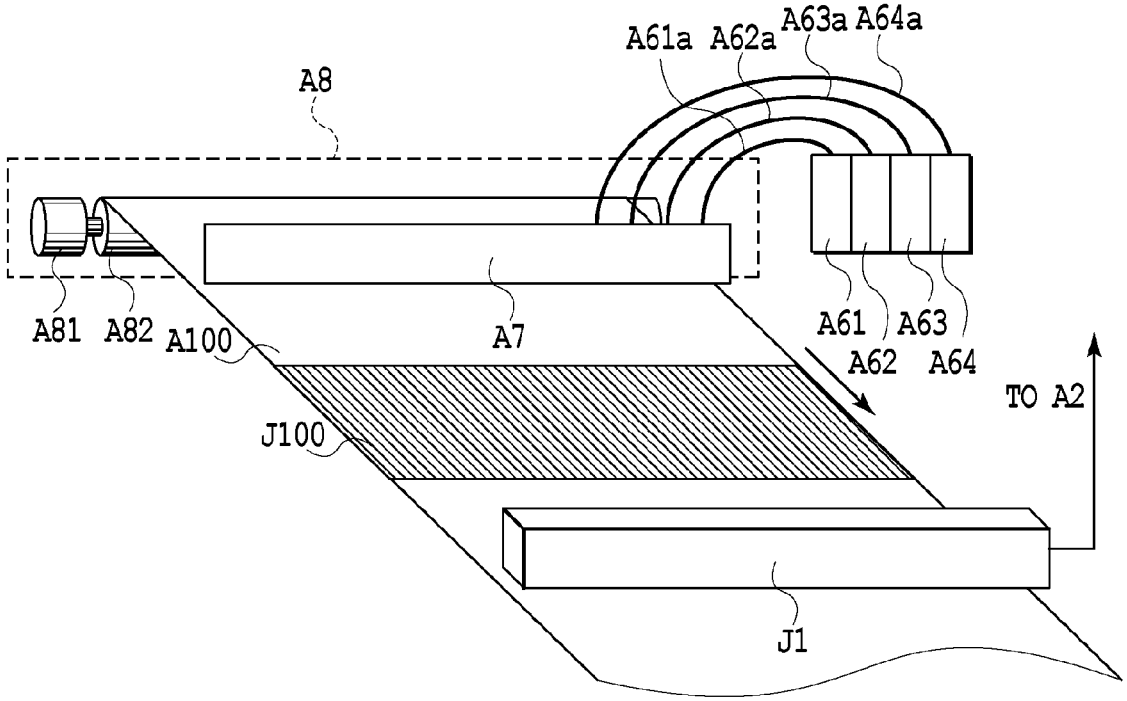
FIG. 17 is a diagram illustrating a portion of the printing apparatus and a reading unit of a second embodiment of the present invention.

FIG. 17 is a diagram illustrating a print characteristics acquisition unit in accordance with the second embodiment of the present invention. The control unit A2 and others are not shown as they are the same as in the first embodiment. In the second embodiment, the print head A7 prints a pattern for print characteristics acquisition J100, and a printed pattern reading unit J1 reads the printed pattern, which is then sent to the print characteristics acquisition unit A51 (FIG. 1A) of the control unit. The printed pattern reading unit J1 includes a CCD for reading density of an image, and others.

Figures 18, 18A:
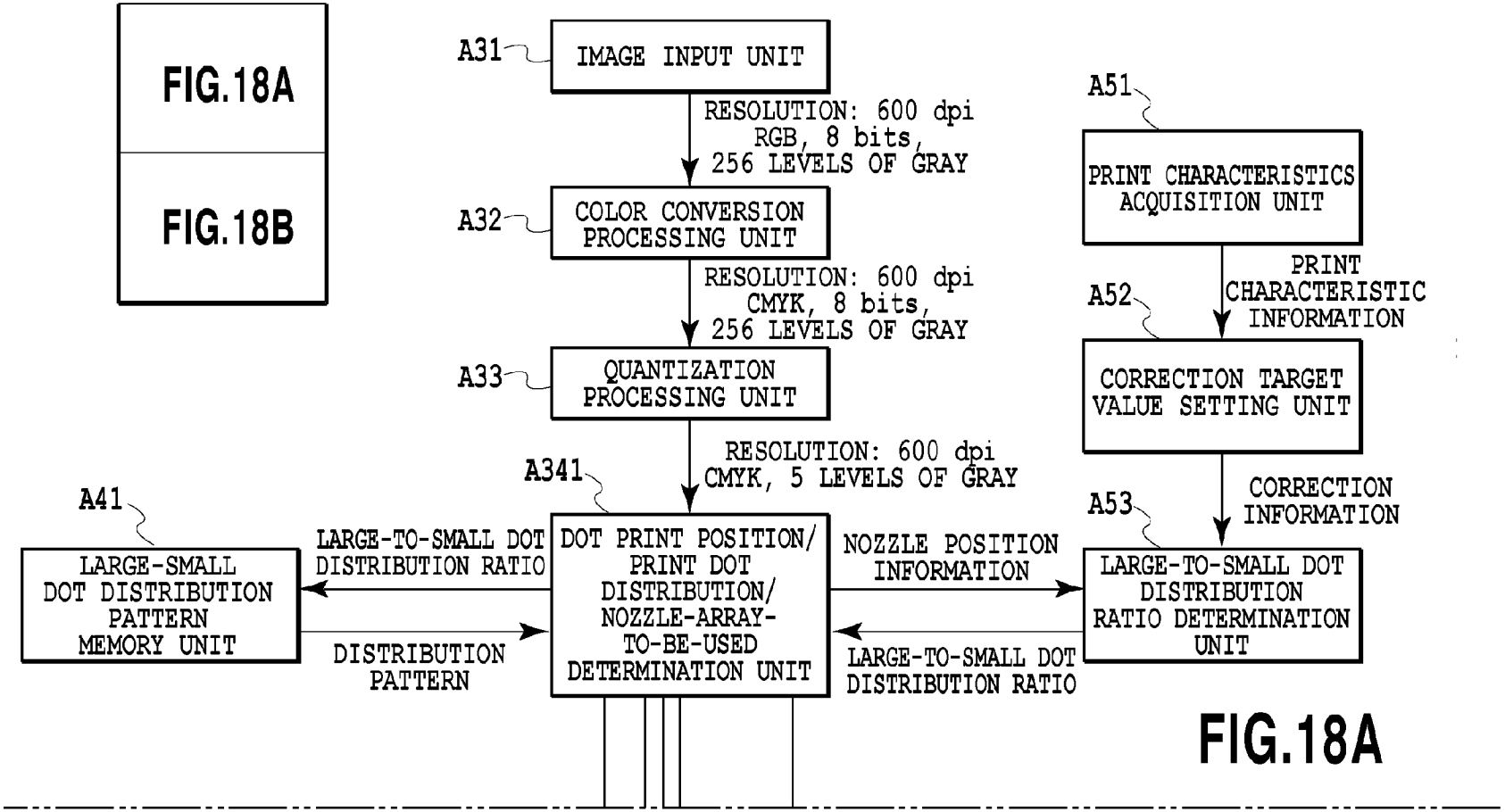
FIG. 18 is a diagram showing the relationship between FIGS. 18A and 18B.
FIGS. 18A and 18B are schematic diagrams of image processing in accordance with the second embodiment of the present invention.
Figure 18B:
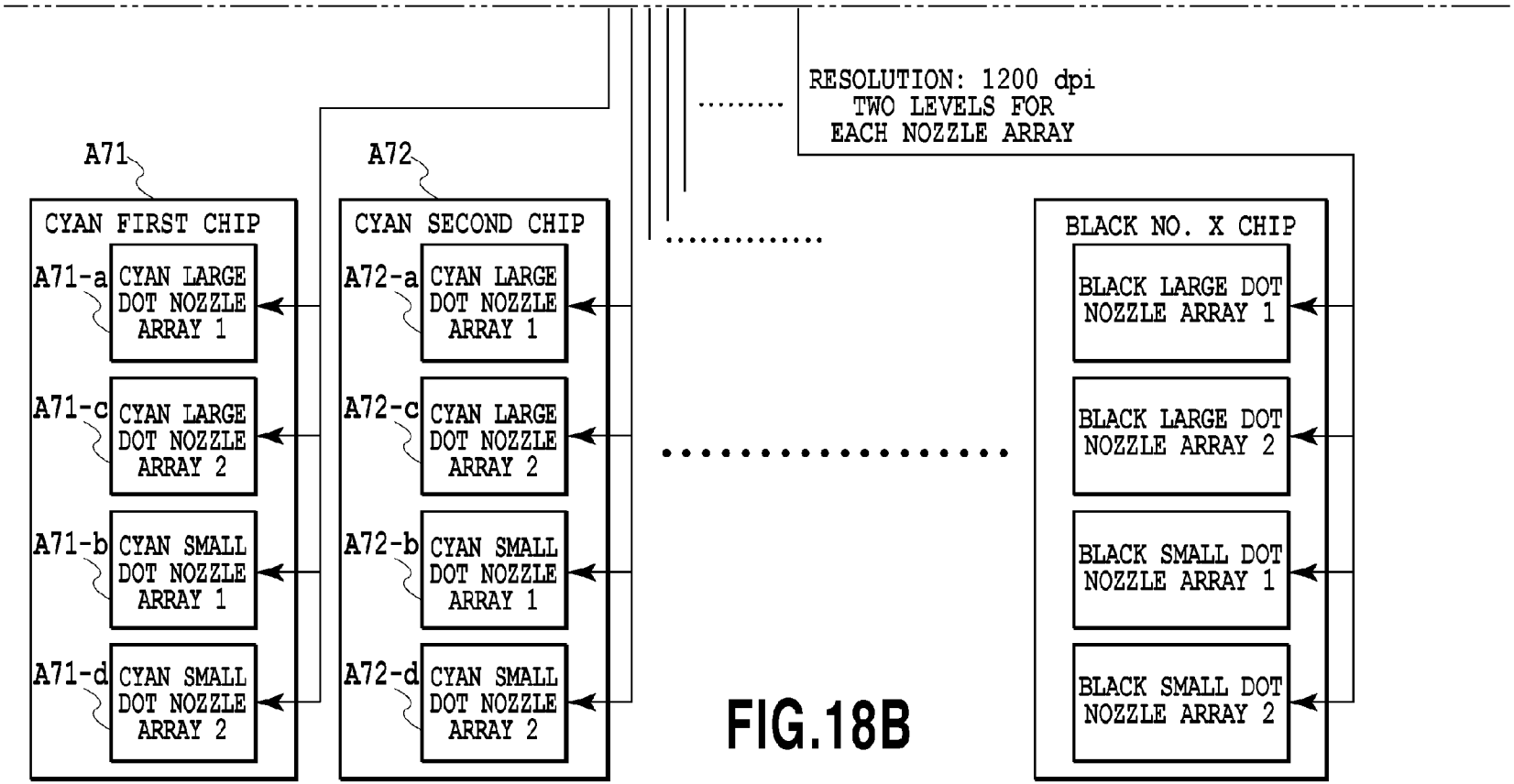
Figure 19A:
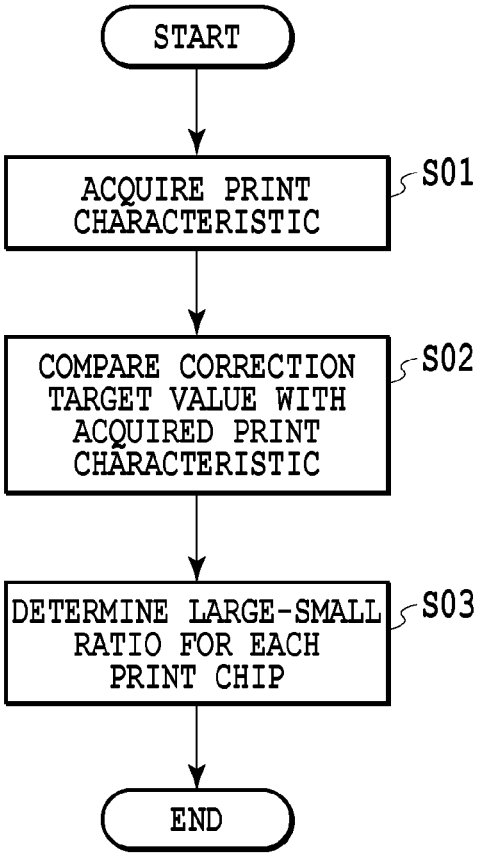
FIGS. 19A and 19B are flow charts of the second embodiment of the present invention.
Figure 19B:
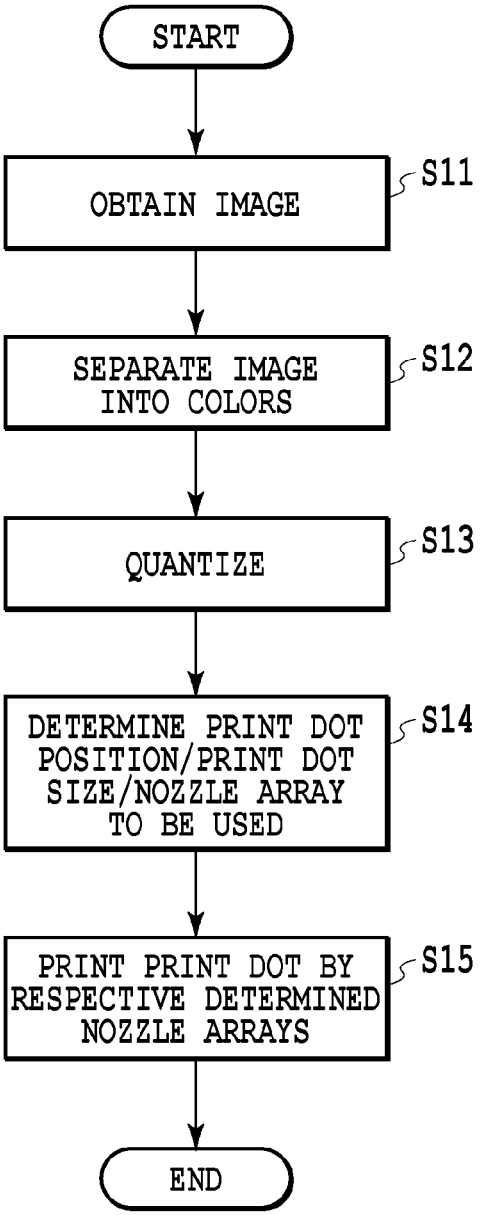

FIGS. 18A and 18B are schematic diagrams of image processing in accordance with the second embodiment of the present invention. FIGS. 19A and 19B are flow charts illustrating the processing flows. First, in step S01 of FIG. 19A, as previously described with reference to FIG. 17, a pattern for print characteristics acquisition is printed for each print chip, and lightness of the printed pattern is read to acquire a print characteristic of each print chip. Hereinafter, a description will be omitted for portions overlapping with the first embodiment.

In the schematic diagrams of FIGS. 18A and 18B, the difference between the second embodiment and the first embodiment is a "dot print position/print dot distribution/nozzle-array-to-be-used determination unit" A341 of FIG. 18A. In this unit, the dot print position determination unit A34, the print dot distribution processing unit A35, and the nozzle-array-to-be-used determination unit A36 of the first embodiment as shown in FIGS. 1A and 1B are integrated. In this unit, quantized image data is obtained and print dot data for each nozzle array printed by each nozzle array is outputted.

In the flow charts of FIGS. 19A and 19B, the difference between the second embodiment and the first embodiment is step S14 of FIG. 19B. In the second embodiment, the processing corresponding to step D14 to step D16 of the flow chart of the first embodiment shown in FIG. 4B is performed collectively as one step.

Figure 20:
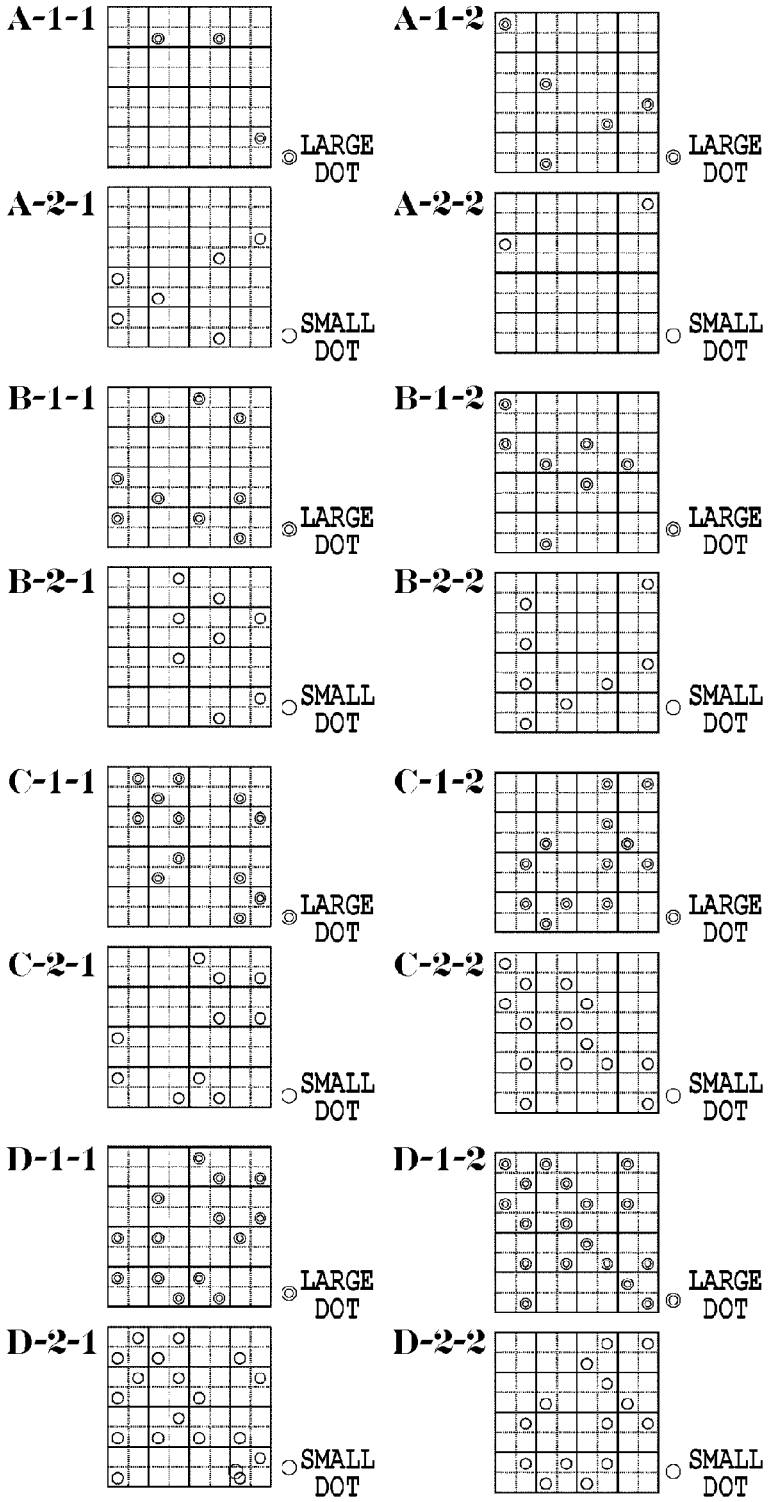
FIG. 20 illustrates large-small dot distribution patterns of the second embodiment of the present invention.

FIG. 20 shows large-small dot distribution patterns used in the present embodiment. Using an example that an output level after quantization is Level 1, the large-small dot distribution patterns used in the present embodiment will be described in detail. In step S13 of FIG. 19B, the quantization processing unit A33 of FIG. 18 sends quantized image data to the dot print position/print dot distribution/nozzle-array-to-be-used determination unit A341. In the present specification, the quantized image data is hereafter also referred to simply as "quantized data." In FIG. 20, A shows exemplary image data of 8×8 in size in a case where an output level after quantization is Level 1. In step S14, the dot print position/print dot distribution/nozzle-array-to-be-used determination unit A341 refers to large-small dot distribution patterns according to input quantized data to generate print dot data associated with each of the large or small nozzle arrays A71*a*, A71*b*, A71*c*, and A71*d*. In FIG. 20, A-1-1 to A-2-2 show distribution patterns in a case where a distribution ratio of large dots to small dots is 1:1. In FIG. 20, A-1-1, A-1-2, A-2-1, and A-2-2 show print data for the nozzle array A71*a*, the nozzle array A71*c*, the nozzle array A71*b*, and the nozzle array A71*d*, respectively. It is determined which nozzle array is used for printing based on the entered output level after quantization and positional information on the image. In FIG. 20, B to D-2-2 show exemplary large-small dot distribution patterns according to the present embodiment at output levels of Level 2 to Level 4 after quantization.

Incidentally, superposing four print dot patterns as shown by A-1-1 to A-2-2 in FIG. 20 at an output level of Level 1 produces the same pattern as shown by B-1 in FIG. 8 which is described in the first embodiment. Similarly, superposing four print dot patterns as shown by B-1-1 to B-2-2 in FIG. 20 at an output level of Level 2 produces the same pattern as shown by B-2 in FIG. 8 which is described in the first embodiment. Further, superposing four print dot patterns as shown by C-1-1 to C-2-2 in FIG. 20 at an output level of Level 3 produces the same pattern as shown by B-3 in FIG. 8 which is described in the first embodiment. Still further, superposing four print dot patterns as shown by D-1-1 to D-2-2 in FIG. 20 at an output level of Level 4 produces the same pattern as shown by B-4 in FIG. 8 which is described in the first embodiment.

The large-small dot distribution patterns of the present embodiment may be obtained by distributing the large-small dot distribution patterns of the first embodiment to the respective nozzle arrays based on masks. Alternatively, the large-small dot distribution patterns may be generated by expanding the methods such as "determination of print dot sizes by random numbers" or "determination of arrangements of print dot sizes by using repulsive potential" as described in the first embodiment. In this case, "determination of positions of large dots and small dots" of the first embodiment may be replaced with "determination of nozzle arrays to be used," and further, the output of two types of nozzle array groups, large and small planes, may be increased to correspond to the increased number of nozzle arrays. In this case, since the number of nozzle arrays in this example is four, the output corresponds to four planes. In particular, determination of print dot sizes and nozzle arrays to be used by using "repulsive potential" makes it possible to uniformly arrange dots printed by each nozzle array and increase dispersing characteristics of large dots as well as dispersing characteristics of large (small) dots printed by each nozzle array.

Here, unbalanced usage of nozzle arrays causes a nozzle array which is used more frequently to reach its end of life within a short time to decrease durability of the entire print head. Furthermore, insufficient dispersion of large dots may adversely affect graininess of an image when formed on a print medium. In addition, insufficient dispersion of print dots per nozzle array may increase visibility of displacements of print positions among nozzle arrays.

The large-small dot distribution patterns used for determination of print dot sizes and nozzle arrays to be used by using "repulsive potential" can solve the above problems to increase durability of a print head and improve graininess of an image, and reduce an adverse influence on an image caused by displacements of print positions among nozzle arrays.

As described above, in the second embodiment, lightness is used as a print characteristic to be corrected, and according to the distribution ratio of print dots having different values of lightness, the print data for each nozzle array is generated and printed based on the quantized data. Accordingly, in the second embodiment, it is possible to correct print density and keep a print dot pattern unchanged at the same time, thereby reducing uneven images.

In addition, since "determination of dot print positions," "print dot distribution," and "determination of nozzle arrays to be used" can be completed at the same time, the second embodiment can achieve a shorter processing time and lighter processing load, as compared to the first embodiment. Furthermore, in the second embodiment, the print dot data printed by each nozzle array is directly generated based on the quantized data. Therefore, by generating large-small dot distribution patterns by using "repulsive potential" or the like, it is possible to improve durability of a print head, improve graininess of an image, and reduce an adverse influence of print dot displacements among nozzle arrays.

Incidentally, as print characteristics in the present invention, an ink volume (ejection volume) is used in the first embodiment and lightness is used in the second embodiment, but it should be understood that print characteristics are not limited to them, and any print characteristics which affect density variations can be used.

For example, instead of an ejection volume itself, an ejection volume ranking determined by ranks of sorted ejection volumes may be used. This is because an ejection volume ranking allows ejection volume management with a less amount of information, and therefore, it is possible to reduce memory consumption in a printing apparatus or a print head.

In the same manner as the lightness, density may be used. Furthermore, a diameter of an ejection nozzle (or a nozzle diameter ranking) may be used as information about print characteristics. This is available because the ejection volume is highly relevant to the diameter of an ejection nozzle. Since this does not require ink in acquisition of print characteristics, time and trouble can be significantly saved.

Furthermore, print characteristics of part of the print dots, not all of the print dots having different print characteristics, may be acquired to determine a distribution ratio. This is because, in a case where nozzle groups which eject print dots having different print characteristics are provided in the same print chip, variations in the print characteristics within the same print chip are relevant to each other. Acquiring print characteristics of only part of the print dots having different print characteristics can minimize the time required for acquiring print characteristics and the print media and inks used for acquiring print characteristics.

It should be understood that the print characteristics may be acquired in an image printing apparatus or may be measured at a factory or the like prior to shipment and stored in a memory unit provided for a print head. Alternatively, a user may enter information indicating print characteristics as a type of print characteristics acquisition unit. User's determination on a preferable correction level based on print head characteristic information or a print medium allows proper density correction without having a specific print characteristics acquisition unit.

Third Embodiment

In a third embodiment, an example of collectively performing quantization, dot print position determination, and print dot distribution of large and small dots will be described.

Figure 21B:
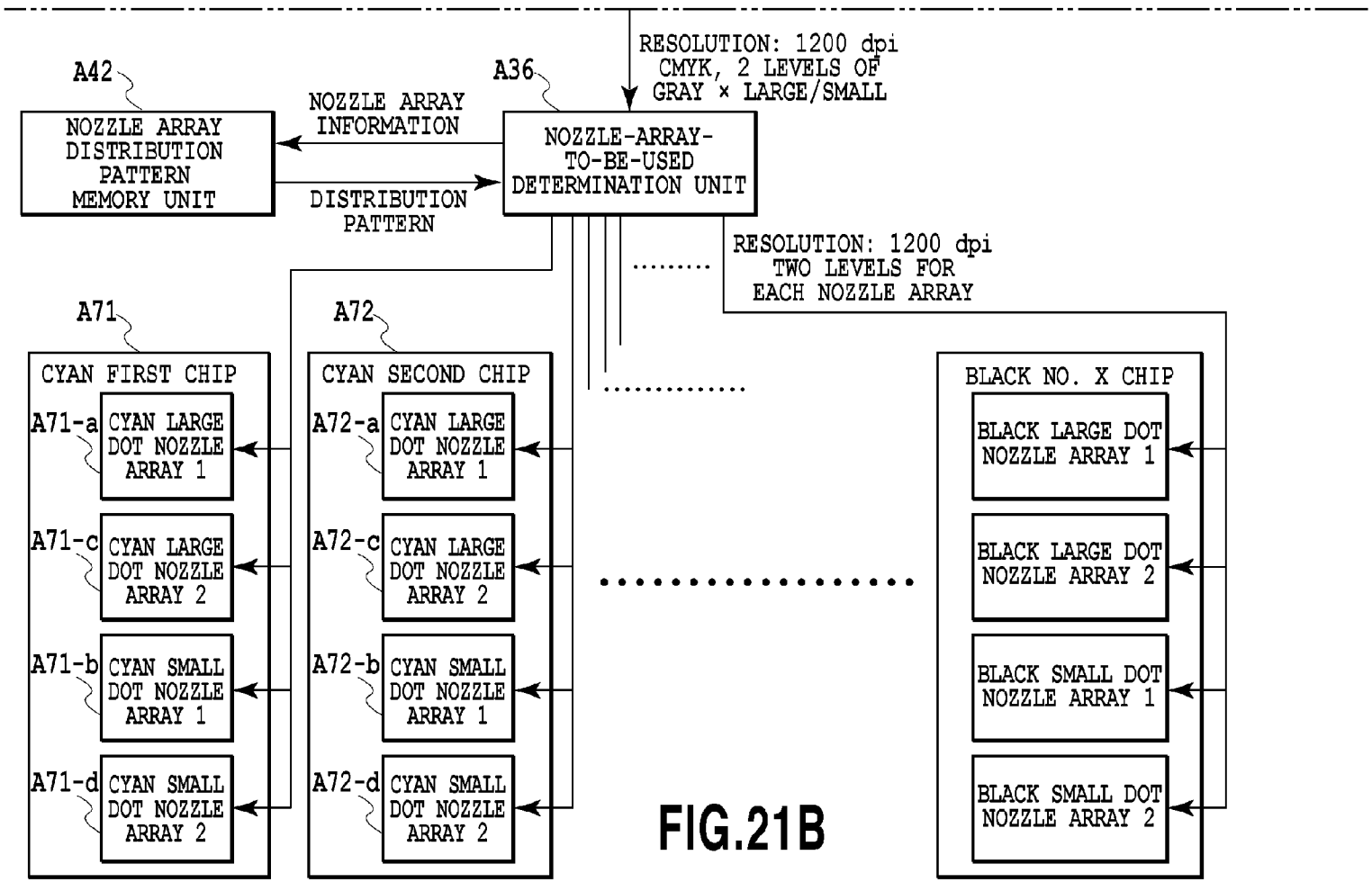
Figure 22A:
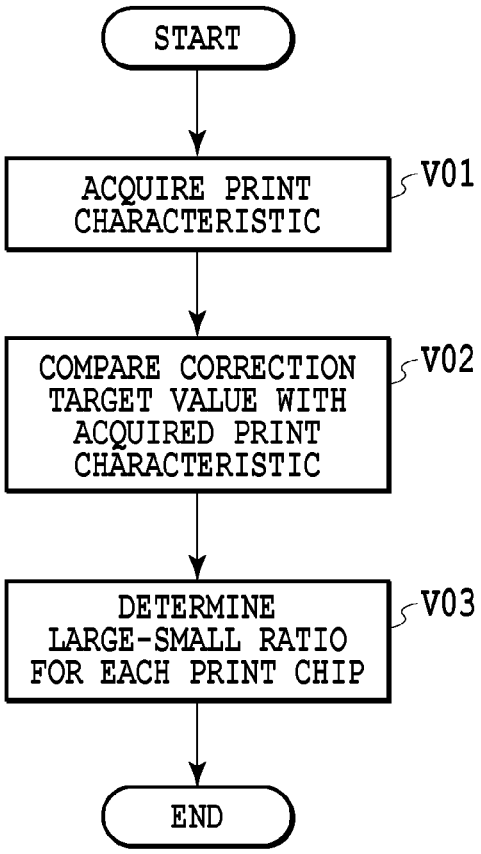
FIGS. 22A and 22B are flow charts of the third embodiment of the present invention.
Figure 22B:
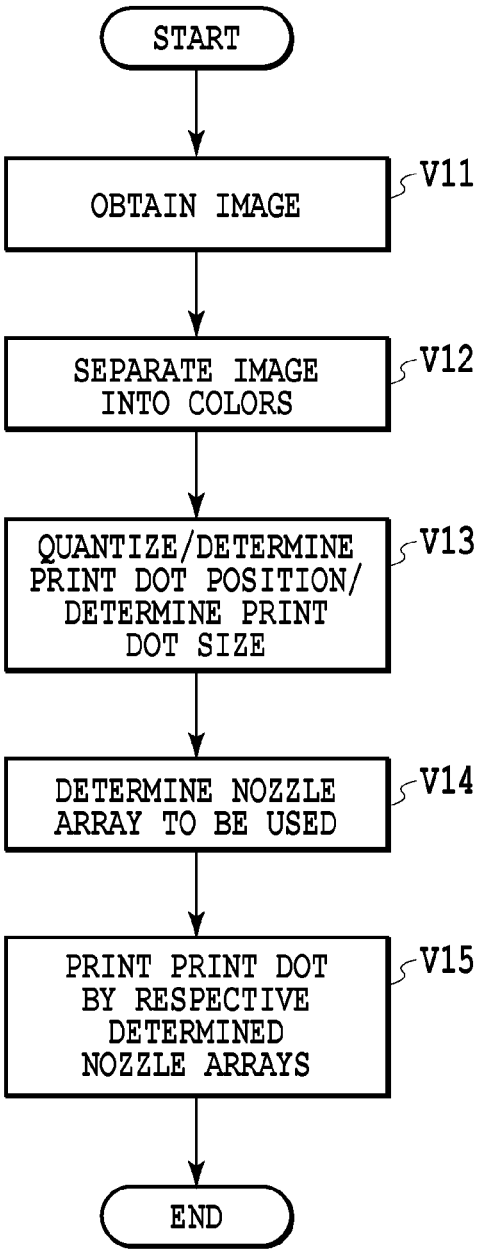

FIGS. 21A and 21B are schematic diagrams of image processing of the third embodiment. FIGS. 22A and 22B are flow charts showing the processing flows of the third embodiment. A description will be omitted for portions overlapping with the first embodiment and/or the second embodiment.

In the schematic diagrams of FIGS. 21A and 21B, the difference between the third embodiment and the first embodiment is a "quantization/dot print position/print dot distribution processing unit" A331 of FIG. 21A. In this unit, the quantization processing unit A33, the dot print position determination unit A34, and the print dot distribution processing unit A35 of the first embodiment as shown in FIG. 1A are integrated. In the third embodiment, color-separated image data with multiple levels of gray (256 levels of gray in this example) is obtained, and print dot data are outputted for large dots and small dots.

In the flow charts of FIGS. 22A and 22B, the difference between the third embodiment and the first embodiment is step V13 in FIG. 22B. In the third embodiment, the processing corresponding to step D13 to step D15 of the flow chart of the first embodiment shown in FIG. 4B is performed collectively as one step.

Figure 23:
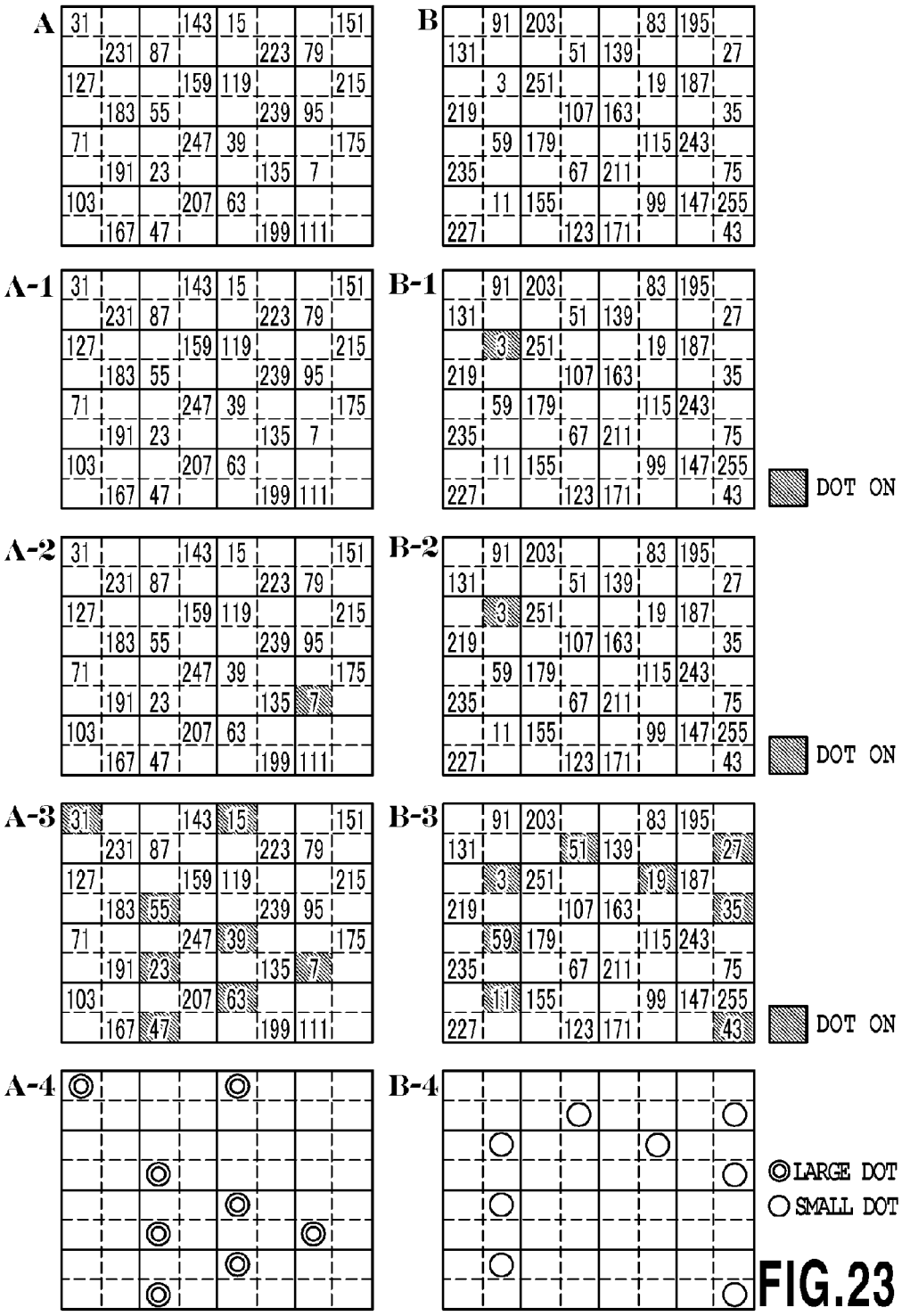
FIG. 23 illustrates large-small dot distribution patterns of the third embodiment of the present invention.

FIG. 23 shows large-small dot distribution patterns for a large-to-small distribution ratio of 1:1 to describe the processing in the "quantization/dot print position/print dot distribution processing unit" A331 employed in this embodiment. In FIG. 23, A shows an exemplary large-small dot distribution pattern of large dots, whereas B shows an exemplary large-small dot distribution pattern of small dots. In step V12 of FIG. 22B, the color conversion processing unit A32 of FIG. 21A sends color-separated output multi-level image data (256 levels of gray from 0 to 255 in this example) to the quantization/dot print position/print dot distribution processing unit A331. The quantization/dot print position/print dot distribution processing unit A331 compares the received output multi-level image data with a threshold at the same position in each of the large dot distribution pattern and the small dot distribution pattern in which thresholds are set for each of the large dot distribution pattern and the small dot distribution pattern. A large dot and a small dot are separately arranged only on portions of the image data with a signal value equal to or greater than the threshold.

A more specific description will be given. For example, in a case where the output multi-level image data is uniform image data with the signal value "4," the smallest threshold in the large dot distribution pattern is 7. Since the signal value is smaller than the threshold, no large dot is outputted (see A-1 in FIG. 23). At the same time, the smallest threshold in the small dot distribution pattern is 3. Since the signal value is greater than the threshold, one small dot is outputted to this position (see B-1 in FIG. 23). In the same manner, in a case where the output multi-level image data has the signal value "8," one large dot is outputted to a lower right position to which the threshold 7 is given (see A-2 in FIG. 23), and one small dot is outputted to the aforementioned position to which the threshold 3 is given (see B-2 in FIG. 23).

In FIG. 23, A-3 and B-3 show examples that a signal value of the output multi-level image data is "64," which is a representative value at an output level after quantization in the first embodiment. As is apparent from FIG. 23, the portions to which a threshold equal to or smaller than 64 is given are set to "dot ON" and become the output target. In FIG. 23, A-4 and B-4 illustrate large dot arrangement and small dot arrangement, respectively, in a case where a signal value of the output multi-level image data is "64." It is understood that eight large dots and eight small dots are printed, which satisfies a 1:1 distribution ratio.

As described above, FIG. 23 illustrates the case where a large-to-small dot distribution ratio is 1:1. For a different large-to-small dot distribution ratio, a different large-small dot distribution pattern which satisfies the different large-to-small dot distribution ratio may be employed.

As described above, applying a large-small dot distribution pattern as a set pattern of thresholds makes it possible to generate print dot patterns for large dots and small dots separately according to a large-to-small dot distribution ratio based on the output multi-level image data.

In the first embodiment, a large-small dot arrangement and a large-to-small dot distribution ratio are specified for each output level after quantization for the output multi-level image data. Therefore, there are some cases where gradation between one output level and another output level after quantization resulted in unfavorable graininess. According to the method of the present embodiment, it is possible to determine a large-small dot arrangement for each signal value of the multi-level image data, and therefore favorable graininess can be maintained irrespective of a signal value of the multi-level image data. In addition, since "quantization processing," "dot print position determination," and "print dot distribution" can be completed at the same time, the third embodiment can achieve a shorter processing time and lighter processing load, as compared to the first embodiment.

Fourth Embodiment

In a fourth embodiment, a description will be given of an example that image data at an output multi-level image data stage is divided according to a large-to-small dot distribution ratio, and thereafter, each piece of the divided output multi-level image data is quantized to determine print dot positions, and then print dot patterns are generated for large dots and small dots separately.

Figures 24, 24A:
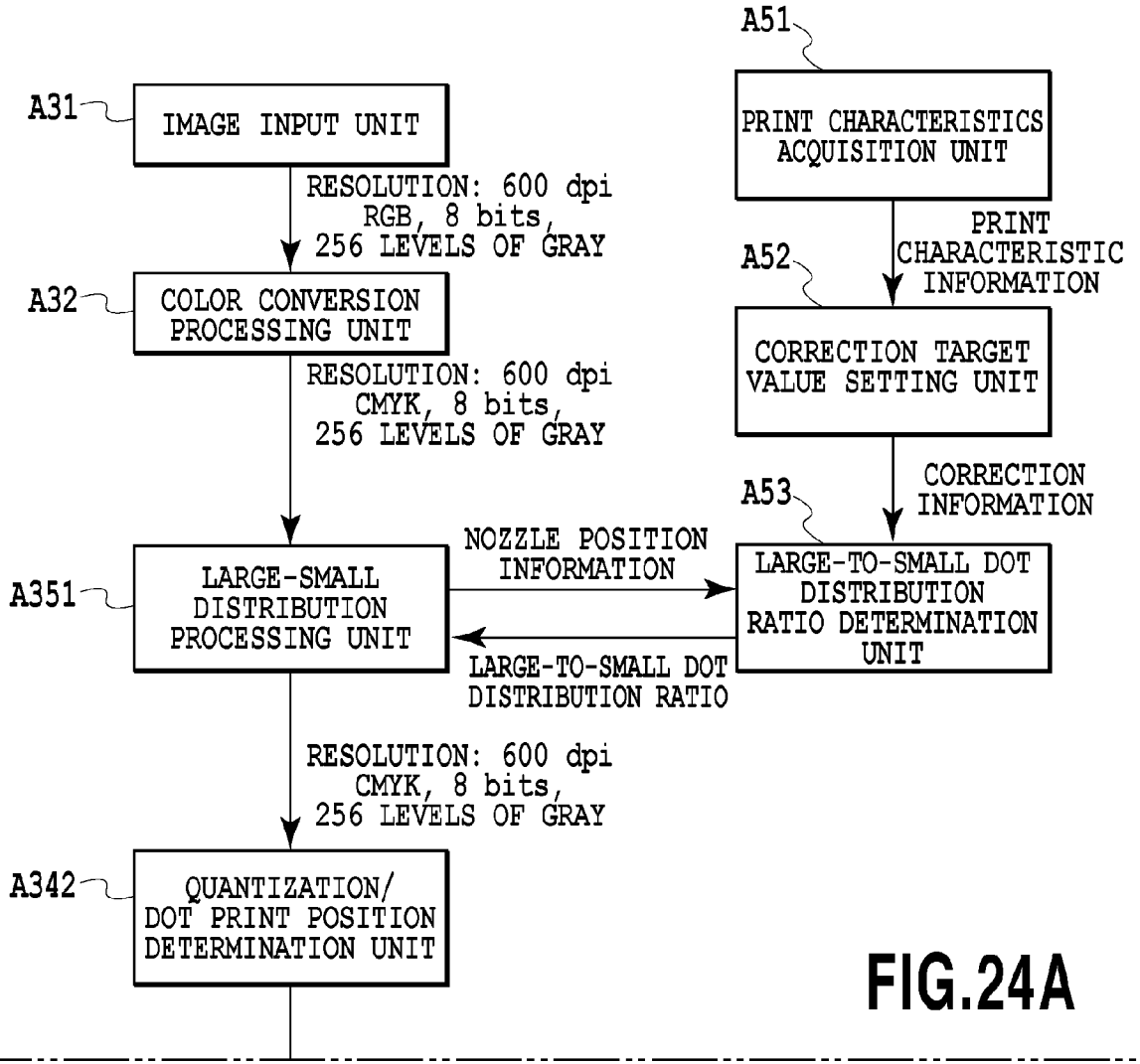
FIG. 24 is a diagram showing the relationship between FIGS. 24A and 24B.
FIGS. 24A and 24B are schematic diagrams of image processing in accordance with a fourth embodiment of the present invention.
Figure 24B:
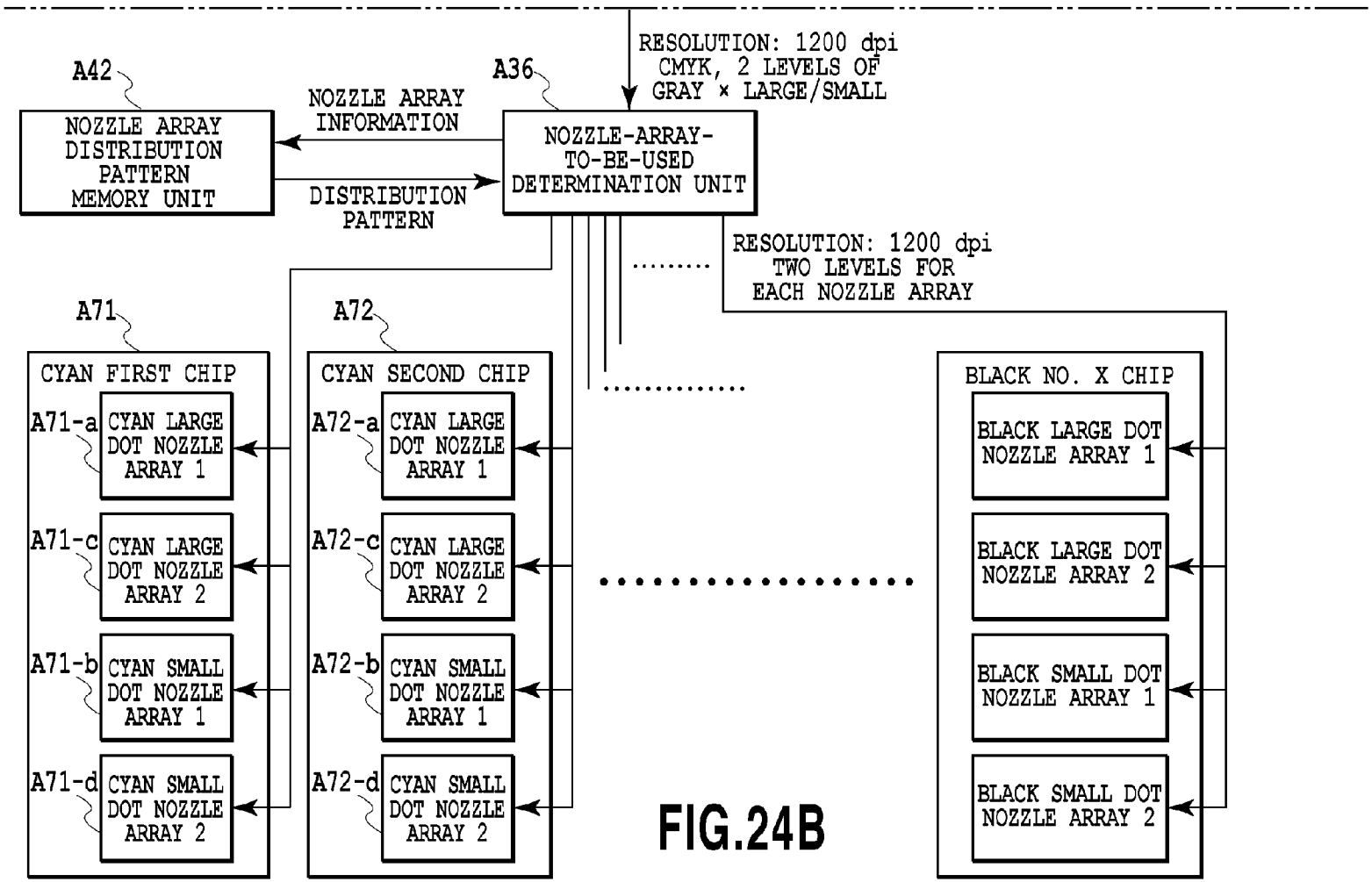
Figure 25A:
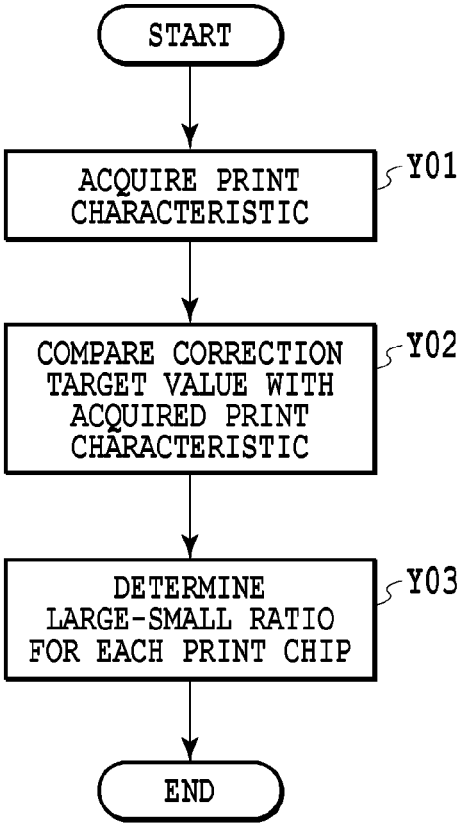
FIGS. 25A and 25B are flow charts of the fourth embodiment of the present invention.
Figure 25B:
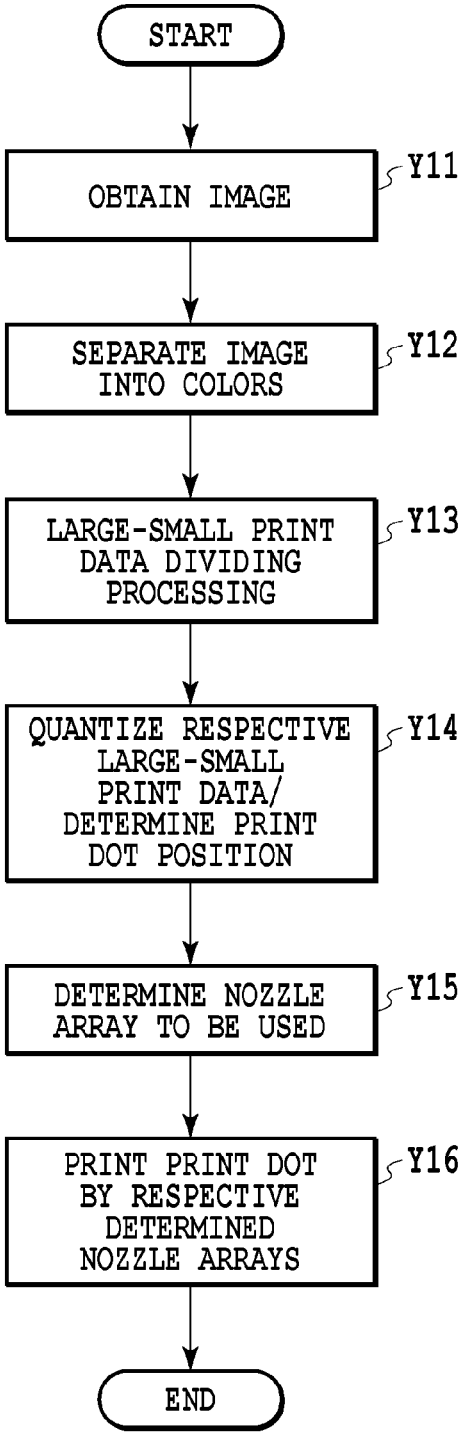

FIGS. 24A and 24B are schematic diagrams of an image processing unit of the fourth embodiment. FIGS. 25A and 25B are flow charts illustrating the processing flows. A description will be omitted for portions overlapping with the first to third embodiments.

In the schematic diagrams of FIGS. 24A and 24B, the difference between the fourth embodiment and the first embodiment is a "large-small distribution processing unit" A351 and a "quantization/dot print position determination unit" A342 of FIG. 24A. In step Y12 of FIG. 25B, the large-small distribution processing unit A351 divides output multi-level image data into colors in the color conversion processing unit A32. Then, in step Y13, the large-small distribution processing unit A351 obtains the output multi-level image data divided into colors, and further divides this data in multiple levels according to a large-to-small dot distribution ratio for each nozzle position where image data is printed. Then, in step Y14, the quantization/dot print position determination unit A342 generates print dot patterns of large dots and small dots separately based on the divided multi-level image data.

Figure 26B:
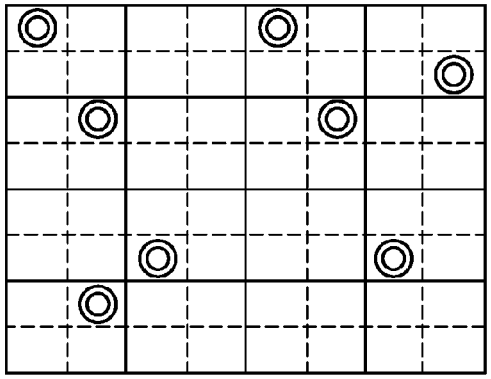
Figure 26B:
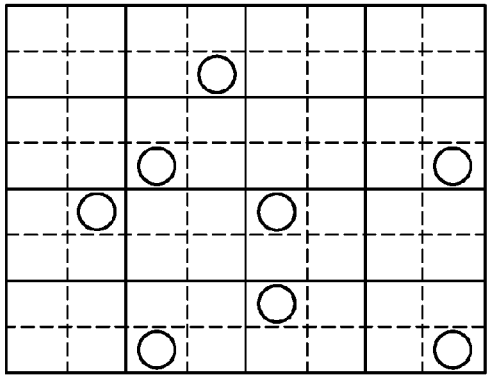
Figure 26B:
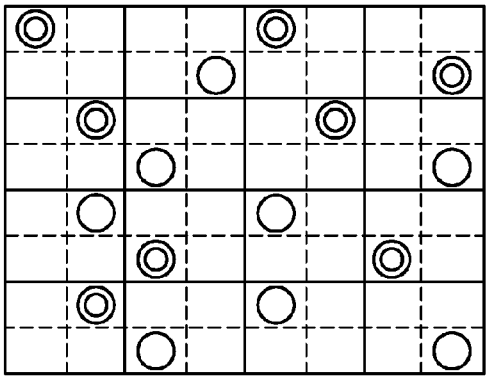

FIGS. 26A and 26B illustrate a process of dividing image data and generating print dot patterns of large dots and small dots separately according to the present embodiment. First, the following description takes A in FIGS. 26A and 26B as an example of the output multi-level image data divided into colors. A description will be given of an example that the image data has 256 levels of gray, that is, from 0 to 255, and the signal value "64."

In step Y13 of FIG. 25B, the large-small distribution processing unit A351 refers to the large-to-small dot distribution ratio for each nozzle position where the output multi-level image data is printed, and distributes the output multi-level image data according to the large-to-small dot distribution ratio. In this example, a distribution ratio of large dots to small dots is set to 1:1, and the divided image data as shown by B-1 and B-2 in FIG. 26A are obtained.

Next, in step Y14, the quantization/dot print position determination unit A342 generates print dot patterns of large dots and small dots separately based on the divided image data. In this example, dithering is used as a quantization method.

In FIG. 26A, C illustrates a dither threshold matrix. Comparisons are made between the values of the image data, and the portions to which a value equal to or greater than a threshold is given are set to "dot ON" and become the target output. First, in FIG. 26B, D-1 shows results of comparisons between the divided image data as shown by B-1 in FIG. 26A and the dither threshold matrix as shown by C in FIG. 26A. Large dots are outputted to portions indicating a signal value of the image data being a value equal to or greater than the threshold. In FIG. 26B, D-2 illustrates a print dot pattern of the outputted large dots.

Then, a print dot pattern of small dots is generated by using the same threshold matrix as the one used for large dots (see C in FIG. 26A) in this embodiment. Small dots are outputted to portions where the sum of a large dot signal value and a small dot signal value, that is, a signal value before division, is equal to or greater than the threshold and where a large dot has not been outputted. In FIG. 26B, E-1 and E-2 illustrate print dot patterns of the small dots.

In FIG. 26B, F illustrates a print dot pattern produced by superposing the print dot pattern of large dots as shown by D-2 in FIG. 26B and the print dot pattern of small dots as shown by E-2 in FIG. 26B. It can be understood that, based on the image data with the signal value "64" and a large-to-small dot distribution ratio of 1:1, the processing of the present embodiment can produce a print dot pattern including eight large dots and eight small large dots in a 1:1 ratio of the number of large dots to the number of small dots.

In this manner, one dither threshold matrix is commonly used between large dots and small dots so that the print dot pattern combining large dots and small dots can be shared irrespective of the large-to-small dot distribution ratio.

As described above, it is understood that, to divide image data according to a large-to-small dot distribution ratio, it is also possible to divide the output multi-level image data of multiple levels of gray.

Fifth Embodiment

In a fifth embodiment, an example of collectively performing quantization, dot print position determination, print dot distribution of large and small dots, and determination of nozzle arrays to be used will be described.

Figures 27, 27A:
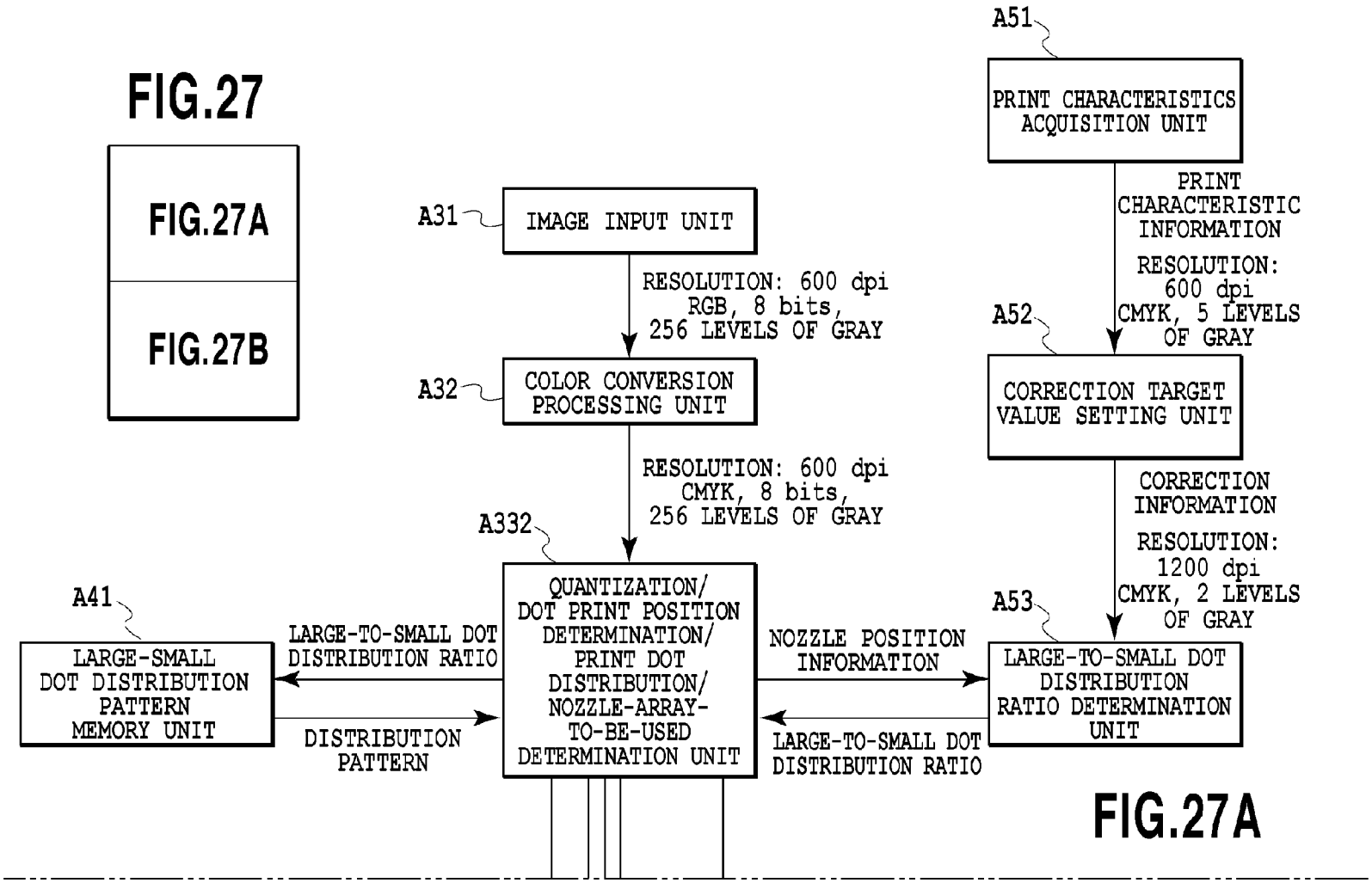
FIG. 27 is a diagram showing the relationship between FIGS. 27A and 27B.
FIGS. 27A and 27B are schematic diagrams of image processing in accordance with a fifth embodiment of the present invention.
Figure 27B:
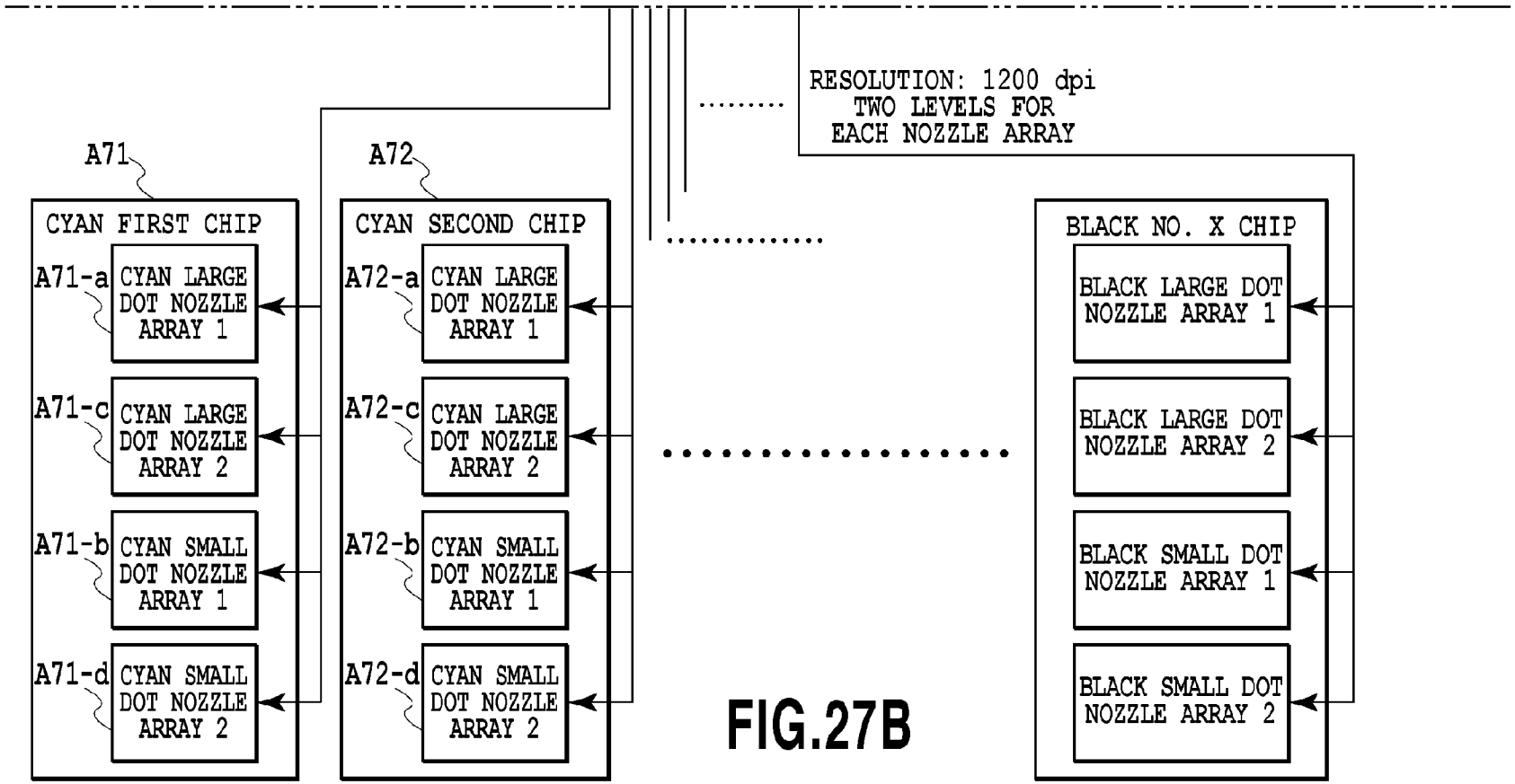
Figure 28A:
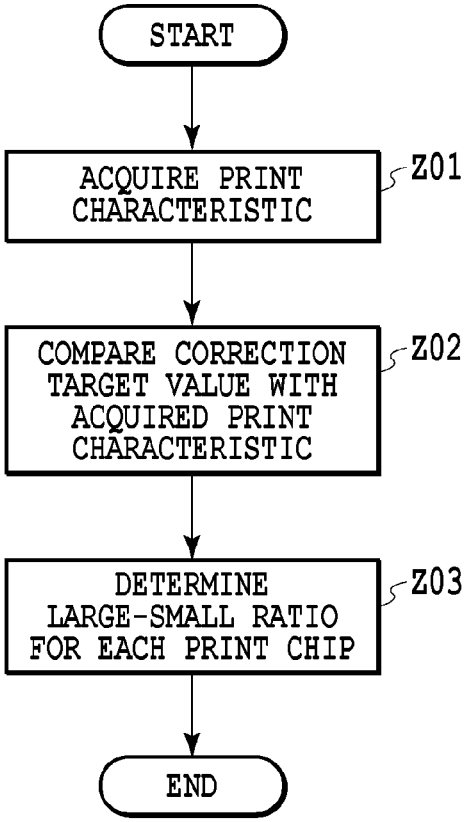
FIGS. 28A and 28B are flow charts of the fifth embodiment of the present invention.
Figure 28B:
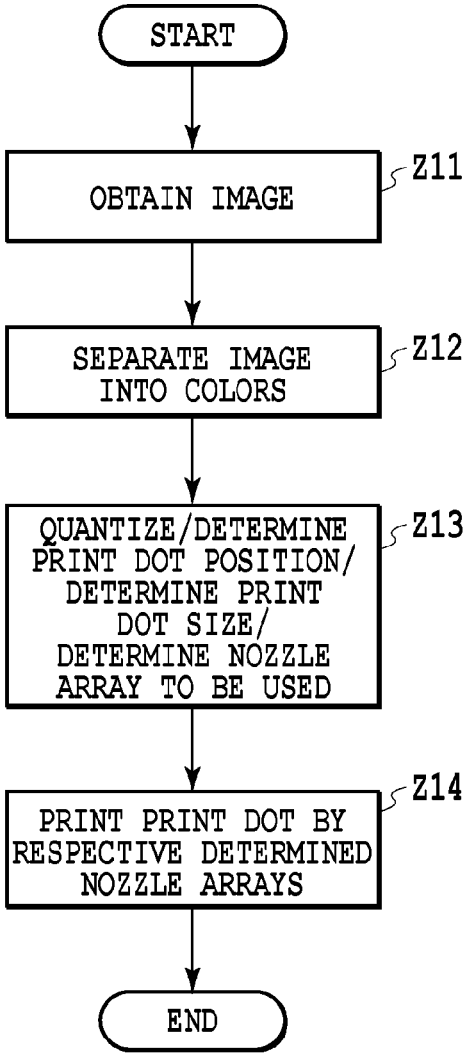

FIGS. 27A and 27B are schematic diagrams of image processing in accordance with the fifth embodiment, and FIGS. 28A and 28B are flow charts illustrating the processing flows. A description will be omitted for portions overlapping with the first to fourth embodiments.

In the schematic diagrams of FIGS. 27A and 27B, the difference between the fifth embodiment and the first embodiment is a "quantization/dot print position determination/print dot distribution/nozzle-array-to-be-used determination unit" A332 of FIG. 27A. In this unit, the quantization processing unit A33, the dot print position determination unit A34, the print dot distribution processing unit A35, and the nozzle-array-to-be-used determination unit A36 of the first embodiment as shown in FIGS. 1A and 1B are integrated. Color-separated output multi-level image data with multiple levels of gray (256 levels of gray in this example) is obtained, and print dot data for each nozzle array printed by a plurality of nozzle arrays having different print characteristics is outputted.

In the flow charts of FIGS. 28A and 28B, the difference between the fifth embodiment and the first embodiment is step Z13 of FIG. 28B. In step Z13, the processing corresponding to steps D13 to D16 of the flow of the first embodiment in FIG. 4B is performed collectively as one step.

Figure 29A:
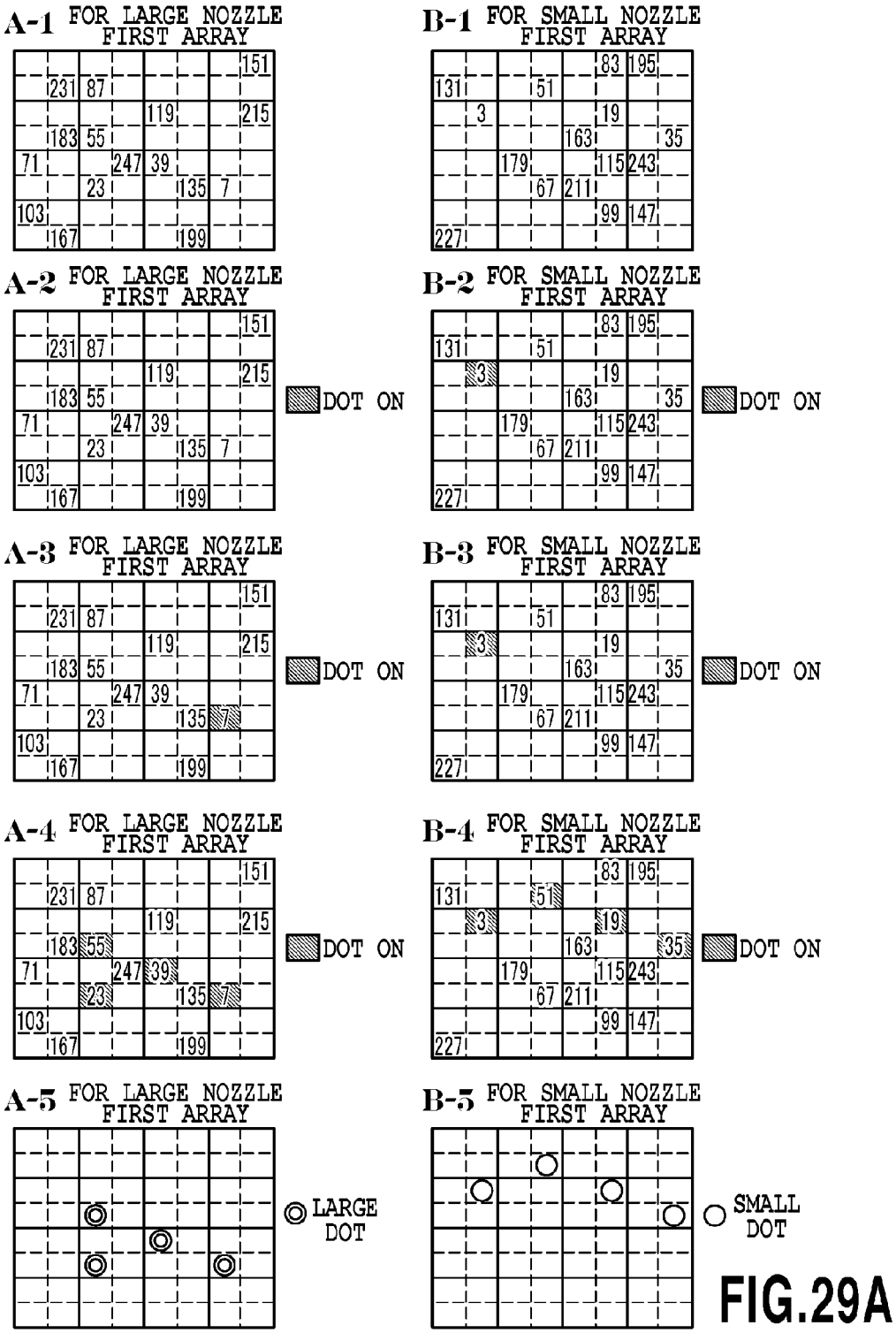

FIGS. 29A and 29B illustrate large-small dot distribution patterns in a case where a distribution ratio of large dots to small dots is 1:1 to describe the processing in the "quantization/dot print position determination/print dot distribution/nozzle-array-to-be-used determination unit" A332 employed in the present embodiment. In FIGS. 29A and 29B, A-1, B-1, C-1, and D-1 illustrate large-small dot distribution patterns for the nozzle array A71*a*, A71*b*, A71*c*, and A71*d*, respectively. In step Z13 of FIG. 28B, the quantization/dot print position determination/print dot distribution/nozzle-array-to-be-used determination unit A332 performs the following processing collectively. That is, first, color-separated output multi-level image data (256 levels of gray from 0 to 255 in this example) is obtained, and then, in the large-small dot distribution patterns prepared for the respective nozzle arrays as shown by A-1 to D-1 in FIGS. 29A and 29B, thresholds in the same position are compared. Then, print dots are arranged only on portions indicating that a signal value of the image data is equal to or greater than the threshold for the nozzle array.

A more specific description will be given. For example, in FIGS. 29A and 29B, A-1 to D-2 illustrate the case where the output multi-level image data is uniform image data with the signal value "4." In this case, the smallest threshold for the nozzle array A71*a* is 7 as shown by A-2 in FIG. 29A. Since the signal value is smaller than the threshold, no print dot is outputted. Similarly, for the nozzle arrays A71*c* and A71*d*, no print dot is outputted (see C-2 and D-2 in FIG. 29B). For the nozzle array A71*b*, since there is an upper left portion with the threshold "3," which is smaller than the signal value "4" of the output multi-level image data, as shown by B-2 in FIG. 29A, one dot is outputted to this position.

Here, since the nozzle array A71*b* is a nozzle array for printing small dots, "one small dot" is printed in a case where a signal value of the output multi-level image data is "4."

Next, with reference to A-3 and D-3 in FIGS. 29A and 29B, a description will be given of the case where a signal value of the output multi-level image data is "8." In the same manner as the previous case, print dots are arranged on portions indicating that a signal value of the output multi-level image data is equal to or greater than the threshold. With reference to A-3 of FIG. 29A, one large dot is arranged on a lower right portion in the pattern for the nozzle array A71*a*. With reference to B-3 of FIG. 29A, one small dot is arranged on an upper left portion in the pattern for the nozzle array A71*b*.

Further, with reference to A-4 to D-4 in FIGS. 29A and 29B, a description will be given of the case where a signal value of the output multi-level image data is "64." Print dots are arranged on portions indicating that a signal value of the output multi-level image data is equal to or greater than the threshold in the large-small dot distribution patterns for the respective nozzle arrays. In FIGS. 29A and 29B, A-5 to D-5 show arrangements of large dots or small dots printed for each nozzle array in this case. According to this embodiment, in a case where a distribution ratio of large dots to small dots is 1:1 and a signal value of the output multi-level image data is "64," it is understood that four dots are printed by each nozzle array, and eight large dots and eight small dots are printed.

The case where a large-to-small dot distribution ratio is 1:1 has been described for the example of the present embodiment as shown in FIGS. 29A and 29B. For a different large-to-small dot distribution ratio, a different large-small dot distribution pattern which satisfies the different large-to-small dot distribution ratio and does not change positions of print pixels for printing print dots may be employed.

Further, in the present embodiment, the threshold patterns which do not include overlaps between the large-small dot distribution patterns as shown by A-1 to D-1 in FIGS. 29A and 29B are used, but the present invention is not limited thereto. Large-small dot distribution patterns including overlaps between patterns may be employed. Employing a pattern without overlaps can print only up to one dot, either a large dot or a small dot per print pixel. However, allowing overlaps makes it possible to print two or more dots to readily increase volumes of ink that can be used for printing.

As described above, in the present embodiment, a large-small dot distribution pattern is applied to each nozzle array as a set pattern of thresholds. This makes it possible to convert the input multi-level image data to generate color-specific output multi-level image data at an output multi-level image data stage, and generate print dot patterns for respective nozzle arrays according to a large-to-small dot distribution ratio based on the generated output multi-level image data.

In the first embodiment, a large-small dot arrangement and a large-to-small dot distribution ratio are specified for each output level after quantization for the multi-level image data. Therefore, there are some cases where gradation between one output level and another output level after quantization resulted in unfavorable graininess. According to the method of the present embodiment, it is possible to determine a large-small dot arrangement for each signal value of the multi-level image data, and therefore favorable graininess can be maintained irrespective of a signal value of the multi-level image data.

In the present embodiment, since it is possible to determine an arrangement of dots printed by each nozzle array for each signal value of the multi-level image data, a difference in usage frequencies among nozzle arrays can be minimized to increase durability of a print head. In addition, since "quantization processing," "dot print position determination," "print dot distribution," and "determination of nozzle arrays to be used" can be completed at the same time, the fifth embodiment can achieve a shorter processing time and lighter processing load, as compared to the first embodiment.

As described in the first to fifth embodiments, the present invention can prevent degradation of image quality resulting from variations in print characteristics among predetermined portions of nozzle arrays. The first to fifth embodiments have shown that various methods can distribute print dots according to a distribution ratio.

It can be understood that different print characteristics in the present invention may be specified by, for example, three different types of dot sizes to form large, medium, and small dots, other than a combination of large and small dots. In addition, the present invention has been described using a line printer, but the present invention may be applied to a serial printer. In the case of a serial printer, a different print characteristic of the present invention may be set for each print chip, for example, and correction may be performed for a unit of print chip, including, for example, a large dot print chip and a small dot print chip differing in ejection volumes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-225998, filed Oct. 11, 2012, which is hereby incorporated by reference herein in its entirety.

What is claimed is:

1. A printing apparatus provided with a print head including a plurality of nozzle groups each consisting of a plurality of nozzles, each of the plurality of nozzle groups applying ink having a plurality of volumes from the plurality of nozzles onto a print medium to form a plurality of dots including dots differing in size for printing, the printing apparatus comprising:

an arrangement determination unit configured to determine an arrangement of dots to be formed in a unit area of the print medium according to a density of an image to be formed in the unit area by each of the plurality of nozzle groups;

a size determination unit configured to determine sizes of the dots for printing determined by the arrangement determination unit, according to respective ejection characteristics of the plurality of nozzle groups, such that a ratio of the number of dots having a first size to the number of dots having a second size which is different from the first size in the case where the density of an image to be formed in the unit area is a first density and the ratio in the case where the density of an image to be formed in the unit area is a second density which is different from the first density are substantially the same; and an ejection control unit configured to control the print head to eject ink having the plurality of sizes determined by the size determination unit in positions of the print medium based on the arrangement determined by the arrangement determination unit.

2. The printing apparatus according to claim 1, wherein at least one of the nozzle groups in the print head has a first ejection port having a first diameter for ejecting ink having a first volume and a second ejection port having a second diameter for ejecting ink having a second volume which is different from the first volume, and the size determination unit is configured to determine whether the dots to be formed on the print medium are formed by ink ejected from the first ejection port or by ink ejected from the second ejection port.

3. The printing apparatus according to claim 1, wherein each of the nozzle groups is a nozzle array consisting of nozzles arranged in a predetermined direction.

4. The printing apparatus according to claim 1, wherein each of the nozzle groups corresponds to a print chip provided for the print head.

5. The printing apparatus according to claim 4, wherein each of the nozzle groups corresponds to one of divided sections of the print chip provided for the print head.

6. The printing apparatus according to claim 1, wherein the ejection characteristics are volumes of ink applied from the nozzles.

7. The printing apparatus according to claim 1, further comprising a density data generation unit configured to generate density data indicating the density of an image to be formed in the unit area based on input image data, and the arrangement determination unit determines the arrangement of dots to be formed in the unit area based on the density data generated by the density data generation unit.

8. The printing apparatus according to claim 1, wherein the arrangement determination unit determines the arrangement of dots according to a dot pattern corresponding to the density of the image to be formed in the unit area and the size determination unit determines the sizes of dots corresponding to the dot pattern by using distribution patterns which represent printing indicating whether the size is the first size or the second size for a plurality of dots depicted by the dot pattern.

9. The printing apparatus according to claim 8, further comprising a memory configured to store a plurality of dot patterns corresponding to a plurality of density levels and a memory configured to store a plurality of distribution patterns corresponding to the plurality of dot patterns, respectively, and the ratios are substantially the same as one another between the plurality of distribution patterns.

10. A printing method using a print head including a plurality of nozzle groups each consisting of a plurality of nozzles, each of the plurality of nozzle groups applying ink having a plurality of volumes from the plurality of nozzles onto a print medium to form a plurality of dots including dots differing in size, the printing method comprising:

an arrangement determination step of determining an arrangement of dots to be formed in a unit area of the print medium according to a density of an image to be formed in the unit area by each of the plurality of nozzle groups;

a size determination step of determining sizes of the dots for printing determined in the arrangement determination step, according to respective ejection characteristics of the plurality of nozzle groups, such that a ratio of the number of dots having a first size to the number of dots having a second size which is different from the first size in the case where the density of an image to be formed in the unit area is a first density and the ratio in the case where the density of an image to be formed in the unit area is a second density which is different from the first density are substantially the same; and an ejection control step of controlling the print head to eject ink having the plurality of sizes determined in the size determination step in positions of the print medium based on the arrangement determined in the arrangement determination step.

11. The printing method according to claim 10, wherein at least one of the nozzle groups in the print head has a first ejection port having a first diameter for ejecting ink having a first volume and a second ejection port having a second diameter for ejecting ink having a second volume which is different from the first volume, and the size determination step is configured to determine whether the dots to be formed on the print medium are formed by ink ejected from the first ejection port or by ink ejected from the second ejection port.

12. The printing method according to claim 10, wherein each of the nozzle groups is a nozzle array consisting of nozzles arranged in a predetermined direction.

13. The printing method according to claim 10, wherein each of the nozzle groups corresponds to a print chip provided for the print head.

14. The printing method according to claim 13, wherein each of the nozzle groups corresponds to one of divided sections of the print chip provided for the print head.

15. The printing method according to claim 10, wherein the ejection characteristics are volumes of ink ejected from the nozzles.

16. The printing method according to claim 10, further comprising a density data generation step of generating density data indicating the density of an image to be formed in the unit area based on input image data, and the arrangement determination step determines the arrangement of dots to be formed in the unit area based on the density data generated in the density data generation step.

17. The printing method according to claim 10, wherein the arrangement determination step determines the arrangement of dots according to a dot pattern corresponding to the density of the image to be formed in the unit area and the size determination step determines the sizes of dots corresponding to the dot pattern by using distribution patterns which represent printing indicating whether the size is the first size or the second size for a plurality of dots depicted by the dot pattern.

18. The printing apparatus according to claim 17, further comprising a first storing step of storing a plurality of dot patterns corresponding to a plurality of density levels in a first memory and a second storing step of storing a plurality of distribution patterns corresponding to the plurality of dot patterns, respectively, in a second memory and the ratios are substantially the same as one another between the plurality of distribution patterns.

* * * * *